US006591183B2

(12) United States Patent
Ishikawa et al.

(10) Patent No.: US 6,591,183 B2
(45) Date of Patent: Jul. 8, 2003

(54) CONTROL APPARATUS FOR INTERNAL COMBUSTION ENGINE

(75) Inventors: Yosuke Ishikawa, Gifu (JP); Katsuhiko Kawai, Nagoya (JP); Masayuki Kita, Kariya (JP)

(73) Assignee: Denso Corporation, Kariya (JP)

( * ) Notice: Subject to any disclaimer, the term of this patent is extended or adjusted under 35 U.S.C. 154(b) by 193 days.

(21) Appl. No.: 09/838,591

(22) Filed: Apr. 20, 2001

(65) Prior Publication Data

US 2002/0038177 A1 Mar. 28, 2002

(30) Foreign Application Priority Data

| | | |
|---|---|---|
| Apr. 21, 2000 | (JP) | 2000-126281 |
| Jun. 9, 2000 | (JP) | 2000-179359 |
| Dec. 28, 2000 | (JP) | 2000-404671 |
| Dec. 28, 2000 | (JP) | 2000-404672 |
| Dec. 28, 2000 | (JP) | 2000-404694 |

(51) Int. Cl.[7] ..... F02D 41/14

(52) U.S. Cl. ..... 701/103; 60/276; 123/694; 701/108; 701/109

(58) Field of Search ..... 701/103, 108, 701/109, 102, 114; 60/274, 276, 285; 123/674, 672, 690, 691, 694, 704

(56) References Cited

U.S. PATENT DOCUMENTS

| | | | | |
|---|---|---|---|---|
| 4,763,629 A | * | 8/1988 | Okazaki et al. | 123/683 |
| 5,031,450 A | * | 7/1991 | Nakaniwa et al. | 73/115 |
| 5,157,920 A | * | 10/1992 | Nakaniwa | 60/274 |
| 5,172,676 A | * | 12/1992 | Imamura | 123/682 |
| 5,243,951 A | * | 9/1993 | Nakaniwa | 123/674 |
| 5,255,662 A | * | 10/1993 | Nakajima | 123/674 |
| 5,579,637 A | | 12/1996 | Yamashita et al. | 60/276 |
| 5,638,800 A | * | 6/1997 | Furuya et al. | 123/674 |
| 5,694,910 A | | 12/1997 | Hasegawa | 123/674 |
| 5,845,491 A | | 12/1998 | Yasui et al. | 60/276 |
| 6,192,857 B1 | * | 2/2001 | Shimada | 123/481 |
| 2001/0013335 A1 | * | 8/2001 | Hosokawa et al. | 123/478 |
| 2002/0104310 A1 | * | 8/2002 | Ikemoto et al. | 60/285 |

FOREIGN PATENT DOCUMENTS

| | | |
|---|---|---|
| JP | 2518247 | 5/1996 |
| JP | 9-324681 | 12/1997 |
| JP | 10-30478 | 2/1998 |
| JP | 10-115243 | 5/1998 |

* cited by examiner

*Primary Examiner*—Hieu T. Vo
(74) *Attorney, Agent, or Firm*—Nixon & Vanderhye P.C.

(57) ABSTRACT

An intermediate target value calculating unit calculates an intermediate target value $\phi$midtg(i) on the basis of an output $\phi(i-1)$ of an A/F ratio sensor in computation of last time and a final target value $\phi$tg(i). By the computation, the intermediate target value $\phi$midtg(i) is set between the output $\phi(i-1)$ of the A/F ratio sensor in computation of last time and the final target value $\phi$tg(i). A correction amount calculating unit calculates a correction amount AFcomp(i) of the target A/F ratio on the basis of a deviation $\Delta\phi(i)$ between the intermediate target value $\phi$midtg(i) and the output $\phi(i)$ of the A/F ratio sensor. Consequently, the control is hard to be influenced by variations in waste time of the subject to be controlled and an error in modeling. While maintaining the stability of the A/F ratio feedback control, higher gain can be achieved and robustness can be also increased.

27 Claims, 32 Drawing Sheets

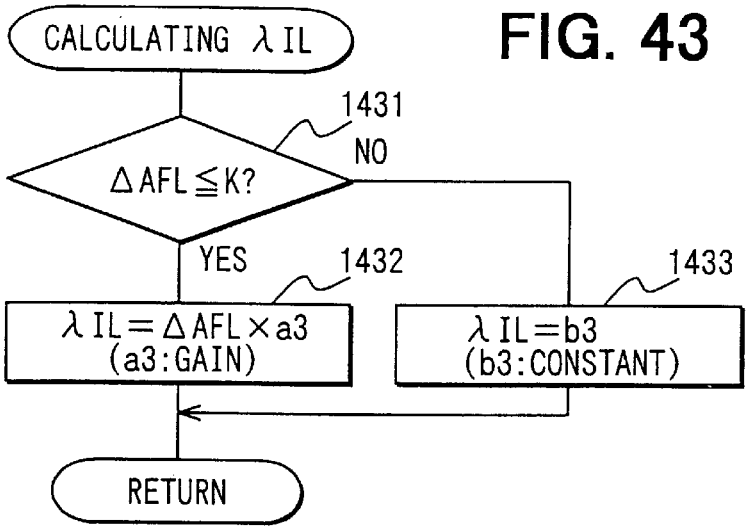
FIG. 43
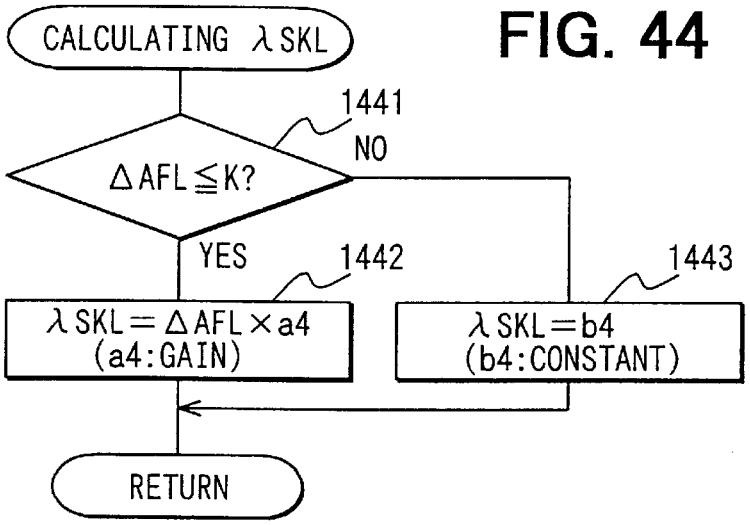
FIG. 44
FIG. 46
| A/F DEVIATION | 0.01 | 0.015 | 0.02 | 0.025 | 0.03 | 0.035 | 0.04 | 0.045 |
|---|---|---|---|---|---|---|---|---|
| PARAMETER | 0.001 | 0.002 | 0.003 | 0.005 | 0.008 | 0.012 | 0.003 | 0.003 |
A/F DEVIATION: ΔAFR, ΔAFL
PARAMETER: λIR, λSKR, λIL, λSKL

CONTROL APPARATUS FOR INTERNAL COMBUSTION ENGINE

CROSS REFERENCE TO RELATED APPLICATION

This application is based on and incorporates herein by reference Japanese Patent Application Nos. 2000-126281 filed on Apr. 21, 2000, 2000-179359 file on Jun. 9, 2000, 2000-404671 filed on Dec. 28, 2000, 2000-404672 filed on Dec. 28, 2000, and 2000-404694 filed on Dec. 28, 2000.

BACKGROUND OF THE INVENTION 1. Field of the Invention

The present invention relates to a control apparatus for an internal combustion engine, for feedback controlling an input of a subject to be controlled in an internal combustion engine.

2. Description of Related Art

In a vehicle under advanced electronic control in recent years, various controls are performed by feedback controls. For example, the feedback control is used for A/F ratio control (fuel injection control), variable valve timing control, electronic throttle control, fuel pump control, boost pressure control of a turbo charger, idle speed control, cruise control, and the like.

A conventional feedback control is carried out in such a manner that an output (controlled variable) of a subject to be controlled is detected by a sensor or the like, a correction amount of an input (operation amount) of the control subject is calculated in accordance with a deviation between the output of the control subject and a target value so that the output of the control subject coincides with the target value, and the input of the control subject is corrected by the correction amount to make the output of the control subject follow the target value.

In many cases, a system as a subject of the feedback control in a vehicle has a long waste time (a large delay element) and, moreover, the waste time varies according to the engine operating conditions, deterioration with time in a control system, and the like. Consequently, the conventional feedback control is easily influenced by the variations in waste time. When a higher gain is set to increase the response, the feedback control becomes unstable, and there is the possibility that hunting occurs. In the conventional feedback control, it is therefore difficult to realize both higher gain (higher response) and stability. Moreover, there is a drawback such that the stability is apt to deteriorate due to an influence of an error in modeling of the control subject, and robustness is low.

A vehicle has a three-way catalyst in its exhaust pipe to treat exhaust gases. In order to increase catalytic conversion efficiency, it is necessary to control the concentration of an exhaust gas to be within a catalytic conversion window (about target A/F ratio). An exhaust gas sensor (A/F ratio sensor or oxygen sensor) is disposed on each of the upstream and downstream sides of a catalyst, a fuel injection amount is feedback controlled so that the A/F ratio of an exhaust gas detected by the exhaust gas sensor on the upstream side is equal to an upstream-side target A/F ratio, and a sub-feedback control is performed to correct the upstream-side target A/F ratio so that the A/F ratio of the exhaust gas detected by the downstream-side exhaust gas sensor is equal to a downstream-side target A/F ratio.

The conventional sub-feedback control is performed by PID control. Recently, in order to increase control accuracy, as shown by the publication of JP-A-9-273439, a technique of using sliding mode control has been proposed. The sliding mode control relates to a feedback control method of a variable structure type of preliminarily building a hyperplane expressed by a linear function using a plurality of state variables of a subject to be controlled as variables, allowing a state variable to converge on the hyperplane by high gain control at high speed, and allowing the state variable to converge on a required equilibrium point on the hyperplane by an equivalent control input while restricting the state variable on the hyperplane.

Generally, the sliding mode control has an advantage that once the state variable of the control subject converges on the hyperplane, the state variable can stably converge on an equilibrium point on the hyperplane without almost no influence of disturbance or the like. However, only a mode of a subject to be controlled in the case where a state variable converges on a hyperplane is considered. Consequently, when the sliding mode control is applied to control the A/F ratio of exhaust gas as in the publication, generally, at a high gain, hunting occurs due to disturbances and waste time around the hyperplane, and a state such that the state variable does not converge on the hyperplane occurs. As shown in FIG. 25, an inconvenience such that an output of the downstream-side exhaust gas sensor (A/F ratio of the exhaust gas on the downstream side of the catalyst) does not converge on a target value (target A/F ratio on the downstream side) may occur depending on the initial states. On the other hand, at a low gain, there is a drawback such that an input is insufficient for an error in modeling, so that response deteriorates and, as shown in FIG. 26, the speed of convergence of an output of the downstream-side exhaust gas sensor (concentration of the exhaust gas on the downstream side of the catalyst) becomes conspicuously slow.

Further, as disclosed in Japanese Patent No. 2,518,247, it is proposed to increase an update amount of an exhaust gas A/F ratio feedback control constant (for example, a skip amount) as the deviation between an A/F ratio detected by the downstream-side exhaust gas sensor and the downstream-side target exhaust gas A/F ratio becomes larger.

Here, dynamic characteristics of a catalyst vary according to the degree of deterioration of the catalyst, catalytic conversion state, and engine operating conditions. However, it cannot be the that the response of sub feedback control of the conventional main/sub feedback system to a change in dynamic characteristics of a catalyst is sufficient. Consequently, there is the possibility that a delay occurs in the response of the sub feedback control to a change in dynamic characteristics of the catalyst, concentration of exhaust gas on the downstream side of the catalyst (output of the downstream-side exhaust gas sensor) becomes unstable, and hunting occurs.

A conventional feedback control is carried out in such a manner that an output (controlled variable) of a subject to be controlled is detected by a sensor or the like, a correction amount of an input (operation amount) of the control subject is calculated by proportional integral and derivative control (PID control) in accordance with a deviation between the output of the control subject and a target value so that the output of the control subject coincides with the target value, and the input of the control subject is corrected by the correction amount to make the output of the control subject follow the target value.

A correction amount calculated by a conventional feedback control using the PID control is derived by adding a proportional term, an integral term, and a differential term. Generally, in order to improve a start-up characteristic in the case where an output of a subject to be controlled follows a target value, it is effective to increase the gain of the differential term. It is presumed that, when the gain of the differential term is set to be too high, an influence of noise becomes large, overshoot occurs, and the performance of following the target value deteriorates. In the conventional feedback control, therefore, the gain of the differential term is set to be low and the gain of the proportional term is set to be high, thereby improving the performance of following the target value.

In various feedback controls regarding the engine control of a vehicle, however, a relatively large waste time and a phase delay exist in a subject to be controlled, and disturbance is large. Consequently, when the gain is increased to make response faster, the feedback control becomes unstable, and there is the possibility that hunting occurs. In the conventional feedback control, it is therefore difficult to realize both higher gain (higher response) and stability. Moreover, there is a drawback such that the stability is apt to deteriorate due to an influence of an error in modeling of the control subject, and robustness is low.

As an engine control system of a vehicle, in order to improve exhaust gas conversion efficiency of a three-way catalyst by increasing control accuracy of exhaust gas A/F ratio, there is what is called a two-sensor type exhaust gas A/F ratio control system in which a sensor for detecting A/F ratio of an exhaust gas (oxygen sensor or broad-range exhaust gas A/F ratio sensor) is disposed on each of the upstream and downstream sides of a catalyst, and which performs feedback control to make an actual exhaust gas A/F ratio on the upstream side of the catalyst coincide with a target exhaust gas A/F ratio on the basis of an output of the upstream-side sensor while carrying out sub feedback control for correcting a target exhaust gas A/F ratio of A/F ratio feedback control on the upstream side of the catalyst on the basis of an output of the downstream side sensor.

In such a two-sensor type exhaust gas A/F ratio control system, it is known that in a state where the target exhaust gas A/F ratio on the upstream side of the catalyst is deviated from a theoretical exhaust gas A/F ratio range, when the sub feedback control based on the output of the downstream side sensor is continued under conditions similar to those of the state where the target exhaust gas A/F ratio is in the theoretical exhaust gas A/F ratio range, the exhaust gas A/F ratio cannot be controlled accurately (refer to JP-A-10-30478). Specifically, when the state where the target exhaust gas A/F ratio on the upstream side of the catalyst is deviated from the theoretical exhaust gas A/F ratio continues for a while, there is a case that a harmful component adsorbing state of the catalyst becomes almost saturated. In such a state, when the sub feedback control based on the output of the downstream side sensor is continued under conditions similar to those in the state where the target exhaust gas A/F ratio is in the theoretical exhaust gas A/F ratio range (the state where the catalyst is not saturated), the target exhaust gas A/F ratio on the upstream side of the catalyst is excessively corrected. Even when the exhaust gas A/F ratio on the upstream side of the catalyst is returned to the theoretical exhaust gas A/F ratio range, a delay in the exhaust gas A/F ratio downstream of the catalyst becomes large by a substance adsorbed by the catalyst, and a return from the excessive correcting state to a normal state is delayed.

JP-A-10-30478 therefore discloses a technique of inhibiting the sub feedback control based on the output of the downstream side sensor when the target exhaust gas A/F ratio at the upstream of the catalyst is deviated from the theoretical exhaust gas A/F ratio.

When the sub feedback control based on the output of the downstream side sensor is inhibited and the exhaust gas A/F ratio feedback control is performed by using only the output of the upstream side sensor in the case where the target exhaust gas A/F ratio at the upstream of the catalyst is deviated from the theoretical exhaust gas A/F ratio, a converting state of the exhaust gas passing through the catalyst (A/F ratio of the exhaust gas downstream of the catalyst) cannot be reflected in the exhaust gas A/F ratio feedback control at all. Consequently, there is a case that the catalytic conversion efficiency deteriorates.

SUMMARY OF THE INVENTION

A first object of the present invention is to provide a control apparatus for an internal combustion engine, capable of realizing both higher gain (higher response) and stability of a feedback control and also increased robustness.

According to a first aspect of the present invention, a control apparatus for an internal combustion engine of the invention sets an intermediate target value on the basis of an output of a subject to be controlled and a final target value by intermediate target value setting means, and calculates a correction amount of an input of the subject to be controlled on the basis of the output of the subject to be controlled and the intermediate target value. By setting not only the final target value but also the intermediate target value as described above, the control is not easily influenced by variations in waste time (lag element) of the subject to be controlled and an error in modeling. While maintaining the stability of the feedback control, higher gain (higher response) can be achieved. Thus, both higher gain and stability of the feedback control can be realized, and robustness can be also increased.

A second object of the present invention is to provide an exhaust gas A/F ratio control apparatus for an internal combustion engine having improved transient characteristics during a period in which exhaust gas A/F ratio detected by a downstream-side exhaust gas sensor (A/F ratio of exhaust gas on the downstream side of a catalyst) converges to target A/F ratio and capable of realizing both prevention of hunting and improved response.

According to a second aspect of the present invention, an exhaust gas A/F ratio control apparatus for an internal combustion engine calculates a correction amount of an upstream-side target exhaust gas A/F ratio on the basis of a state variable derived from an exhaust gas A/F ratio detected by a downstream-side exhaust gas sensor by using a back stepping method. In the back stepping method, an almost ideal convergence locus of the state variable (target convergence locus) is set by a virtual input term. While converging the deviation between the state variable and the virtual input term, a control is performed in consideration of the deviation between the state variable and the target value as well. Consequently, even under the conditions that the deviation between the state variable and the virtual input term is not equal to zero, the state variable can be stably converged. Therefore, even under the conditions that an influence of disturbance and waste time is exerted and the state variable is not easily converged by the conventional sliding mode control, the state variable can be smoothly converged, and the A/F ratio of the exhaust gas on the downstream side of the catalyst can be converted to the target A/F ratio with high response.

A third object of the present invention is to provide an exhaust gas A/F ratio control apparatus for an internal combustion engine, capable of performing stable exhaust gas A/F ratio control with improved response of sub feedback control to a change in dynamic characteristics of a catalyst.

According to a third aspect of the present invention, in an exhaust gas A/F ratio control apparatus for an internal combustion engine of the invention, exhaust gas sensors are provided on the upstream and downstream sides of a catalyst, a fuel injection amount is feedback-controlled by exhaust gas A/F ratio feedback control means so that the exhaust gas A/F ratio detected by the upstream-side exhaust gas sensor becomes an upstream-side target exhaust gas A/F ratio, and the upstream-side target exhaust gas A/F ratio is corrected by sub feedback control means so that the exhaust gas A/F ratio detected by the downstream-side exhaust gas sensor becomes the downstream-side target exhaust gas A/F ratio. In the apparatus, intermediate target value setting means sets an intermediate target value of the sub feedback control on the basis of the exhaust gas A/F ratio detected by the downstream-side exhaust gas sensor and a final downstream-side target exhaust gas A/F ratio, and a correction amount of the upstream side target exhaust gas A/F ratio is calculated on the basis of the exhaust gas A/F ratio detected by the downstream-side exhaust gas sensor and the intermediate target value. In such a manner, the response of the sub feedback control to a change in dynamic characteristics of the catalyst is improved. The exhaust gas A/F ratio on the downstream side of the catalyst (output of the downstream-side exhaust gas sensor) becomes stable, no hunting due to a change in dynamic characteristics of the catalyst occurs, and stable control on the exhaust gas A/F ratio can be performed.

A fourth object of the present invention is to provide a control apparatus for an internal combustion engine, capable of realizing both higher gain (higher response) and stability of a feedback control and also increased robustness.

According to a fourth aspect of the present invention, a control apparatus for an internal combustion engine of the invention calculates a correction amount of an input of a subject to be controlled by proportional derivative control (PD control) in which the gain of a differential term is higher than the gain of a proportional term by proportional derivative means, and regulates the correction amount within a predetermined range by regulating means. Specifically, the invention is characterized in that (i) the correction amount is calculated by the proportional derivative control, (ii) by setting the gain of the differential term to be higher than the gain of the proportional term, the characteristic of start-up of following the target value, of an output of the subject to be controlled is improved, and (iii) the correction amount calculated by the proportional derivative control is regulated within the predetermined range, thereby solving the inconveniences caused by setting the high gain in the differential term (problems of the influence of noise and deterioration in following the target value). Consequently, even to a subject to be controlled having long waste time or a large phase delay and a subject to be controlled having large disturbance, while maintaining the stability of the feedback control, the gain (response) can be increased. Both higher gain and stability in the feedback control can be realized. The control apparatus is not easily influenced by an error in modeling, and robustness can be also enhanced.

A fifth object of the present invention is to provide an exhaust gas concentration control apparatus for an internal combustion engine, capable of properly reflecting a converting state of an exhaust gas passing through a catalyst (A/F ratio of the exhaust gas at the downstream of the catalyst) into exhaust gas A/F ratio feedback control even when the target exhaust gas A/F ratio on the upstream side of the catalyst is deviated from the theoretical exhaust gas A/F ratio range, and having improved catalytic conversion efficiency.

According to a fifth aspect of the present invention, in an exhaust gas A/F ratio control apparatus for an internal combustion engine of the invention, when a sensor for detecting A/F ratio of exhaust gas is provided on each of the upstream and downstream sides of a catalyst, exhaust gas A/F ratio feedback control on the upstream side of the catalyst is performed by exhaust gas A/F ratio feedback control means on the basis of an output of the upstream side sensor, and sub feedback control for reflecting an output of the downstream side sensor into the feedback control on the exhaust gas A/F ratio on the upstream side of the catalyst is performed by sub feedback control means, at least one of parameters of the sub feedback control is variably set by parameter varying means in accordance with a deviation between the exhaust gas A/F ratio on the upstream side of the catalyst and a theoretical exhaust gas A/F ratio. Consequently, also in the case where the deviation between the exhaust gas A/F ratio on the upstream side of the catalyst and the theoretical exhaust gas A/F ratio is large (in a region where the sub feedback control is inhibited in a conventional system), the sub feedback control is executed so as not to excessively correct the deviation. The conversion state of the exhaust gas passing the catalyst (exhaust gas A/F ratio on the downstream side of the catalyst) can be properly reflected in the exhaust gas A/F ratio feedback control on the upstream side of the catalyst. Thus, the catalytic conversion efficiency can be improved as compared with the conventional system.

BRIEF DESCRIPTION OF THE DRAWINGS

FIG. 43 is a flowchart showing the flow of processes of a lean integral term λIL calculating program (twelfth embodiment);

FIG. 44 is a flowchart showing the flow of processes of a lean skip term λSKL calculating program (twelfth embodiment);

FIG. 46 is a diagram showing an example of a table used to calculate a parameter according to an exhaust gas A/F ratio deviation (twelfth embodiment).

DETAILED DESCRIPTION OF PREFERRED EMBODIMENTS

First Embodiment

An air-fuel ratio feedback control system as a first embodiment of the invention will be described hereinbelow with reference to FIGS. 1–5.

Figure 1:
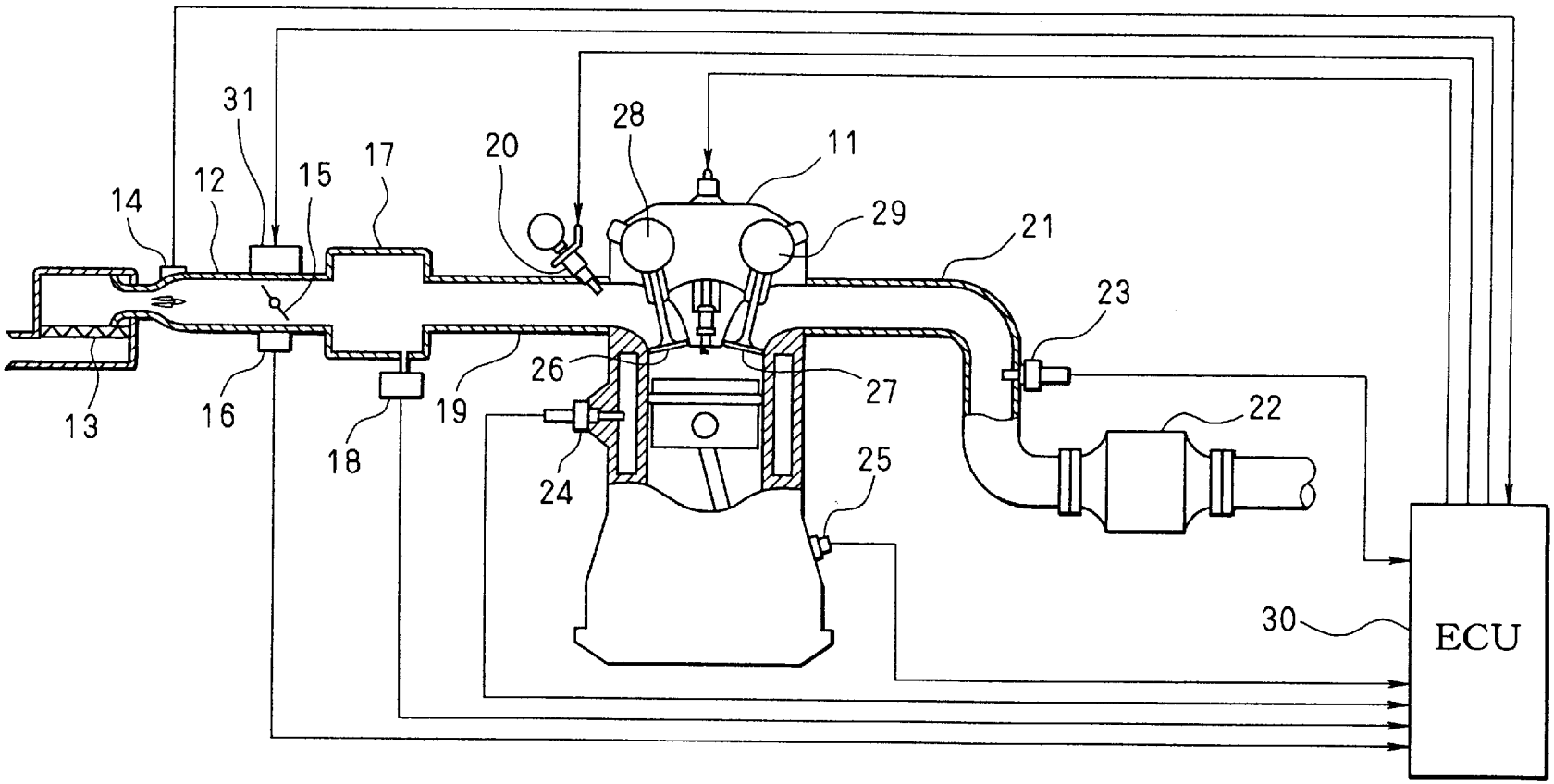
FIG. 1 is a schematic configuration diagram of a whole engine control system in an A/F ratio feedback control system (first embodiment)

First, the schematic configuration of a whole engine control system will be described by referring to FIG. 1. In the uppermost stream part of an intake pipe 12 of an engine 11 as an internal combustion engine, an air cleaner 13 is provided. On the downstream side of the air cleaner 13, an air flow meter 14 for detecting an intake air amount is provided. On the downstream side of the air flow meter 14, a throttle valve 15 driven by a motor 31 such as a DC motor is provided. The angle (throttle angle) of the throttle valve 15 is detected by a throttle angle sensor 16. During engine operation, a controlled variable of the motor 31 is feedback controlled so that an actual throttle angle detected by the throttle angle sensor 16 coincides with a target throttle angle set according to an accelerator operation amount or the like.

On the downstream side of the throttle valve 15, a surge tank 17 is provided, and the surge tank 17 is provided with an intake pressure sensor 18 for detecting an intake pressure P. The surge tank 17 is provided with an intake manifold 19 for introducing the air into each of cylinders of the engine 11. Near the intake port of the intake manifold 19 of each cylinder, a fuel injection valve 20 for injecting fuel is attached. An intake valve 26 and an exhaust valve 27 of the engine 11 are driven by variable valve timing adjusting mechanisms 28 and 29, respectively, and an intake/exhaust valve timing (VVT angle) is adjusted according to engine operating conditions. The variable valve timing adjusting mechanisms 28 and 29 may be of a hydraulic driving system or electromagnetic driving system.

In some midpoint of an exhaust pipe 21 of the engine 11, a catalyst 22 such as a three-way catalyst for treating exhaust gas is disposed. On the upstream side of the catalyst 22, an air-fuel (A/F) ratio sensor (or oxygen sensor) 23 for detecting the A/F ratio of the exhaust gas (or A/F ratio of oxygen) is provided. To a cylinder block of the engine 11, a cooling water temperature sensor 24 for detecting the temperature of cooling water and an engine speed sensor 25 (crank angle sensor) for detecting the engine speed area attached.

Outputs of the various sensors are supplied to an engine control unit (hereinbelow, referred to as "ECU") 30. The ECU 30 is constructed mainly by a microcomputer and executes an A/F ratio feedback control program stored in a built-in ROM (storage medium), thereby performing a feedback control so that the A/F ratio on the upstream side of the catalyst 22 coincides with the target A/F ratio. The ECU 30 also performs various feedback controls such as throttle angle control, variable valve timing control, idle speed control, fuel pressure feedback control (fuel pump control), and cruise control.

Figure 2:
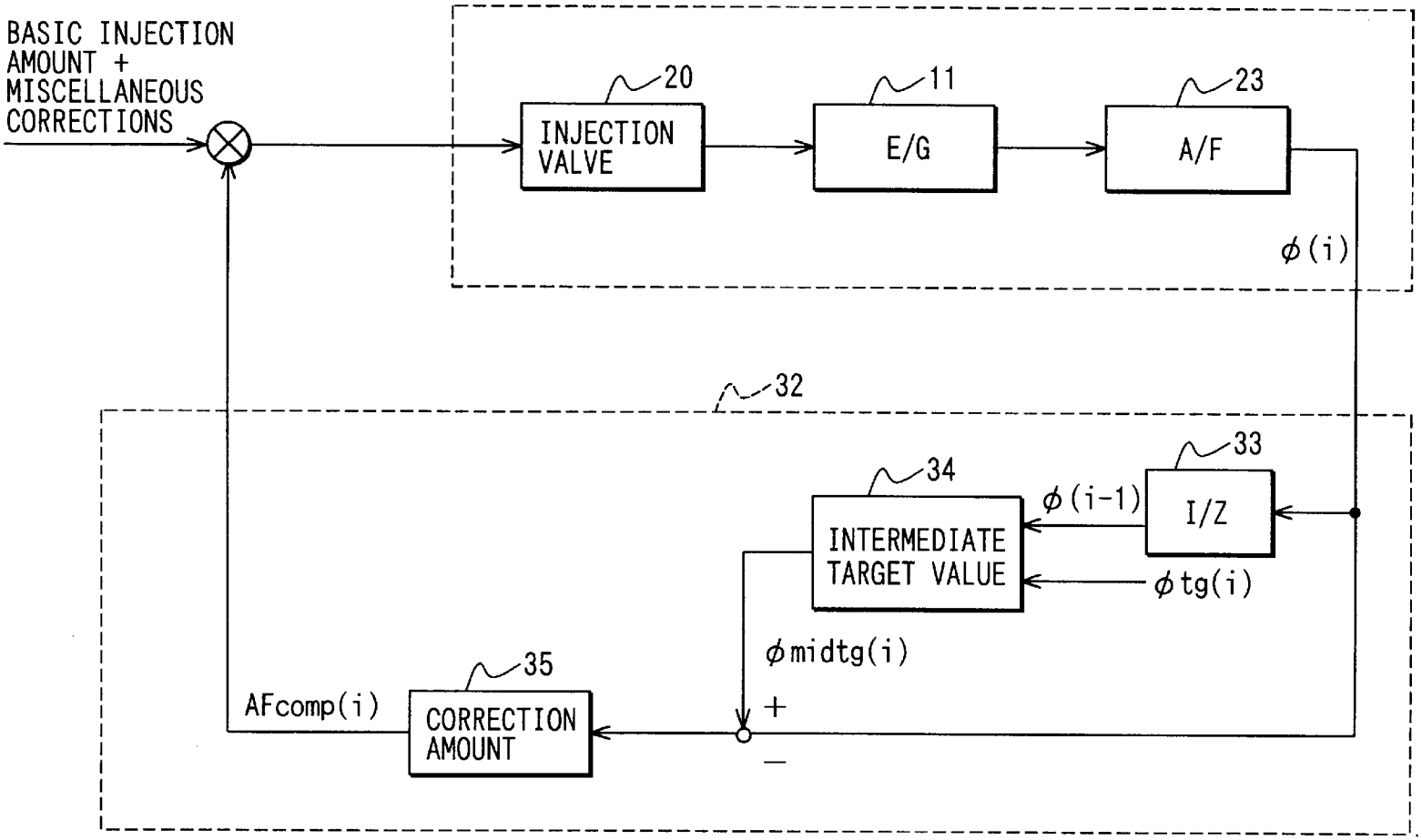
FIG. 2 is a block diagram showing the functions of the whole A/F ratio feedback control system (first embodiment)

The present invention can be applied to any of the feedback controls, the case of applying the invention to the A/F ratio feedback control will be described by referring to FIGS. 2–5. FIG. 2 is a functional block diagram showing the outline of an A/F ratio feedback control system. The subject of the A/F ratio feedback control is a system including the fuel injection valve 20, engine 11, and A/F ratio sensor 23. An input of the control subject is a fuel injection amount obtained by correcting a fuel injection amount derived by adding miscellaneous correction amounts to a basic injection amount (or multiplying the basic injection amount by miscellaneous correction coefficients) by an output AFcomp of an A/F ratio feedback control unit 32. The basic injection amount is calculated by using a map or mathematical expression in accordance with an intake air amount (or intake pipe pressure) and engine speed. Miscellaneous correction amounts include, for example, a correction amount according to a cooling water temperature, a correction amount at the time of acceleration/deceleration driving, and a correction amount in a learning control. An output of the control subject is an output $\phi$(A/F ratio, excess air ratio, or excess fuel ratio) of the A/F ratio sensor 23.

The A/F ratio feedback control unit 32 has a time lag element (1/z) 33, an intermediate target value calculating unit 34, and a correction amount calculating unit 35 and plays the role corresponding to feedback control means in the present invention. The time lag element 33 supplies an output $\phi(i-1)$ of the A/F ratio sensor 23 in computation of last time to the intermediate target value calculating unit 34.

Figure 3:
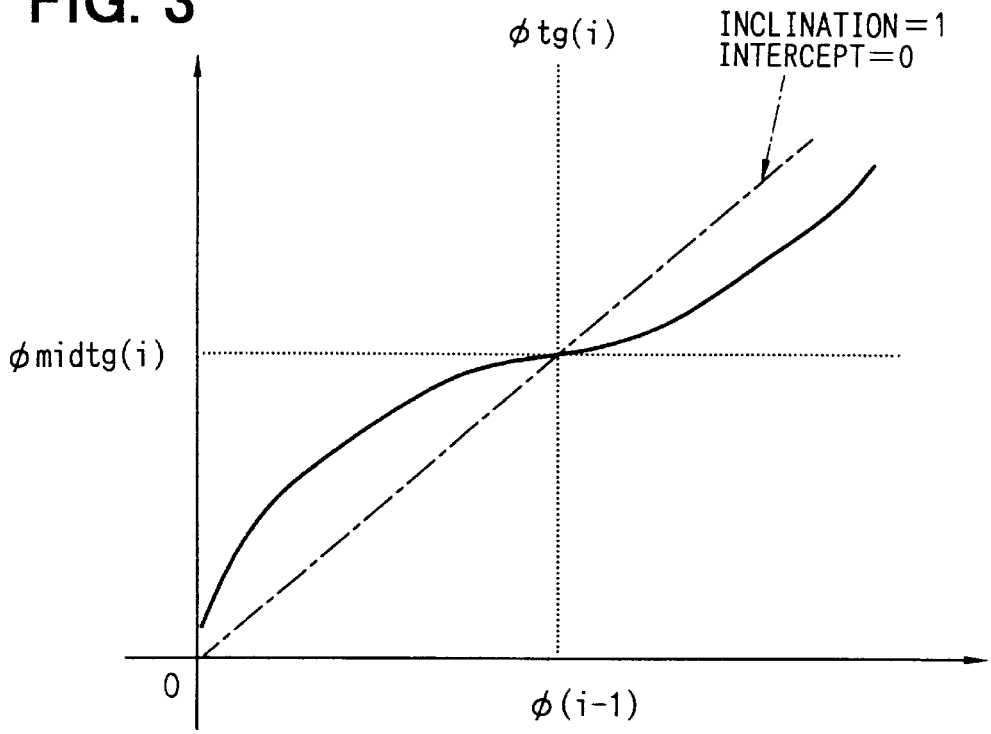
FIG. 3 is a diagram schematically showing a map for setting an intermediate target value $\phi$midtg(i) in accordance with an output $\phi(i-1)$ of an A/F ratio sensor in computation of last time (first embodiment)

The intermediate target value calculating unit 34 plays the role corresponding to intermediate target value setting means in the present invention and calculates an intermediate target value $\phi$midtg(i) on the basis of the output $\phi(i-1)$ of the A/F ratio sensor 23 in computation of last time and a final target value $\phi$tg(i) (final target A/F ratio) by using a map of FIG. 3 or the following equation (1). By the calculation, the intermediate target value $\phi$midtg(i) is set between the output $\phi(i-1)$ of the A/F ratio sensor 23 in computation of last time and the final target value $\phi$tg(i).

The map of FIG. 3 for setting the intermediate target value $\phi$midtg(i) is expressed by a non-linear increasing function which is set as follows. When the output $\phi(i-1)$ of the A/F ratio sensor 23 in computation of last time is smaller than the final target value $\phi$tg(i), that is, when the A/F ratio of exhaust gas is lean, the intermediate target value $\phi$midtg(i) is positioned upper than the linear line having inclination of 1 and intercept of 0. On the contrary, when the output $\phi(i-1)$ of the A/F ratio sensor 23 in computation of last time is larger than the final target value $\phi$tg(i), that is, when the A/F ratio of exhaust gas is rich, the intermediate target value $\phi$midtg(i) is positioned lower than the linear line having inclination of 1 and intercept of 0. The curve of the non-linear increasing function may be determined by statistic characteristics of the A/F ratio sensor 23.

In the case of calculating the intermediate target value $\phi$midtg(i) by a mathematical expression, the following expression (1) may be used.

$$\phi midtg(i)=\phi tg(i)+Kdec\times\{\phi(i-1)-\phi tg(i)\} \tag{1}$$

In the equation, $\phi$tg(i) is a final target value of this time, and $\phi(i-1)$ is an output of the A/F ratio sensor 23 in computation of last time. Kdec denotes a positive coefficient less than 1 (hereinbelow, called a "damping factor" and is set in the range of $0<Kdec<1$. The damping factor Kdec may be a fixed value for a simplified computing process or, for example, may be set by using a map or mathematical expression in accordance with the engine operating conditions (such as intake air amount and engine speed).

An output change characteristic of the A/F ratio sensor 23 (oxygen sensor) is that the response of a change from the fuel lean state to the fuel rich state and that of a change from the rich state to the lean state are not the same but the former is fast and the latter is slow. In consideration of the characteristic, the damping factor Kdec in the rich state and that in the leans state with respect to the final target value $\phi$tg(i) may be different from each other. In such a manner, the intermediate target value $\phi$midtg(i) can be obtained with high accuracy by compensating the difference between the response in the rich state and that in the lean state.

After calculating the intermediate target value $\phi$midtg(i) by using the map of FIG. 3 or the above equation (1) as described above, the correction amount AFcomp(i) of the target A/F ratio is calculated by the following equation using the intermediate target value $\phi$midtg(i).

$$\begin{aligned} AFcomp(i)&=Fsat\{K1\times(\phi midtg(i)-\phi(i))+K2\times\Sigma(\phi midtg(i)-\phi(i))\}+f(\phi tg(i))= \\ &Fsat(K1\times\Delta\phi(i)+K2\times\Sigma\Delta\phi(i))+f(\phi tg(i)) \\ &\text{where } \Delta\phi(i)=\phi midtg(i)-\phi(i) \end{aligned} \tag{2}$$

Figure 4:
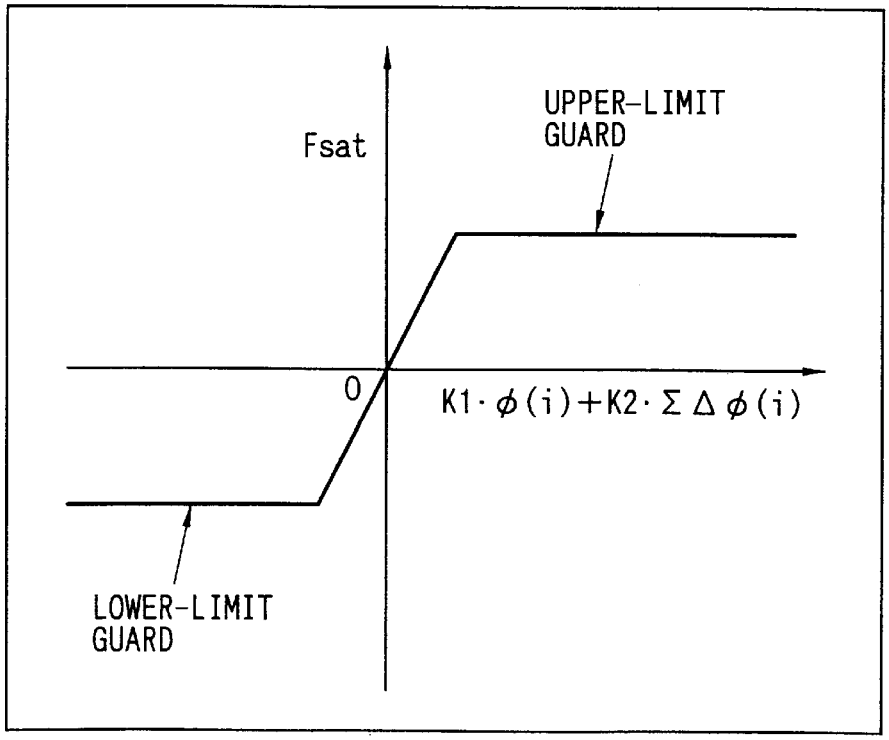
FIG. 4 is a diagram for explaining a saturation function for calculating a correction amount AFcomp(i) (first embodiment)

In the equation (2), Fsat denotes a saturation function having characteristics as shown in FIG. 4 and is obtained by setting an upper-limit guard value and a lower-limit guard value for a computation value of $K1\times\Delta\phi(i)+K2\times\Sigma(\Delta\phi(i))$. In the equation, K1 denotes a proportional gain and K2 expresses an integral gain. Consequently, $K1\times\Delta\phi(i)$ denotes a proportional term which increases as the deviation value $\Delta\phi(i)$ between the intermediate target value $\phi$midtg(i) and the output $\phi(i)$ of the A/F ratio sensor 23 becomes larger. $K2\times\Sigma\Delta\phi(i)$ denotes an integration term which becomes larger as an integration value between the intermediate target value $\phi$midtg(i) and the output $\phi(i)$ of the A/F ratio sensor 23 becomes larger. f($\phi$tg(i)) is calculated by a map or mathematical expression using the final target value $\phi$tg(i) as a parameter. f($\phi$tg(i) may be equal to $\phi$tg(i) (in the case where $\phi$tg(i) is expressed by an excess air ratio) for a simplified computing process.

Figure 5:
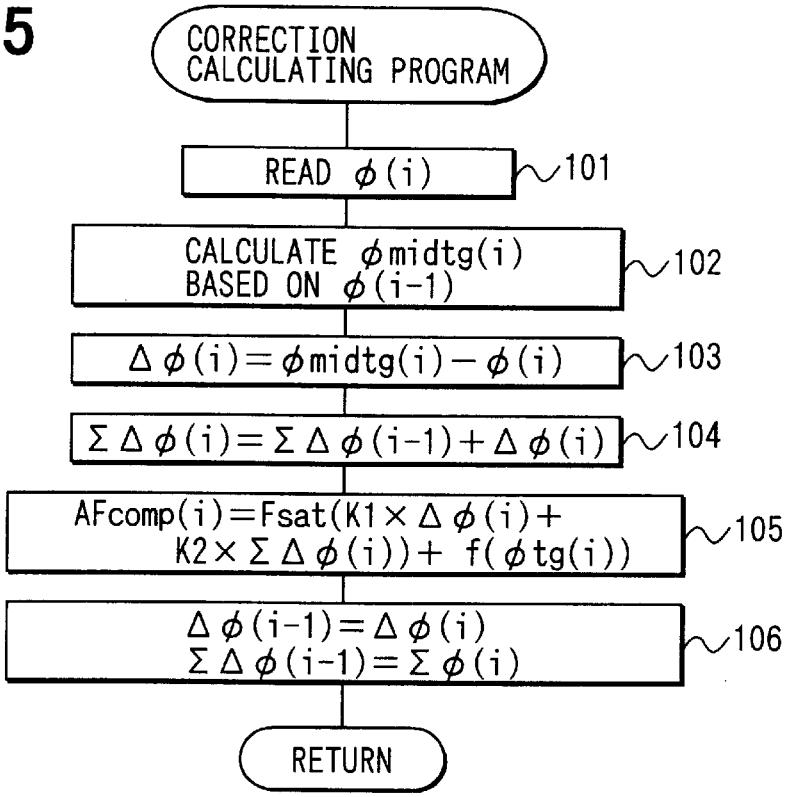
FIG. 5 is a flowchart showing the flow of a correction amount calculating program (first embodiment)

The above-described calculation of the correction amount AFcomp(i) by the A/F ratio feedback control unit 32 is executed by a correction amount calculating program of FIG. 5 which is executed every predetermined time or every predetermined crank angle.

When the program is started, first, in step 101, a current output $\phi(i)$ of the A/F ratio sensor 23 is read. In step 102, the intermediate target value $\phi$midtg(i) is calculated by using the map of FIG. 3 or the equation (1) on the basis of the output $\phi$(i−1) of the A/F ratio sensor 23 in computation of last time and the final target value $\phi$tg(i) (final target A/F ratio). By the calculation, the intermediate target value $\phi$midtg(i) is set between the output $\phi$(i−1) of the A/F ratio sensor 23 in computation of last time and the final target value $\phi$tg(i).

After that, the program advances to step 103 where the deviation $\Delta\phi$(i) between the intermediate target value $\phi$midtg(i) and the output $\phi$(i) of the A/F ratio sensor 23 is calculated.

$$\Delta\phi(i)=\phi midtg(i)-\phi(i) \tag{3}$$

In the following step 104, the integration value $\Sigma\Delta\phi$(i−1) of the deviation $\Delta\phi$ until the previous time is integrated with the deviation $\Delta\phi$(i) of this time, thereby calculating the integration value $\Sigma\Delta\phi$(i) until this time.

$$\Sigma\Delta\phi(i)=\Sigma\Delta\phi(\mathrm{i}-1)+\Delta\phi(i) \tag{4}$$

After that, the program advances to step 105 where the correction value AFcomp(i) of the target A/F ratio is calculated by the following equation.

$$AFcomp(i)=Fsat(\mathrm{K1}\times\Delta\phi(i)+\mathrm{K2}\times\Sigma\Delta\phi(i))+f(\phi tg(i)) \tag{5}$$

Here, Fsat(K1×$\Delta\phi$(i)+K2×$\Sigma\Delta\phi$(i)) is obtained by adding the proportional term (K1×$\Delta\phi$(i)) and the integral term (K2×$\Sigma\Delta\phi$(i)) while setting the upper-limit guard value and the lower-limit guard value. f($\phi$tg(i)) is calculated by a map or mathematical expression using the final target value $\phi$tg(i) as a parameter.

In step 106, $\Delta\phi$(i) and $\Sigma\Delta\phi$(i) of this time are stored as $\Delta\phi$(i−1) and $\Sigma\Delta\phi$(i−1) of last time, and the program is finished.

During the engine operation, the basic injection amount is calculated by a map or mathematical expression in accordance with the intake air volume (or intake pipe pressure) and the engine speed, a fuel injection amount is computed by adding various correction amounts according to the engine operating conditions to the basic injection amount, the fuel injection amount is multiplied by the correction amount AFcomp(i) to thereby obtain the final fuel injection amount, and the fuel injection amount of the fuel injection valve 20 is controlled.

According to the foregoing first embodiment, the intermediate target value $\phi$midtg(i) is calculated on the basis of the output $\phi$(i−1) of the A/F ratio sensor 23 in computation of last time and the final target value $\phi$tg(i), and the correction amount AFcomp(i) of the target A/F ratio is calculated on the basis of the deviation $\Delta\phi$(i) between the intermediate target value $\phi$midtg(i) and the output $\phi$(i) of the A/F ratio sensor 23. Consequently, the control is not easily influenced by variations in waste time (lag element) and modeling error of the control subject. While maintaining the stability of the A/F ratio feedback control, higher gain (higher response) can be realized. Both higher gain and stability of the A/F ratio feedback control can be achieved and robustness can be also increased.

In the above-described first embodiment, the output $\phi$(i−1) of the A/F ratio sensor 23 in computation of last time is used to calculate the intermediate target value $\phi$midtg(i). Alternatively, the output $\phi$(i−n) of the A/F ratio sensor 23 of the time before a predetermined number of computation times may be used.

Second Embodiment

In the case of applying the invention to an A/F ratio feedback control, another method of calculating an intermediate target value and a correction amount may be used. In short, it is sufficient to calculate an intermediate target value on the basis of an output of the A/F ratio sensor 23 and the final target value and compute a correction amount of the target A/F ratio on the basis of the intermediate target value and the output of the A/F ratio sensor 23.

Figure 6:
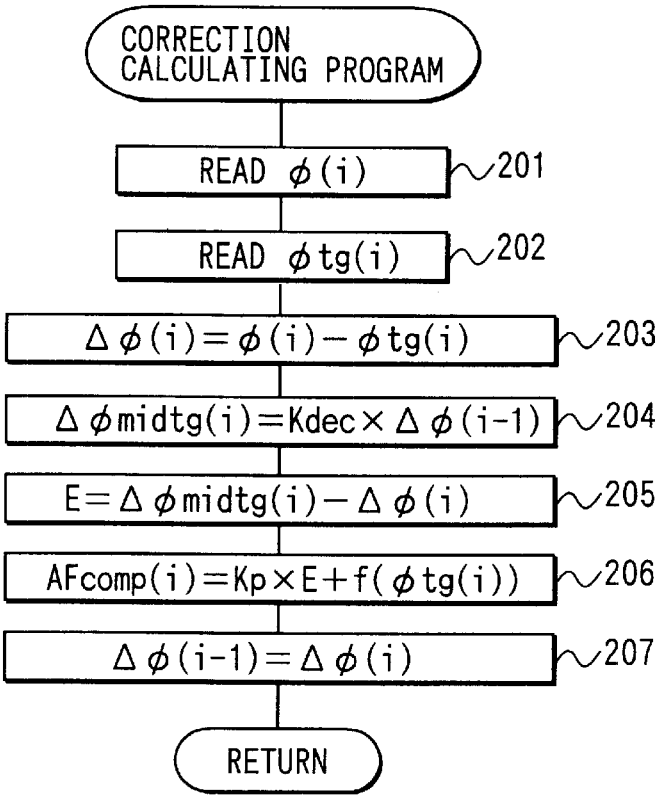
FIG. 6 is a flowchart showing the flow of a correction amount calculating program (second embodiment)

In the present second embodiment, by executing a correction amount calculating program of FIG. 6, the deviation $\Delta\phi$(i) between the output $\phi$(i) of the A/F ratio sensor 23 and the final target value $\phi$tg(i) is calculated, the intermediate target value $\Delta\phi$midtg(i) of the A/F ratio deviation is calculated on the basis of the A/F ratio deviation $\Delta\phi$(i−1) of last time, and the correction amount AFcomp(i) of the target A/F ratio is calculated on the basis of a deviation E between the intermediate target value $\Delta\phi$midtg(i) and the A/F ratio deviation $\Delta\phi$(i) of this time.

The correction amount calculating program of FIG. 6 is executed every predetermined time or predetermined crank angle. When the program is started, first, in step 201, the present output $\phi$(i) of the A/F ratio sensor 23 is read. In step 202, the final target value $\phi$tg(i) is read. After that, the program advances to step 203 where the deviation (A/F ratio deviation) $\Delta\phi$(i) between the output $\phi$(i) of the A/F ratio sensor 23 and the final target value $\phi$tg(i) is calculated.

$$\Delta\phi(i)=\phi(i)-\phi tg(i) \tag{6}$$

In step 204, the A/F ratio deviation $\Delta\phi$(i−1) in computation of last time is multiplied by the damping factor Kdec, thereby obtaining the intermediate target value $\Delta\phi$midtg(i) of the A/F ratio deviation.

$$\Delta\phi midtg(i)=Kdec\times\Delta\phi(\mathrm{i}-1) \tag{7}$$

Here, the damping factor Kdec may be a fixed value for a simplified computing process or, for example, set by using a map or mathematical expression in accordance with the engine operating conditions (such as intake air amount and engine speed). The damping factor Kdec may be varied according to whether the A/F ratio of exhaust gas is rich or lean with respect to the final target value $\phi$tg(i).

After that, the program advances to step 205 where the deviation E between the intermediate target value $\Delta\phi$midtg (i) and the A/F ratio deviation $\Delta\phi$(i) is calculated.

$$E=\Delta\phi midtg(i)-\Delta\phi(i) \tag{8}$$

In the step 206, the correction amount value AFcomp(i) of the target A/F ratio is calculated by the following equation using the deviation E.

$$AFcomp(i)=Kp\times E+f(\phi tg(i)) \tag{9}$$

Here, Kp denotes a proportional gain and f($\phi$tg(i)) is calculated by a map or mathematical expression using the final target value $\phi$tg(i) as a parameter. f($\phi$tg(i)) may be equal to $\phi$tg(i) (in the case of expressing $\phi$tg(i) as the excess air factor) for a simplified computing process.

After that, in step 207, $\Delta\phi$(i) of this time is stored as $\Delta\phi$(i−1) of last time, and the program is finished.

In the above-described second embodiment as well, effects similar to those in the first embodiment can be obtained.

Third Embodiment

Figure 7:
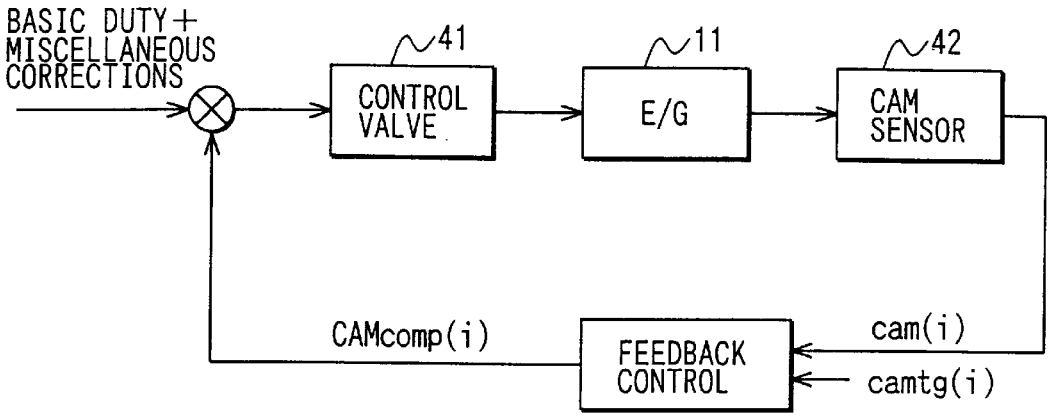
FIG. 7 is a schematic configuration diagram of a whole variable valve timing control system (third embodiment)

A variable valve timing control system according to the third embodiment of the invention will now be described with reference to FIGS. 7 and 8. As shown in FIG. 7, a subject of a variable valve timing control is a system including a hydraulic control valve 41 for controlling a hydraulic pressure of the variable valve timing adjusting mechanisms 28 and 29, the engine 11, and a cam sensor 42 for detecting a cam position cam(i) (valve timing). An input of the control subject is a hydraulic control duty obtained by correcting a hydraulic control duty derived by adding miscellaneous correction amounts to a basic duty (or multiplying the basic duty by various correction factors) by a cam position correction amount CAMcomp(i) calculated by a feedback control of the invention. The basic duty is calculated by a map or mathematical expression in accordance with the engine operating conditions. An output of the control subject is an output cam(i) (cam position) of the cam sensor 42.

Figure 8:
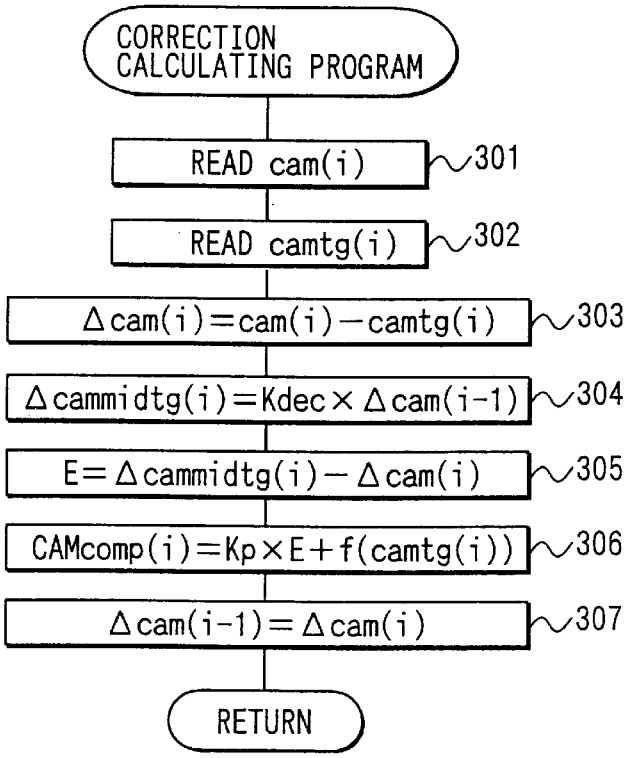
FIG. 8 is a flowchart showing the flow of processes of a correction amount calculating program (third embodiment)

A correction amount calculating program in FIG. 8 used in the third embodiment is executed every predetermined time or predetermined crank angle. When the program is started, first in step 301, a present cam position cam(i) detected by the cam sensor 42 is read. In step 302, a target cam position camtg(i) as a final target value is read. After that, the program advances to step 303 where a deviation (cam position deviation) Δcam(i) between the present cam position cam(i) and the target cam position camtg(i) is calculated.

$$\Delta cam(i)=cam(i)-camtg(i) \tag{10}$$

After that, the program advances to step 304 where the cam position deviation Δcam(i−1) in computation of last time is multiplied by the damping factor Kdec, thereby obtaining an intermediate target value Δcammidtg(i) of the cam position deviation.

$$\Delta cammidtg(i)=Kdec\times\Delta cam(\mathrm{i}-1) \tag{11}$$

The damping factor Kdec may be a fixed value for a simplified computing process or, for example, may be set by a map or mathematical expression in accordance with the engine operating conditions.

After that, the program advances to step 305 where a deviation E between the intermediate target value Δcammidtg(i) and the cam position deviation Δcam(i) is calculated.

$$E=\Delta cammidtg(i)-\Delta cam(i) \tag{12}$$

In the next step 306, a cam position correction amount CAMcomp(i) is calculated by using the deviation E.

$$CAMcomp(i)=Kp\times E+f(camtg(i)) \tag{13}$$

Here, Kp denotes a proportional gain and f(camtg(i)) is calculated by a map or mathematical expression using the target cam position camtg(i) as a parameter.

After that, the program advances to step 307 where Δcam(i) of this time is stored as Δcam(i−1) of last time and the program is finished.

During engine operation, the basic duty is calculated by using a map or mathematical expression in accordance with engine operating conditions, and various correction amounts are added to the basic duty to thereby obtain a hydraulic control duty. The hydraulic control duty is multiplied by the cam position correction amount CAMcomp(i) to obtain a final hydraulic control duty. The hydraulic control valve 41 is driven with the hydraulic control duty to perform a feedback control so that the cam position (valve timing) of the intake valve 26 and/or the exhaust valve 27 coincides with the target cam position camtg(i).

In the above-described third embodiment, the control is not easily influenced by variations in waste time (lag element) and modeling error of the variable valve timing system. While maintaining the stability of the variable valve timing control, higher gain (higher response) can be realized. Both higher gain and stability of the variable valve timing control can be achieved and robustness can be also increased.

In the variable valve timing control as well, in a manner similar to the correction amount program of FIG. 5 described in the first embodiment, the cam position correction amount CAMcomp(i) can be calculated.

Fourth Embodiment

Figure 9:
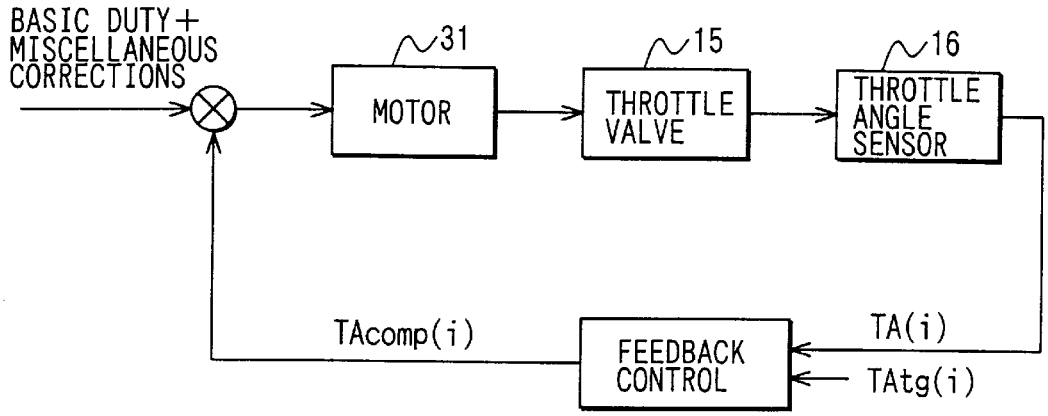
FIG. 9 is a schematic configuration diagram of a whole electronic throttle system (fourth embodiment)

An electronic throttle system as a fourth embodiment of the invention will now be described with reference to FIGS. 9 and 10. As shown in FIG. 9, a subject of throttle angle control is an electronic throttle system including a motor 31, a throttle valve 15, and a throttle angle sensor 16. An input of the control subject is a motor control duty obtained by correcting a motor control duty derived by adding miscellaneous correction amounts to a basic duty (or multiplying the basic duty by various correction coefficients) with a throttle angle correction amount TAcomp(i) calculated by a feedback control of the invention. The basic duty is calculated by a map or mathematical expression in accordance with the engine operating conditions. An output of the control subject is an output TA(i) (throttle angle) of the throttle angle sensor 16.

Figure 10:
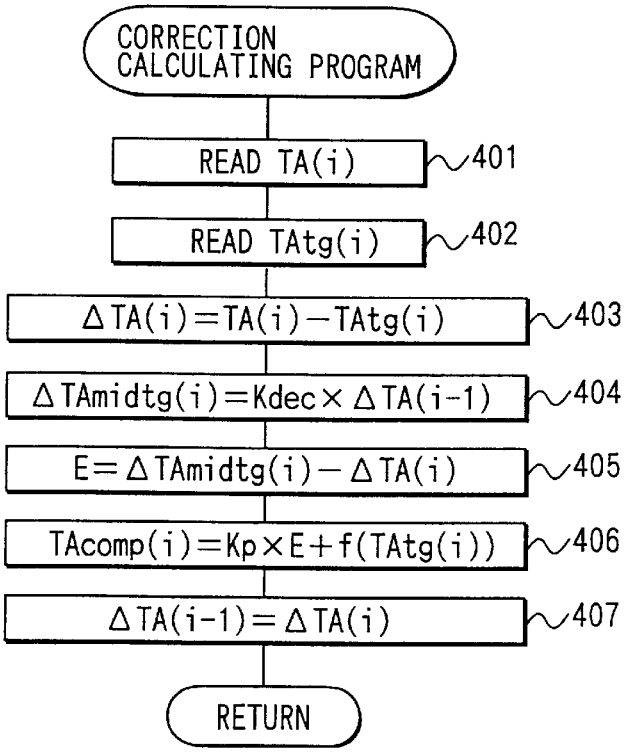
FIG. 10 is a flowchart showing the flow of processes of a correction amount calculating program (fourth embodiment)

The correction amount calculating program of FIG. 10 used in the fourth embodiment is executed every predetermined time or predetermined crank angle. When the program is started, first, in step 401, the present throttle angle TA (i) detected by the throttle angle sensor 16 is read. In step 402, the target throttle angle TAtg(i) as a final target value is read. After that, the program advances to step 403 where the deviation ΔTA (i) between the present throttle angle TA(i) and the target throttle angle TAtg(i) is calculated.

$$\Delta TA(i)=TA(i)-TAtg(i) \tag{14}$$

After that, the program advances to step 404 where a throttle angle deviation ΔTA(i−1) in computation of last time is multiplied by a damping factor Kdec to thereby obtain an intermediate target value ΔTAmidtg(i) of the throttle angle deviation.

$$\Delta TAmidtg(i)=Kdec\times\Delta TA(i-1) \tag{15}$$

Here, the damping factor Kdec may be a fixed value for a simplified computing process or, for example, may be set by using a map or mathematical expression in accordance with engine operating conditions.

After that, the program advances to step 405 where the deviation E between the intermediate target value ΔTAmidtg (i) and the throttle angle deviation ΔTA(i) is calculated.

$$E=\Delta TAmidtg(i)-\Delta TA(i) \tag{16}$$

In step 406, a throttle angle correction amount TAcomp(i) is calculated by the following equation using the deviation E.

$$TAcomp(i)=Kp\times E+f(TAtg(i)) \tag{17}$$

Here, Kp denotes a proportional gain and f(TAtg(i)) is calculated by a map or mathematical expression using the target throttle angle TAtg(i) as a parameter.

After that, the program advances to step 407 where ΔTA(i) of this time is stored as ΔTA(i−1) of last time, and the program is finished.

During an engine operation, the basic duty is calculated by a map or mathematical expression in accordance with the engine operating conditions, and the motor control duty is obtained by adding various correction amounts to the basic duty. By multiplying the motor control duty with a throttle angle correction amount TAcomp(i), a final motor control duty is calculated. By driving the motor 31 with the motor control duty, the throttle angle is feedback controlled so as to coincide with the target throttle angle TAtg(i).

In the above-described fourth embodiment, the control is not easily influenced by variations in waste time (lag element) and a modeling error of the electronic throttle system. While maintaining the stability of the throttle angle control, higher gain (higher response) can be realized. Both higher gain and stability of the throttle angle control can be achieved and robustness can be also increased.

In the throttle angle control as well, in a manner similar to the correction amount calculating program of FIG. 5 described in the first embodiment, the throttle angle correction amount TAcomp(i) may be calculated.

Fifth Embodiment

Figure 11:
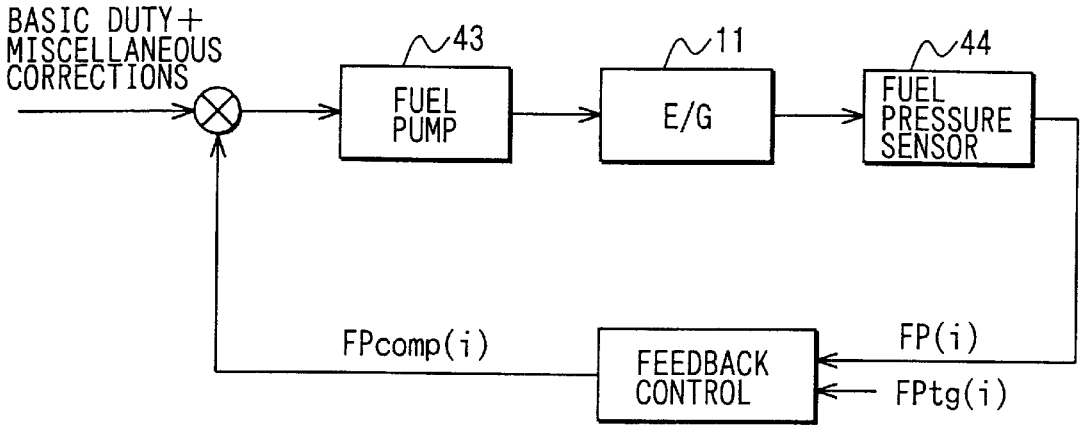
FIG. 11 is a schematic configuration diagram of a whole fuel pressure feedback control system (fifth embodiment)

A fuel pressure feedback control (fuel pump control) system as a fifth embodiment of the invention will now be described with reference to FIGS. 11 and 12. As shown in FIG. 11, a subject of fuel pressure feedback control is a system including a fuel pump 43, the engine 11, and a fuel pressure sensor 44 for detecting a pressure FP(i) of fuel discharged from the fuel pump 43. An input of the control subject is a fuel pressure control duty obtained by correcting a fuel control duty derived by adding various correction amounts to a basic duty (or multiplying the basic duty by various correction coefficients) with a fuel pressure correction amount FPcomp(i) calculated by a feedback control of the invention. The basic duty is calculated by a map, or mathematical expression in accordance with the engine operating conditions. An output of the control subject is an output FP(i) (fuel pressure) of the fuel pressure sensor 44.

Figure 12:
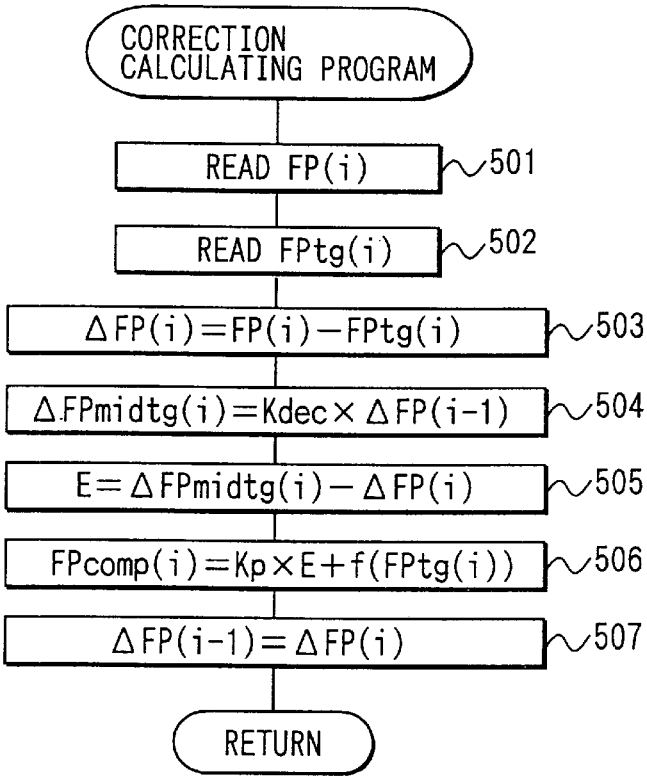
FIG. 12 is a flowchart showing the flow of processes of a correction amount calculating program (fifth embodiment)

A correction amount calculating program of FIG. 12 used in the fifth embodiment is executed every predetermined time or predetermined crank angle. When the program is started, first, in step 501, a present fuel pressure FP(i) detected by the fuel pressure sensor 44 is read. In step 502, the target fuel pressure FPtg(i) as a final target value is read. After that, the program advances to step 503 where the deviation (fuel pressure deviation) ΔFP (i) between the present fuel pressure FP(i) and the target fuel pressure FPtg(i) is calculated.

$$\Delta FP(i)=FP(i)-FPtg(i) \tag{18}$$

After that, the program advances to step 504 where a fuel pressure deviation ΔFP(i−1) in computation of last time is multiplied by a damping factor Kdec to thereby obtain an intermediate target value ΔFPmidtg(i) of the fuel pressure deviation.

$$\Delta FPmidtg(i)=Kdec\times\Delta FP(i-1) \tag{19}$$

The damping factor Kdec may be a fixed value for a simplified computing process or, for example, may be set by using a map or mathematical expression in accordance with engine operating conditions.

After that, the program advances to step 505 where the deviation E between the intermediate target value ΔFPmidtg (i) and the fuel pressure deviation ΔFP(i) is calculated.

$$E=\Delta FPmidtg(i)-\Delta FP(i) \tag{20}$$

In the following step 506, a fuel pressure correction amount FPcomp(i) is calculated by the following equation using the deviation E.

$$FPcomp(i)=Kp\times E+f(FPtg(i)) \tag{21}$$

Here, Kp denotes a proportional gain and f(FPtg(i)) is calculated by a map or mathematical expression using the target fuel pressure FPtg(i) as a parameter.

After that, the program advances to step 507 where ΔFP(i) of this time is stored as ΔFP(i−1) of last time, and the program is finished.

During an engine operation, the basic duty is calculated by a map or mathematical expression in accordance with the engine operating conditions, and the fuel pressure control duty is obtained by adding various correction amounts to the basic duty. By multiplying the fuel pressure control duty by a fuel pressure correction amount FPcomp(i), a final fuel pressure control duty is calculated. The fuel pump 43 is controlled with the fuel pressure control duty, and the fuel pressure is feedback controlled so as to coincide with the target fuel pressure FPtg(i).

In the above-described fifth embodiment, the control is not easily influenced by variations in waste time (lag element) and a modeling error of the fuel pressure feedback control system. While maintaining the stability of the fuel pressure feedback control, higher gain (higher response) can be realized. Both higher gain and stability of the fuel pressure feedback control can be achieved, and robustness can be also increased.

In the fuel pressure feedback control as well, in a manner similar to the correction amount calculating program of FIG. 5 described in the first embodiment, the fuel pressure correction amount FPcomp(i) may be calculated.

Sixth Embodiment

Figure 13:
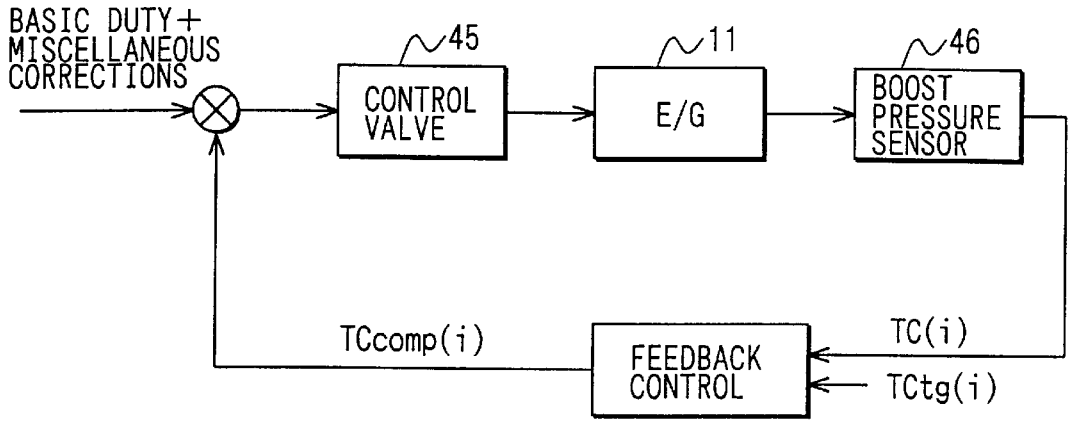
FIG. 13 is a schematic configuration diagram of a whole boost pressure feedback control system (sixth embodiment)

A boost pressure feedback control system of a turbo charger as the sixth embodiment of the invention will now be described with reference to FIGS. 13 and 14. As shown in FIG. 13, a subject of boost pressure feedback control is a system including a control valve 45 for controlling a boost pressure TC(i), the engine 11, and a boost pressure sensor 46 for detecting a boost pressure TC(i). An input of the control subject is a boost pressure control duty obtained by correcting a boost pressure duty derived by adding miscellaneous correction amounts to a basic duty (or multiplying the basic duty by various correction coefficients) with a boost pressure correction amount TCcomp(i) calculated by a feedback control of the invention. The basic duty is calculated by a map or mathematical expression in accordance with the engine operating conditions. An output of the control subject is an output TC(i) (boost pressure) of the boost pressure sensor 46.

Figure 14:
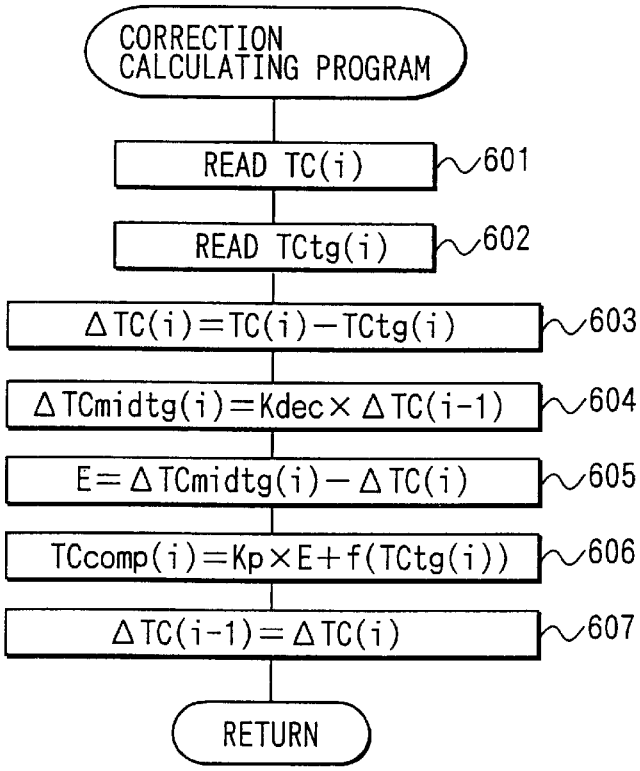
FIG. 14 is a flowchart showing the flow of processes of a correction amount calculating program (sixth embodiment)

The correction amount calculating program of FIG. 14 used in the sixth embodiment is executed every predetermined time or predetermined crank angle. When the program is started, first, in step 601, the present boost pressure TC(i) detected by the boost pressure sensor 46 is read. In step 602, the target boost pressure TCtg(i) as a final target value is read. After that, the program advances to step 603 where the deviation (boost pressure deviation) ΔTC(i) between the present boost pressure TC(i) and the target boost pressure TCtg(i) is calculated.

$$\Delta TC(i)=TC(i)-TCtg(i) \tag{22}$$

After that, the program advances to step 604 where a boost pressure deviation ΔTC(i−1) in computation of last time is multiplied by a damping factor Kdec to thereby obtain an intermediate target value ΔTCmidtg(i) of the boost pressure deviation.

$$\Delta TCmidtg(i)=Kdec\times\Delta TC(i-1) \quad (23)$$

The damping factor Kdec may be a fixed value for a simplified computing process or, for example, may be set by using a map or mathematical expression in accordance with engine operating conditions.

After that, the program advances to step 605 where the deviation E between the intermediate target value ΔTCmidtg (i) and the boost pressure deviation ΔTC(i) is calculated.

$$E=\Delta TCmidtg(i)-\Delta TC(i) \quad (24)$$

In step 606, a boost pressure correction amount TCcomp (i) is calculated by the following equation using the deviation E.

$$TCcomp(i)=Kp\times E+f(TCtg(i)) \quad (25)$$

Here, Kp denotes a proportional gain and f(TCtg(i)) is calculated by a map or mathematical expression using the target boost pressure TCtg(i) as a parameter.

After that, the program advances to step 607 where ΔTC(i) of this time is stored as ΔTC(i−1) of last time, and the program is finished.

During engine operation, the basic duty is calculated by a map or mathematical expression in accordance with the engine operating conditions, and the boost pressure control duty is obtained by adding various correction amounts to the basic duty. By multiplying the boost pressure control duty by a boost pressure correction amount TCcomp(i), a final boost pressure control duty is calculated. The control valve 45 is driven with the boost pressure control duty, and the boost pressure is feedback controlled to achieve the target boost pressure TCtg(i).

In the above-described sixth embodiment, the control is not easily influenced by variations in waste time (lag element) and a modeling error of the boost pressure feedback control system. While maintaining the stability of the boost pressure feedback control, higher gain (higher response) can be realized. Both higher gain and stability of the boost pressure feedback control can be achieved and robustness can be also increased.

In the boost pressure feedback control as well, in a manner similar to the correction amount calculating program of FIG. 5 described in the first embodiment, the boost pressure correction amount TCcomp(i) may be calculated.

Seventh Embodiment

Figure 15:
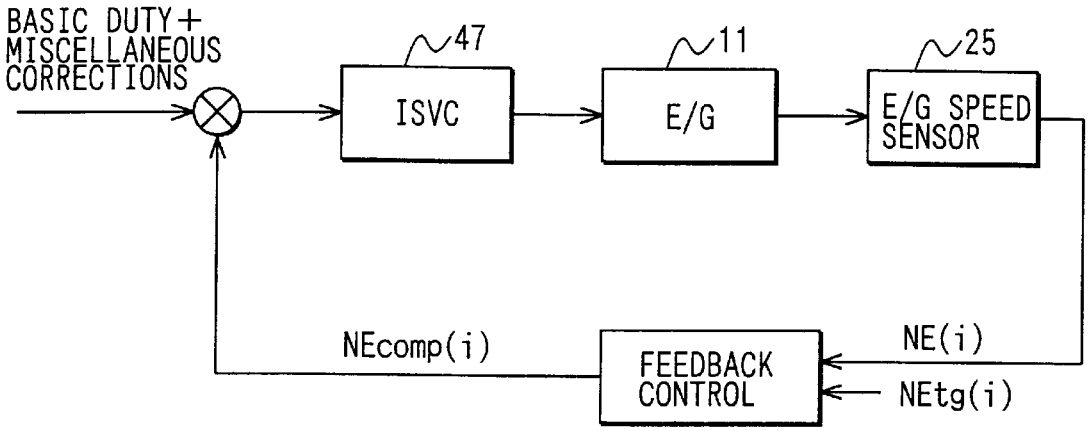
FIG. 15 is a schematic configuration diagram of a whole idle speed control system (seventh embodiment)

An idle speed control (ISC) system as a seventh embodiment of the invention will now be described with reference to FIGS. 15 and 16. As shown in FIG. 15, a subject of idle speed control is a system including an idle speed control valve 47 (ISCV) for controlling an intake air volume (bypass air volume) at the time of idling operation, the engine 11, and the engine speed sensor 25 for detecting an engine speed NE(i). An input of the control subject is an ISC duty obtained by correcting an ISC duty derived by adding various correction amounts to a basic duty (or multiplying the basic duty with miscellaneous correction coefficients) by an ISC correction amount NEcomp(i) calculated by a feedback control of the invention. The basic duty is calculated by a map or mathematical expression in accordance with the engine operating conditions. An output of the control subject is an output NE(i) (engine speed) of the engine speed sensor 25.

Figure 16:
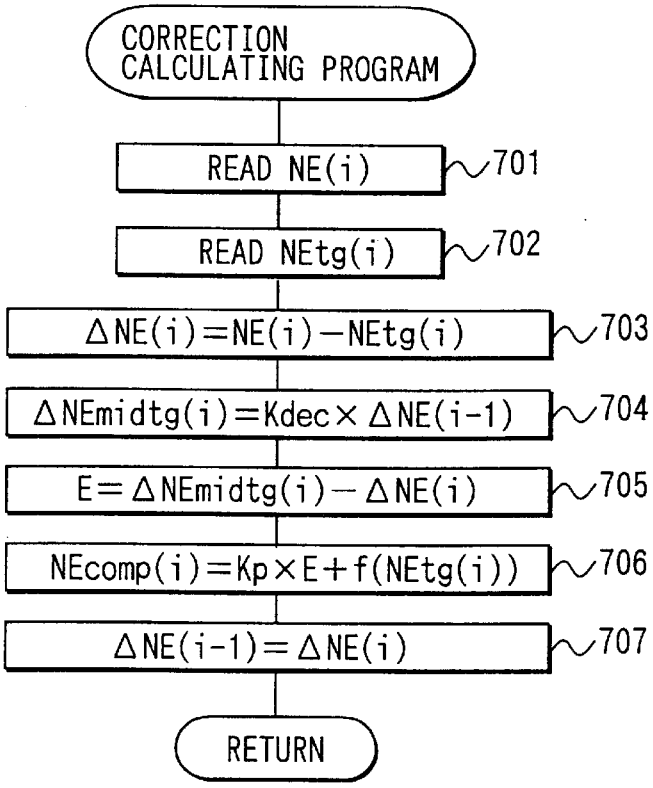
FIG. 16 is a flowchart showing the flow of processes of a correction amount calculating program (seventh embodiment)

The correction amount calculating program of FIG. 16 used in the seventh embodiment is executed every predetermined time or predetermined crank angle. When the program is started, first, in step 701, the present engine speed NE(i) detected by the engine speed sensor 25 is read. In step 702, the target boost pressure NEtg(i) as a final target value is read. After that, the program advances to step 703 where the deviation (engine speed deviation) ΔNE(i) between the present engine speed NE(i) and the target engine speed NEtg(i) is calculated.

$$\Delta NE(i)=NE(i)-NEtg(i) \quad (26)$$

After that, the program advances to step 704 where an engine speed deviation ΔNE(i−1) in computation of last time is multiplied by a damping factor Kdec to thereby obtain an intermediate target value ΔNEmidtg(i) of the engine speed deviation.

$$\Delta NEmidtg(i)=Kdec\times\Delta NE(i-1) \quad (27)$$

The damping factor Kdec may be a fixed value for a simplified computing process or may be set by using a map or mathematical expression in accordance with, for example, engine operating conditions.

After that, the program advances to step 705 where the deviation E between the intermediate target value ΔNEmidtg (i) and the engine speed deviation ΔNE(i) is calculated.

$$E=\Delta NEmidtg(i)-\Delta NE(i) \quad (28)$$

In step 706, an ISC correction amount NEcomp(i) is calculated by the following equation using the deviation E.

$$NEcomp(i)=Kp\times E+f(NEtg(i)) \quad (29)$$

Here, Kp denotes a proportional gain and f(NEtg(i)) is calculated by a map or mathematical expression using the target engine speed NEtg(i) as a parameter.

After that, the program advances to step 707 where ΔNE(i) of this time is stored as ΔNE(i−1) of last time, and the program is finished.

During engine operation, the basic duty is calculated by a map or mathematical expression in accordance with the engine operating conditions, and the ISC duty is obtained by adding various correction amounts to the basic duty. By multiplying the ISC duty by an ISC correction amount NEcomp(i), a final ISC duty is calculated. The idle speed control valve 47 is driven with the ISC duty, and the idle speed is feedback controlled to achieve the target engine speed NEtg(i).

In the above-described seventh embodiment, the controller is not easily influenced by variations in waste time (lag element) and a modeling error of the idle speed control system. While maintaining the stability of the idle speed control, higher gain (higher response) can be realized. Both higher gain and stability of the idle speed control can be achieved and robustness can be also increased.

In the idle speed control as well, in a manner similar to the correction amount calculating program of FIG. 5 described in the first embodiment, the ISC correction amount NEcomp (i) may be calculated.

Although the idle speed control system of the seventh embodiment controls the idle speed by the idle speed control valve 47 for controlling the volume of air passing through a bypass for bypassing the throttle valve 15, it is also possible to omit the idle speed control valve 47 and the bypass, and control the angle of the throttle valve 15 at the time of idle operation to adjust the intake air volume at the time of idle operation, thereby controlling the idle speed.

Eighth Embodiment

Figure 17:
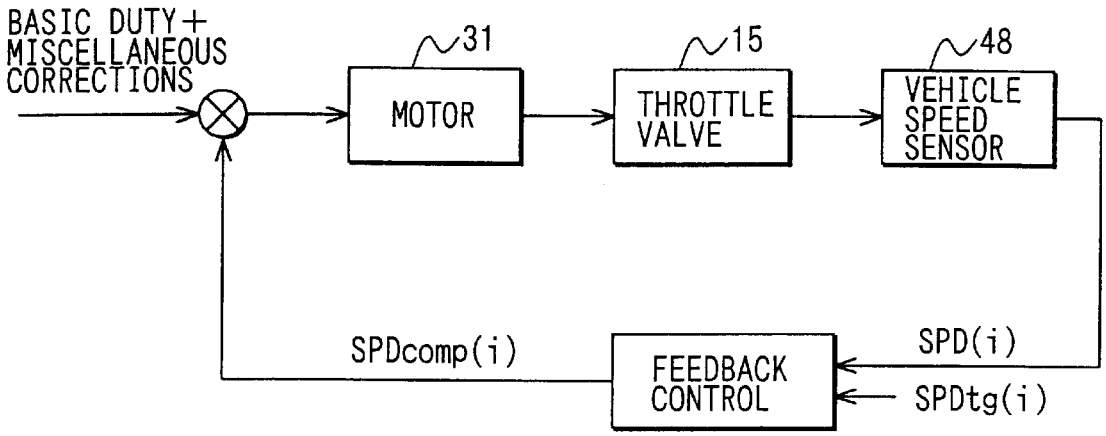
FIG. 17 is a schematic configuration diagram of a whole cruise control system (eighth embodiment)

A cruise control system as an eighth embodiment of the invention will now be described with reference to FIGS. 17 and 18. As shown in FIG. 17, a subject of cruise control is a system including the motor 31, the throttle valve 15, and a vehicle speed sensor 48 of an electronic throttle system. An input of the control subject is a motor control duty obtained by correcting a motor control duty derived by adding various correction amounts to a basic duty (or multiplying the basic duty with various correction coefficients) by a speed correction amount SPDcomp(i) calculated by a feedback control of the invention. The basic duty is calculated by a map or mathematical expression in accordance with the engine operating conditions. An output of the control subject is an output SPD(i) (vehicle speed) of the vehicle speed sensor 48.

Figure 18:
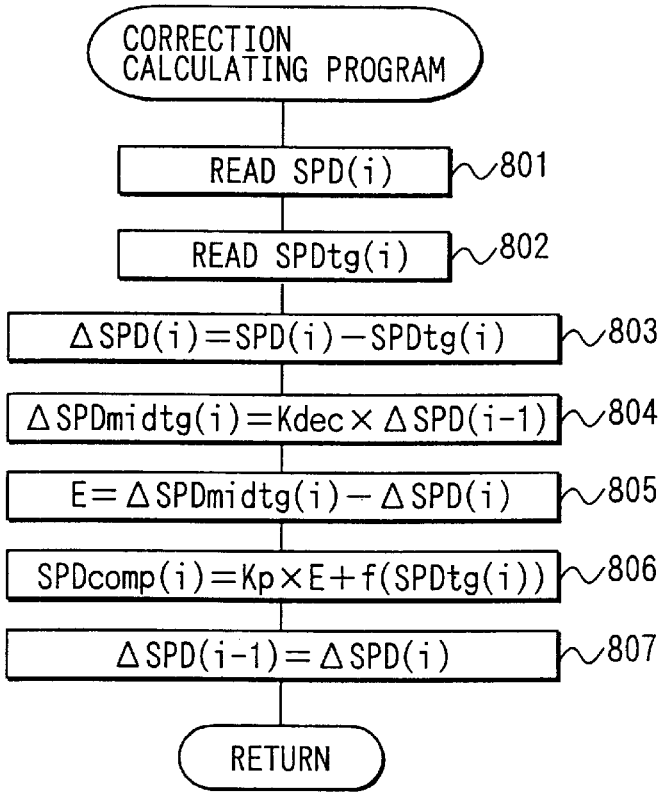
FIG. 18 is a flowchart showing the flow of processes of a correction amount calculating program (eighth embodiment)

The correction amount calculating program of FIG. 18 used in the eighth embodiment is executed every predetermined time or predetermined crank angle. When the program is started, first, in step 801, the present vehicle speed SPD(i) detected by the vehicle speed sensor 48 is read. In step 802, the target vehicle speed SPDtg(i) as a final target value is read. After that, the program advances to step 803 where the deviation (vehicle speed deviation) ΔSPD(i) between the current vehicle speed SPD(i) and the target vehicle speed SPDtg(i) is calculated.

$$\Delta SPD(i)=SPD(i)-SPDtg(i) \tag{30}$$

After that, the program advances to step 804 where a vehicle speed deviation ΔSPD(i−1) in computation of last time is multiplied by a damping factor Kdec to thereby obtain an intermediate target value ΔSPDmidtg(i) of the vehicle speed deviation.

$$\Delta SPDmidtg(i)=Kdec\times\Delta SPD(i-1) \tag{31}$$

Here, the damping factor Kdec may be a fixed value for a simplified computing process or, for example, may be set by using a map or mathematical expression in accordance with engine operating conditions.

After that, the program advances to step 805 where the deviation E between the intermediate target value ΔSPDmidtg(i) and the vehicle speed deviation ΔSPD(i) is calculated.

$$E=\Delta SPDmidtg(i)-\Delta SPD(i) \tag{32}$$

In step 806, a speed correction amount SPDcomp(i) is calculated by the following equation using the deviation E.

$$SPDcomp(i)=Kp\times E+f(SPDtg(i)) \tag{33}$$

Here, Kp denotes a proportional gain and f(SPDtg(i)) is calculated by a map or mathematical expression using the target vehicle speed SPDtg(i) as a parameter.

After that, the program advances to step 807 where ΔSPD(i) of this time is stored as ΔSPD(i−1) of last time, and the program is finished.

During engine operation, the basic duty is calculated by a map or mathematical expression in accordance with the engine operating conditions, and the motor control duty is obtained by adding various correction amounts to the basic duty. By multiplying the motor control duty by a speed correction amount SPDcomp(i), a final motor control duty is calculated. The angle of the throttle valve 15 is controlled with the motor control duty, and the vehicle speed is feedback controlled to achieve the target vehicle speed SPDtg(i).

In the above-described eighth embodiment, the control is not easily influenced by variations in waste time (lag element) and a modeling error of the cruise control system. While maintaining the stability of the cruise control, higher gain (higher response) can be realized. Both higher gain and stability of the idle speed control can be achieved and robustness can be also increased.

In the cruise control as well, in a manner similar to the correction amount calculating program of FIG. 5 described in the first embodiment, the vehicle speed correction amount SPDcomp(i) may be calculated.

The feedback controls in the above-described first to eighth embodiments may be properly combined and executed.

The feedback control of the invention is not limited to the above-described first through eighth embodiments but can be also applied to various feedback controls of a vehicle.

Ninth Embodiment

The ninth embodiment of the present invention will be described hereinbelow with reference to FIGS. 19–23.

Figure 19:
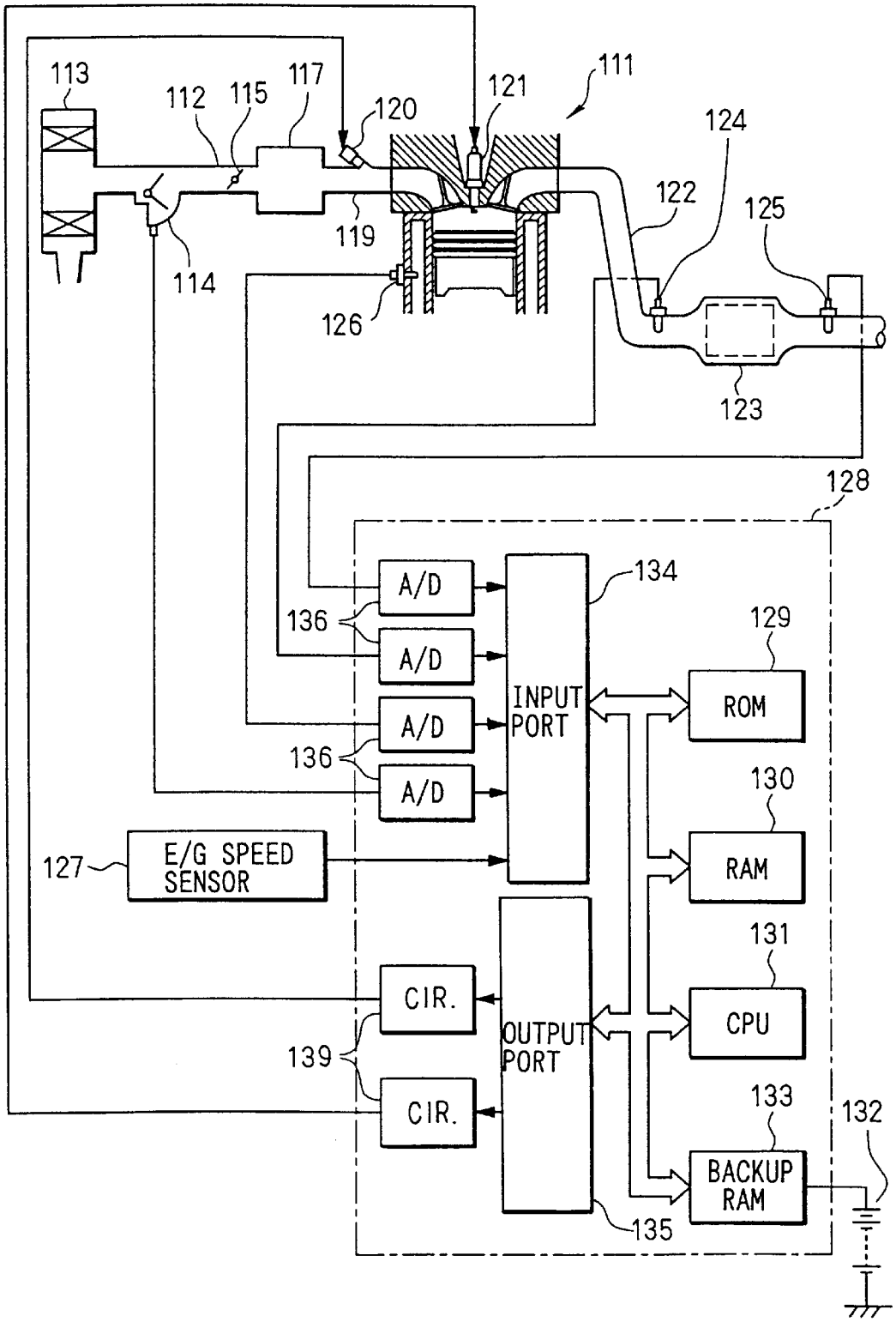
FIG. 19 is a schematic configuration diagram of a whole engine control system (ninth embodiment)

A schematic configuration of a whole engine control system will be described with reference to FIG. 19. In the uppermost stream part of an intake pipe 112 of an engine 111 as an internal combustion engine, an air cleaner 113 is provided. On the downstream side of the air cleaner 113, an air flow meter 114 for detecting an intake air amount is provided. On the downstream side of the air flow meter 114, a throttle valve 115 is provided.

Further, on the downstream side of the throttle valve 15, a surge tank 117 is provided. The surge tank 117 is provided with an intake manifold 119 for introducing air into each of cylinders of the engine 111. A fuel injection valve 120 for injecting fuel is attached near the intake port of the intake manifold 119 of each cylinder. A spark plug 121 is attached to a cylinder head of each of cylinders of the engine 111.

In some midpoint of the exhaust pipe 122 of the engine 111, a catalyst 123 such as a three-way catalyst for treating harmful components (CO, HC, Nox, and the like) in exhaust gases is disposed. On the upstream and downstream sides of the catalyst 123, exhaust gas sensors 124 and 125 each for detecting A/F ratio of exhaust gases are disposed, respectively. In the present ninth embodiment, as the upstream-side exhaust sensor 124, an A/F ratio sensor (linear A/F ratio sensor) for outputting a linear A/F ratio signal according to the exhaust gas A/F ratio is used. As the downstream-side exhaust sensor 125, an oxygen sensor of which output voltage is inverted according to whether the A/F ratio of the exhaust gas is rich or lean is used. Consequently, when the A/F ratio is lean state, the downstream-side gas sensor 125 generates an output voltage of about 0.1V. When the A/F ratio is rich state, the downstream-side exhaust gas sensor 125 generates an output voltage of about 0.9V. To a cylinder block of the engine 111, a water temperature sensor 126 for detecting a cooling water temperature and an engine speed sensor 127 for detecting engine speed are attached.

An engine control unit (hereinbelow, referred to as an "ECU") 128 is mainly constructed by a microcomputer having a ROM 129, a RAM 130, a CPU 131, a backup RAM 133 backed up by a battery 132, an input port 134, and an output port 135. To the input port 134, an output signal of the engine speed sensor 127 is supplied and also output signals from the air flow meter 114, upstream-side and downstream-side exhaust gas sensors 124 and 125, and water temperature sensor 126 are supplied via A/D converters 136. To the output port 135, the fuel injection valve 120, spark plug 121, and the like are connected via driving circuits 139. The ECU 128 executes a fuel injection control program and an ignition control program stored in the ROM 129 by the CPU 131, thereby controlling the operations of the fuel injection valve 120 and the spark plug 121, and executes an A/F ratio control program, thereby feedback controlling the A/F ratio (fuel injection amount) so that the A/F ratio of the exhaust gas becomes the target A/F ratio.

Figure 20:
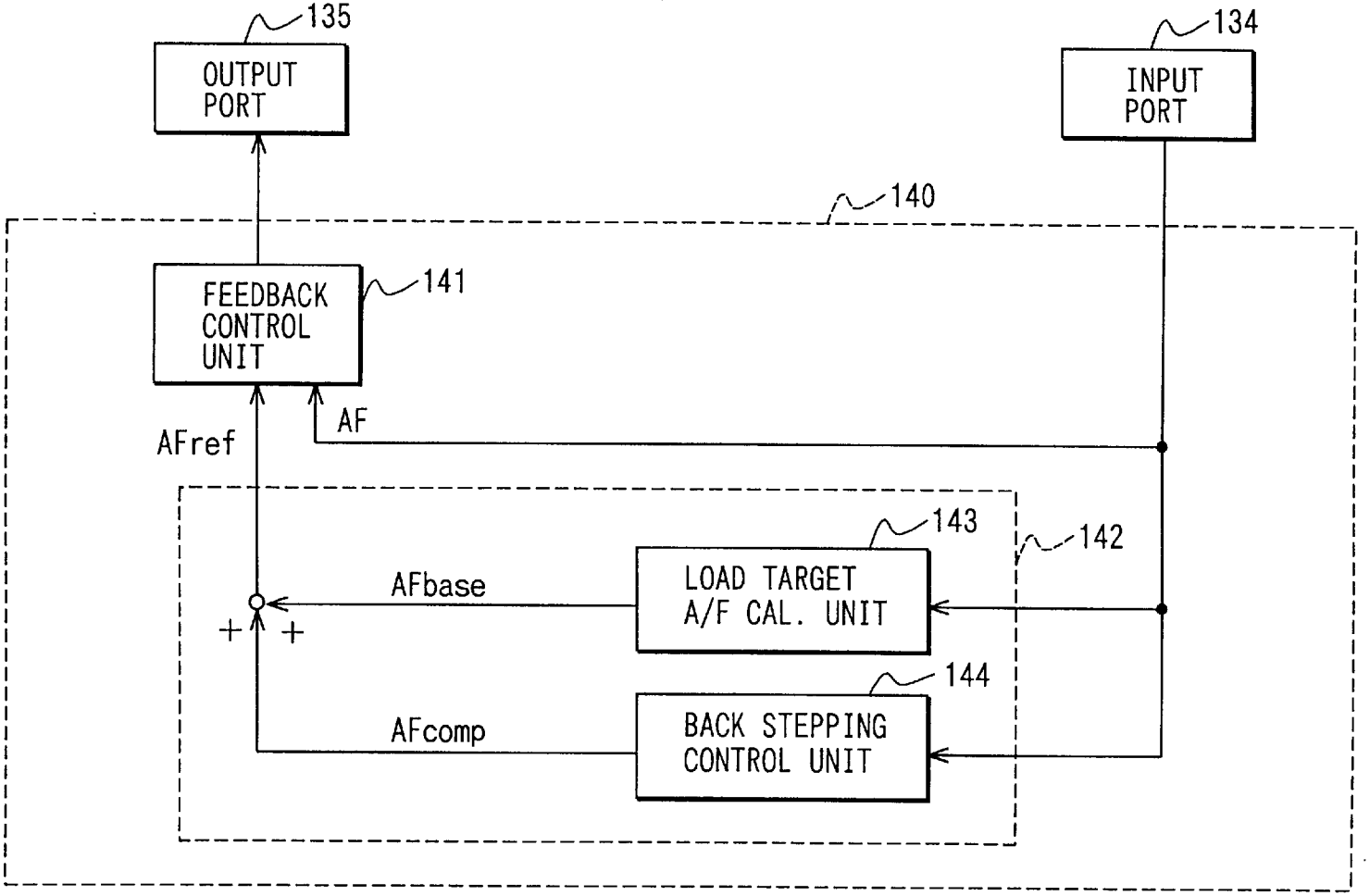
FIG. 20 is a block diagram showing the functions of exhaust gas A/F ratio control means realized by computing functions of a CPU in an ECU (ninth embodiment)
Figure 21:
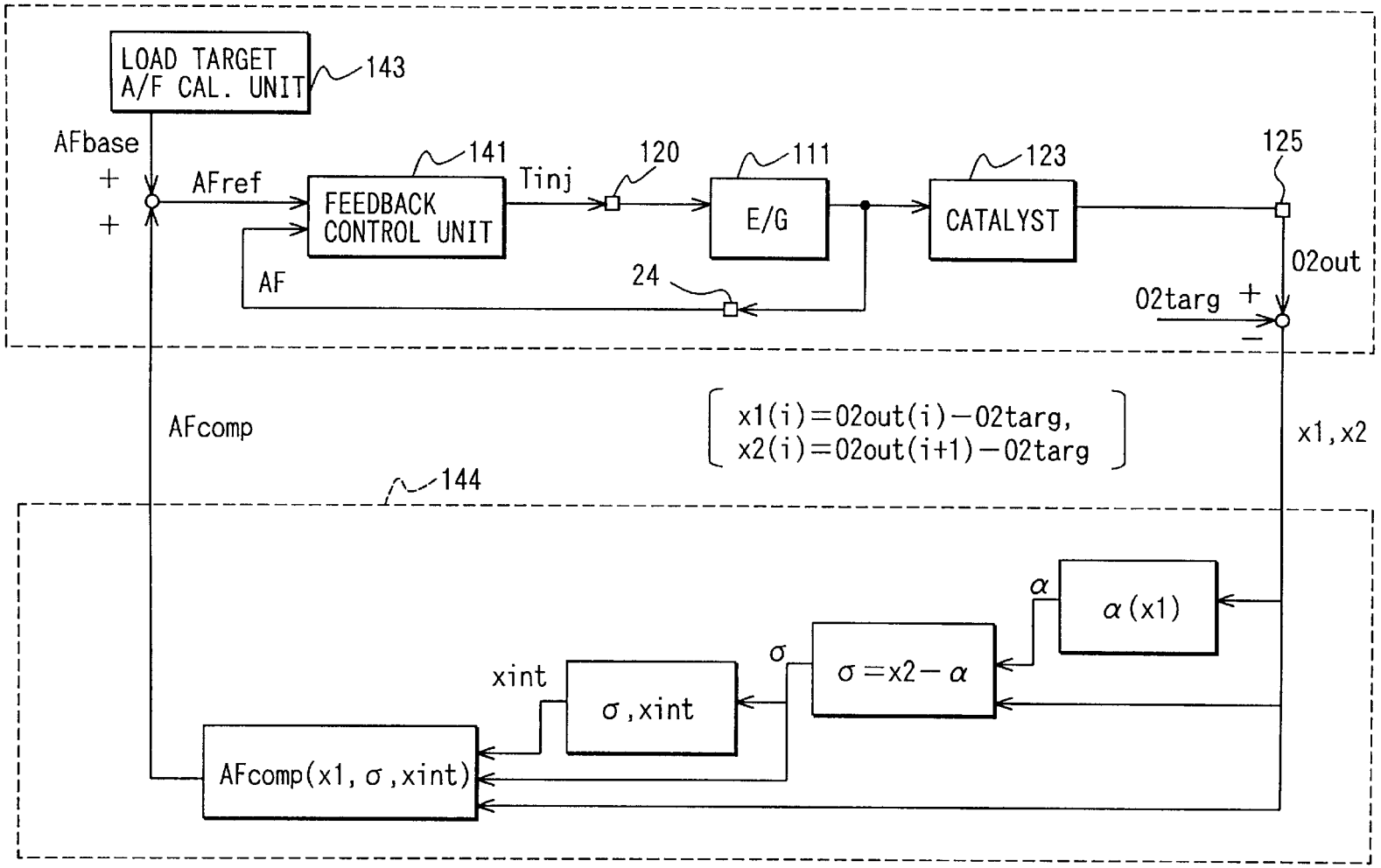
FIG. 21 is a functional block diagram showing the functions of a whole exhaust gas A/F ratio feedback control system (ninth embodiment)

An A/F ratio feedback control system of the present embodiment will be described hereinbelow with reference to FIGS. 20 and 21. FIG. 20 is a block diagram showing the functions of A/F ratio control means 140 realized by the computing process function of the CPU 131, and FIG. 21 is a block diagram showing the functions of the whole A/F ratio feedback control system.

The A/F ratio control means 140 is constructed by a fuel injection amount feedback control unit 141 and a target A/F ratio calculating unit 142. Further, the target A/F ratio calculating unit 142 is constructed by a load target A/F ratio calculating unit 143 and a back stepping control unit 144.

The fuel injection amount feedback control unit 141 calculates fuel injection time Tinj of the fuel injection valve 120 so that the A/F ratio AF detected by the upstream-side exhaust gas sensor 124 converges to an upstream-side target A/F ratio AFref. The fuel injection time Tinj is calculated by an optimum regulator built for a linear equation of a model of the subject to be controlled. The fuel injection amount feedback control unit 141 operates as an A/F ratio feedback control means in the present invention.

The load target A/F ratio calculating unit 143 calculates a load target A/F ratio AFbase according to an intake air volume (or intake pipe pressure) and engine speed by a functional equation or map stored in the ROM 129. The functional equation or map for calculating the load target A/F ratio AFbase is preset by a test or the like so that, when an output value O2out (detected A/F ratio) of the downstream-side exhaust gas sensor 125 is almost stationarily equal to a target value O2targ (downstream-side target A/F ratio), by maintaining the upstream-side target A/F ratio AFref at the load target A/F ratio AFbase, the output value O2out of the downstream-side exhaust gas sensor 125 is maintained almost at the target value O2targ.

The back stepping control unit 144 calculates a correction amount AFcomp of the upstream-side target A/F ratio AFref by using a back stepping method which will be described hereinlater on the basis of the output value O2out of the downstream-side exhaust gas sensor 125. By adding the correction amount AFcomp to the load target A/F ratio AFbase, the upstream-side target A/F ratio AFref is obtained. The upstream-side target A/F ratio AFref is supplied to the fuel injection amount feedback control unit 141.

$$AFref=AFbase+AFcomp \tag{34}$$

In this case, the target A/F ratio calculating unit 142 corresponds to sub-feedback control means in the scope of claims, and the back stepping control unit 144 corresponds to back stepping control means in the present invention.

A method of calculating the correction amount AFcomp by using the back stepping method in the back stepping control unit 144 will now be described with reference to FIG. 21.

The subject to be controlled is a system including the fuel injection amount feedback control unit 141, engine 111, catalyst 123, and downstream-side exhaust gas sensor 125. The correction amount AFcomp of the upstream-side target A/F ratio AFref is calculated so that the output value O2out of the downstream-side exhaust gas sensor 125 is maintained around the target value O2targ. In order to apply the back stepping method, two state variables x1 and x2 shown in the following equations (35) and (36) are used.

$$x1(i)=O2out(i)-O2targ \tag{35}$$

$$x2(i)=O2out(i+1)-O2targ \tag{36}$$

The state variable x1 denotes a deviation between the output value O2out of the downstream-side exhaust gas sensor 125 in the i-th calculation period and the target value O2targ. The state variable x2 denotes a deviation between the output value O2out of the downstream-side exhaust gas sensor 125 in the (i+1)th calculation period and the target value O2targ.

In the present embodiment, by controlling each of the state variables x1 and x2 defined as described above to 0 by using state feedback, the correction amount AFcomp of the upstream-side target A/F ratio AFref is obtained.

In order to carry out the control, first, the subject to be controlled is modeled by a quadratic linear state equation (37).

$$\begin{bmatrix} x1(i+1) \\ x2(i+1) \end{bmatrix} = \begin{bmatrix} 0 & 1 \\ a1 & a2 \end{bmatrix} \cdot \begin{bmatrix} x1(i) \\ x2(i) \end{bmatrix} + \begin{bmatrix} 0 \\ b \end{bmatrix} \cdot AFcomp(i) \tag{37}$$

An input is the correction amount AFcomp calculated by the back stepping control unit 144 in the i-th calculation period. The state variables x1 and x2 are determined by the sum of linear values of past state variables x1 and x2 using a1, a2, and b as coefficients, and the current correction amount AFcomp. The model equation is not limited to a quadratic equation but a cubic equation or an equation of a higher degree in which waste time or the like is considered may be used.

The model equation (37) is divided into two sub systems shown by the following equations (38) and (39).

$$x1(i+1)=x2(i) \tag{38}$$

$$x2(i+1)=a1\cdot x1(i)+a2\cdot x2(i)+b\cdot Afcomp(i) \tag{39}$$

The sub systems (equations (38) and (39) are controlled by the following two procedures (i) and (ii).

<Procedure (i)>

In the sub system shown by the equation (38), the state variable x1 is controlled to the target value 0. In this case, when it is assumed that the state variable x2 in the equation (38) is set as a virtual input a and the value can be freely set as shown by the following equation (40), the state variable x1 can be controlled to the target value 0 with an almost ideal convergence locus.

$$\alpha(i)=Kc\cdot x1(i) \tag{40}$$

Where, Kc is a constant of which absolute value is smaller than 1.

<Procedure (ii)>

By using the sub system shown by the equation (39), the state variable x2 is controlled so as to be equal to the virtual input α. In this case, first, the deviation σ between the state variable x2 in the equation (38) and the virtual input a set in the equation (40) is set as shown by the following equation (41).

$$\sigma(i)=x2(i)-\alpha(i) \tag{41}$$

x2(*i*) can be expressed by the following equation (42).

$$x2(i)=\alpha(i)+\sigma(i) \tag{42}$$

From the equations (38) and (42), the following equation (43) is obtained.

$$x1(i+1)=\alpha(i)+\sigma(i) \tag{43}$$

From the equations (39) and (42), the following equation (44) is derived.

$$\sigma(i+1)=a1\cdot x1(i)+a2\cdot\sigma(i)+b\cdot Afcomp(i)-\alpha(i+1)+a2\cdot\alpha(i) \tag{44}$$

where, $\alpha(i)$ and $\alpha(i+1)$ are functions of $x1(i)$ and $x1(i+1)$, respectively, and $x1(i+1)$ is a function of $\alpha(i)$ and $\sigma(i)$. Consequently, the equations (43) and (44) express functions of $x1(i)$ and $\sigma(i)$, respectively.

With respect to the whole system made by the equations (43) and (44), the correction amount AFcomp is set by the sum of linear values of the state variable x1, the deviation $\sigma$, and the integration value $\Sigma\sigma$ of the deviation $\sigma$ by using the following equation (45) so that three amount of the state variable x1, the deviation $\sigma$, and the integration value of the deviation a are simultaneously converged to 0.

$$AFcomp(i) = K1\cdot x1(i) + K2\cdot\sigma(i) + K3\cdot\sum_{j=0}^{j=i}\sigma(j) \tag{45}$$

Here, K1, K2, and K3 denote feedback gains and express constants determined according to the engine operating conditions. By taking the convergence of the state variable x1 (deviation between the output value O2out of the downstream-side exhaust gas sensor 125 and the target value O2targ) into consideration, even under the condition that the deviation $\sigma$ (deviation between the state variable and the virtual input) does not become 0. due to an influence of waste time, disturbance, or the like, the convergence stability of the state variable x1 can be improved.

As described in the present embodiment, in the case where the virtual input $\alpha$ is set as $\alpha(i)=Kc\cdot x1(i)$ (refer to equation (40)), it is possible to express the whole system constructed by the equations (43) and (44) and the following equation (46) by the following determinant (47) and determine the feedback gains K1, K2, and K3 by an optimum regulator.

$$xint(i) = \sum_{j=0}^{j=i}\sigma(j) \tag{46}$$

$$\begin{bmatrix} x1(i+1) \\ \sigma(i+1) \\ xint(i+1) \end{bmatrix} = \begin{bmatrix} Kc & 1 & 0 \\ a1+Kc\cdot a2-Kc^2 & a2-Kc & 0 \\ 0 & 1 & 1 \end{bmatrix}\cdot \begin{bmatrix} x1(i) \\ \sigma(i) \\ xint(i) \end{bmatrix} + \begin{bmatrix} 0 \\ b \\ 0 \end{bmatrix}\cdot AFcomp(i) \tag{47}$$

In this case, the feedback gains K1, K2, and K3 can be expressed as follows.

$$\begin{bmatrix} K1 \\ K2 \\ K3 \end{bmatrix} = (B^TSB + 1)^{-1}B^TSA \tag{48}$$

$$A = \begin{bmatrix} Kc & 1 & 0 \\ a1 + Kc\cdot a2 - Kc^2 & a2 - Kc & 0 \\ 0 & 1 & 1 \end{bmatrix}$$

-continued $$B = \begin{bmatrix} 0 \\ b \\ 0 \end{bmatrix}$$

$$A^TSA - S - A^TSB(B^TSB + 1)^{-1}B^TSA + Q = 0 \tag{49}$$

$$Q = \begin{bmatrix} Wx1 & 0 & 0 \\ 0 & Wsigma & 0 \\ 0 & 0 & Wint \end{bmatrix}$$

Here, Wx1 denotes a weighting factor on the state variable x1 (deviation from the target convergence value), Wsigma denotes a weighting factor on the deviation $\sigma$ (deviation from the target convergence locus), and Wint expresses a weighting factor on the integration value xint of the deviation $\sigma$ (integration value of the deviation from the target convergence locus).

By the equations (48) and (49), according to a combination of the weighting factors Wx1, Wsigma, and Wint, the feedback gains K1, K2, and K3 are determined. In the case of converging the state variable x1, the deviation $\sigma$, and the integration value xint of the deviation $\sigma$ to 0, the importance (weighting) of each of them can be easily set by the weighting factors Wx1, Wsigma, and Wint.

Figure 22:
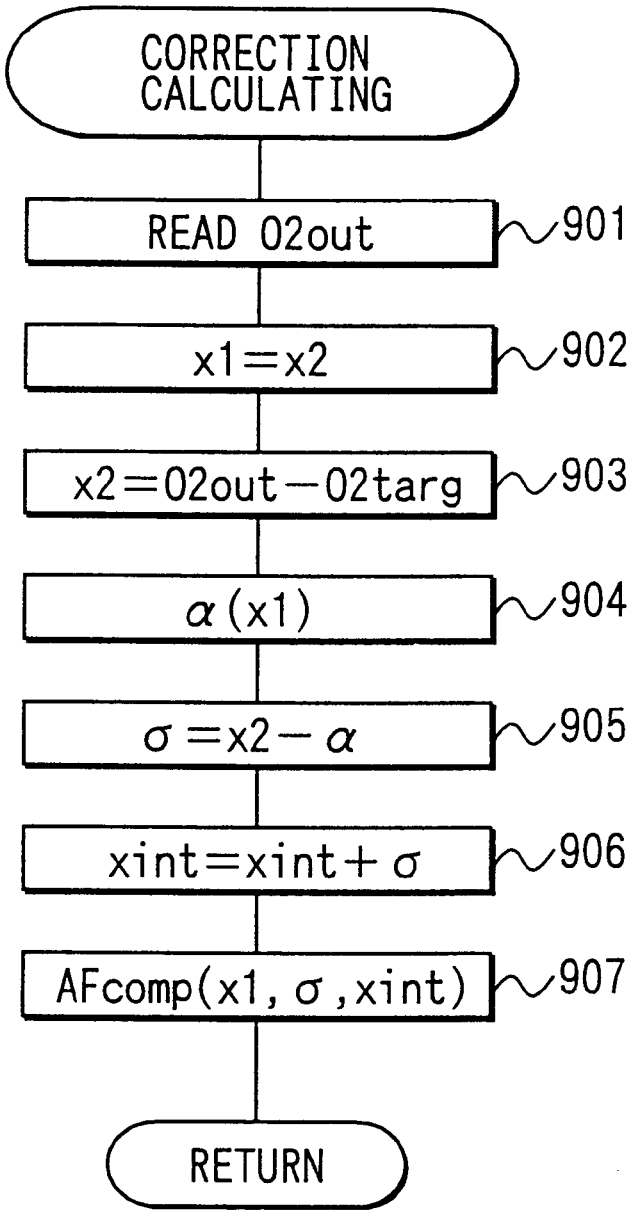
FIG. 22 is a flowchart showing the flow of processes of a correction amount calculating program (ninth embodiment)
Figure 23:
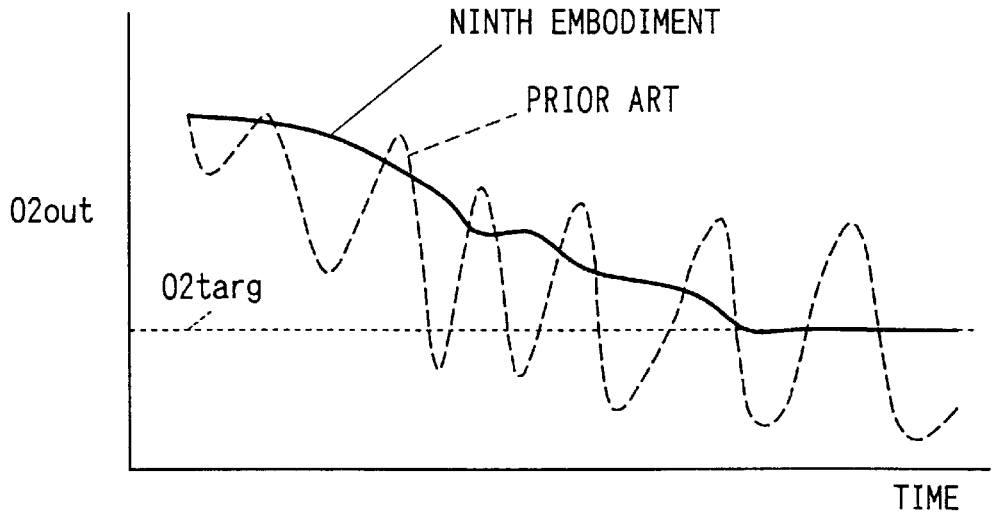
FIG. 23 is a time chart showing convergence characteristics of a downstream-side A/F ratio sensor (ninth embodiment)

The above-described calculation of the correction amount AFcomp by the back stepping control unit 144 is executed by a correction amount calculating program of FIG. 22. The program is performed every predetermined time or predetermined crank angle. When the program is started, first, in step 901, the output value O2out of the downstream-side exhaust gas sensor 125 is read. In step 902, the state variable x1 is updated by the state variable x2 of the last time. After that, in step 903, the state variable x2 (=O2out−O2targ) of this time is calculated.

In step 904, the virtual input $\alpha=Kc\cdot x1$ is calculated. In step 905, the deviation $\sigma$ (=x2−$\alpha$) between the state variable x2 and the virtual input $\alpha$ is calculated. In step 906, the deviation $\sigma$ of this time is added to the integration value xint of the deviation a until last time, thereby updating the integration value xint of the deviation $\sigma$ (xint+$\sigma$). In step 907, the correction amount AFcomp (=K1·x1+K2·$\sigma$+K3·xint) of the upstream side target A/F ratio is calculated. After that, the program is finished.

The CPU 131 obtains the upstream-side target A/F ratio AFref by adding the correction amount AFcomp to the load target A/F ratio AFbase and calculates the fuel injection time Tinj so that the A/F ratio AF detected by the upstream-side exhaust gas sensor 124 converges to the upstream-side target A/F ratio AFref.

According to the ninth embodiment as described above, the correction amount AFcomp of the upstream-side A/F ratio is calculated by using the back stepping method. Consequently, the state variable (deviation between the output value O2out of the downstream-side exhaust gas sensor 125 and the target value O2targ) can be converged to 0 so as to trace an almost ideal convergence locus. Even under the conditions that the influence of disturbance and waste time is exerted and the output value O2out of the downstream-side exhaust gas sensor 125 (A/F ratio of the exhaust gas on the downstream side of the catalyst) is not easily converged to the target value O2targ in the conventional sliding mode control as shown by broken line in FIG. 23, the output value O2out of the downstream-side exhaust gas sensor 125 (A/F ratio of the exhaust gas on the downstream side of the catalyst) can be converged to the target value O2targ with high response as shown by solid line in FIG. 23.

Although the virtual input α(i) is set to be equal to Kc·x1(*i*) (refer to the equation (40)) in the ninth embodiment, as shown by the following equation, the virtual input α(i) may include a term in which the integration value Σx1 of the state variable x1(*i*) is multiplied by the constant gain K1.

$$\alpha(i) = Kc \cdot x1(i) + KI \cdot \sum_{j=0}^{j=i} x1(j) \tag{50}$$

In such a manner, the steady-state deviation of the state variable x1 and, moreover, the steady-state deviation of the output value O2out of the downstream-side exhaust gas sensor q25 (A/F ratio of the exhaust gas on the downstream side of the catalyst) can be reduced.

Figure 24:
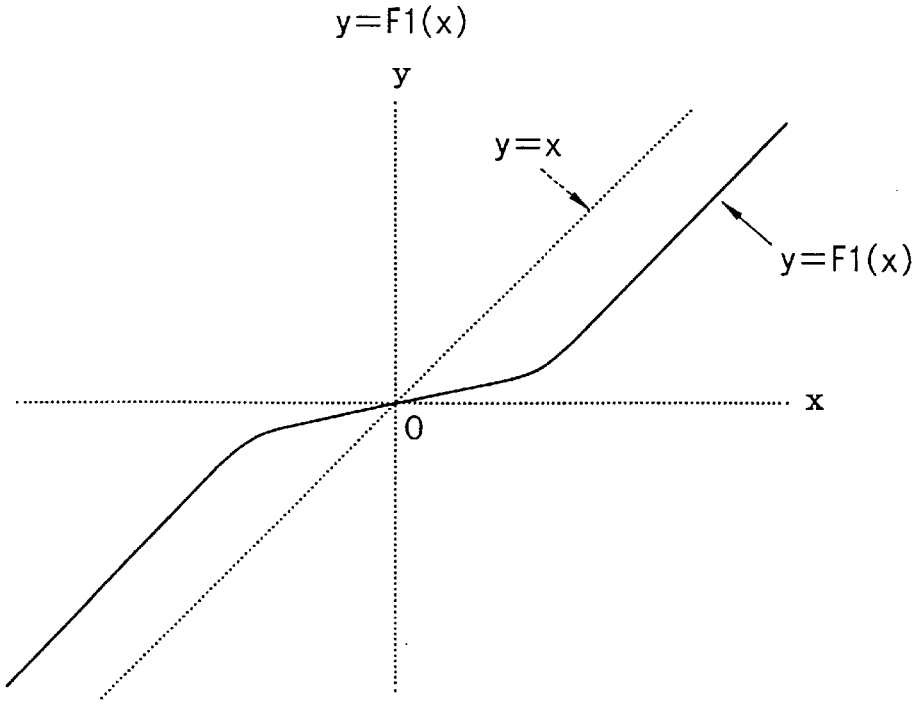
FIG. 24 is a diagram for explaining a non-linear function F1(*x*) used in a modification (ninth embodiment)
Figure 25:
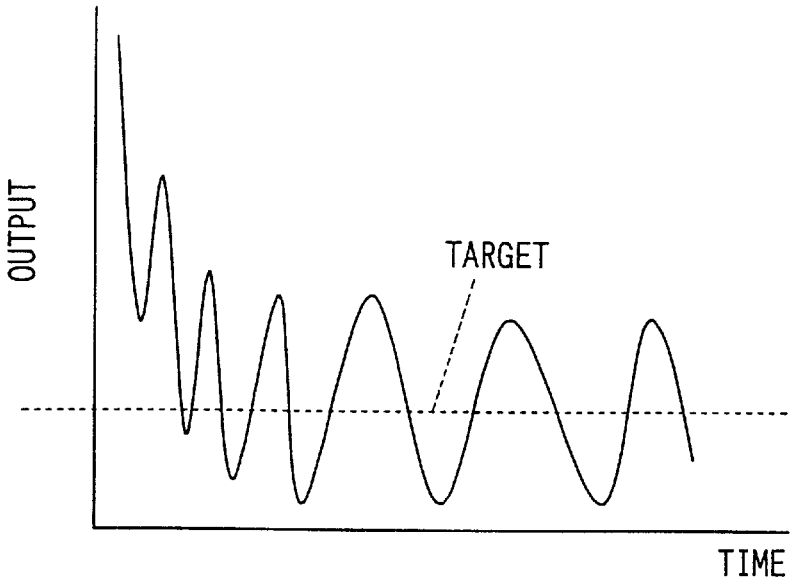
FIG. 25 PRIOR ART
FIG. 25 is a time chart (No. 1) showing convergence characteristics of a downstream-side exhaust gas sensor output in an exhaust gas A/F ratio control (prior art)
Figure 26:
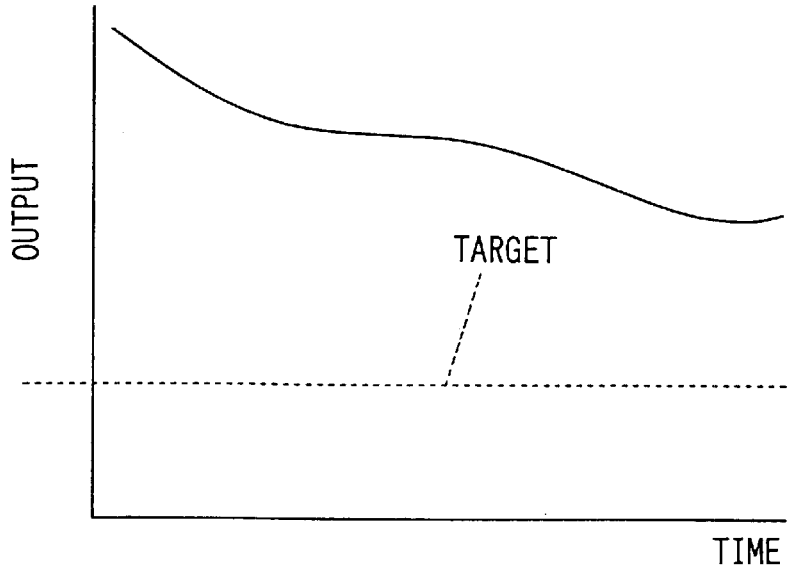
FIG. 26 PRIOR ART
FIG. 26 is a time chart (No. 2) showing convergence characteristics of a downstream-side A/F ratio sensor output in an exhaust gas A/F ratio control (prior art)

The virtual input α(i) may be set as shown by the following equation using the non-linear function F1(*x*) shown in FIG. 24.

$$\alpha(i)=F1(x(i)) \tag{51}$$

In this case, the non-linear function F1(*x*) is set, as shown in FIG. 24, as a non-linear function expressed as a linear line or curve having an inclination smaller than 1 and passing first and third quadrants in a predetermined region including the origin and expressed as a linear line having the inclination of 1 in the other region.

In such a manner, in the region where the state variable x(i) is small, that is, in the region where the deviation between the output value O2out of the downstream-side exhaust gas sensor 125 and the target value O2targ is small, the output value O2out of the downstream-side exhaust gas sensor 125 can be controlled around the target value O2targ like a bang—bang control of high gain. On the other hand, in the region where the state variable x(i) is large, that is, in the region where the deviation between the output value O2out of the downstream-side exhaust gas sensor 125 and the target value O2tag is large, an input is limited so as not to deteriorate the response.

As the downstream-side exhaust gas sensor 125, in place of the oxygen sensor, an A/F ratio sensor (linear A/F ratio sensor) may be used. As the upstream-side gas sensor, in place of the A/F ratio sensor (linear A/F ratio sensor), an oxygen sensor may be used.

The present invention may be variously modified by, for example, properly changing the model equation of the subject to be controlled.

Tenth Embodiment

Figure 27:
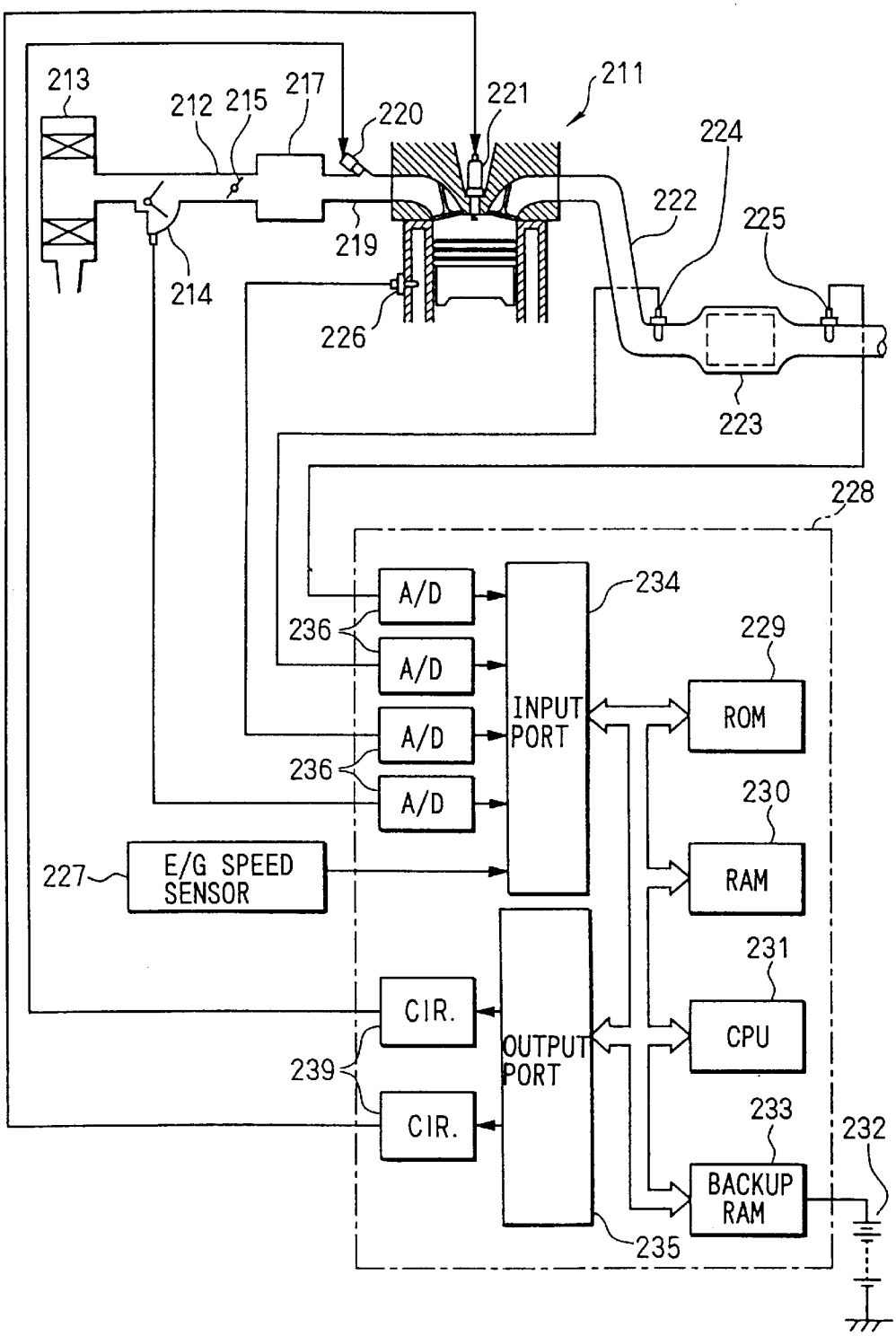
FIG. 27 is a schematic configuration diagram of a whole engine control system (tenth embodiment)

The tenth embodiment of the present invention will be described hereinbelow with reference to the drawings. First, a schematic configuration of a whole engine control system will be described with reference to FIG. 27. In the uppermost stream part of an intake pipe 212 of an engine 211 as an internal combustion engine, an air cleaner 213 is provided. On the downstream side of the air cleaner 213, an air flow meter 214 for detecting an intake air amount is provided. On the downstream side of the air flow meter 214, a throttle valve 215 is provided.

Further, on the downstream side of the throttle valve 215, a surge tank 217 is provided. The surge tank 217 is provided with an intake manifold 219 for introducing air into each of cylinders of the engine 211. A fuel injection valve 220 for injecting fuel is attached near the intake port of the intake manifold 219 of each cylinder. A spark plug 221 is attached to a cylinder head of each of cylinders of the engine 211.

In some midpoint of an exhaust pipe 222 of the engine 211, a catalyst 223 such as a three-way catalyst for treating CO, HC, NOx, and the like in exhaust gases is disposed. On the upstream and downstream sides of the catalyst 223, exhaust gas sensors 224 and 225 each for detecting A/F ratio of an exhaust gas are disposed, respectively. In the tenth embodiment, as the upstream-side exhaust gas sensor 224, an A/F ratio sensor (linear A/F ratio sensor) for outputting a linear A/F ratio signal according to the A/F ratio is used. As the downstream-side exhaust gas sensor 225, an oxygen sensor of which output voltage is inverted according to whether the A/F ratio of the exhaust gas is rich state or lean state is used. When the A/F ratio is lean state, the downstream-side exhaust gas sensor 225 generates an output voltage of about 0.1V. When the A/F ratio is rich state, the downstream-side exhaust gas sensor 225 generates an output voltage of about 0.9V. To a cylinder block of the engine 211, a water temperature sensor 226 for detecting a cooling water temperature and an engine speed sensor 227 for detecting engine speed are attached.]

An engine control unit (hereinbelow, referred to as an "ECU") 228 is constructed mainly by a microcomputer having a ROM 229, a RAM 230, a CPU 231, a backup RAM 233 backed up by a battery 232, an input port 234, and an output port 235. To the input port 234, an output signal of the engine speed sensor 227 is supplied and also output signals from the air flow meter 214, upstream-side and downstream-side exhaust gas sensors 224 and 225, and water temperature sensor 226 are supplied via A/D converters 236. To the output port 235, the fuel injection valve 220, spark plug 221, and the like are connected via driving circuits 239.

The ECU 228 executes a fuel injection control program and an ignition control program stored in the ROM 229 by the CPU 231, thereby controlling the operations of the fuel injection valve 220 and the spark plug 221. The ECU 228 also executes an A/F ratio control program, thereby performing feedback control on the A/F ratio (fuel injection amount) so that the A/F ratio of the exhaust gas becomes the target A/F ratio.

Figure 28:
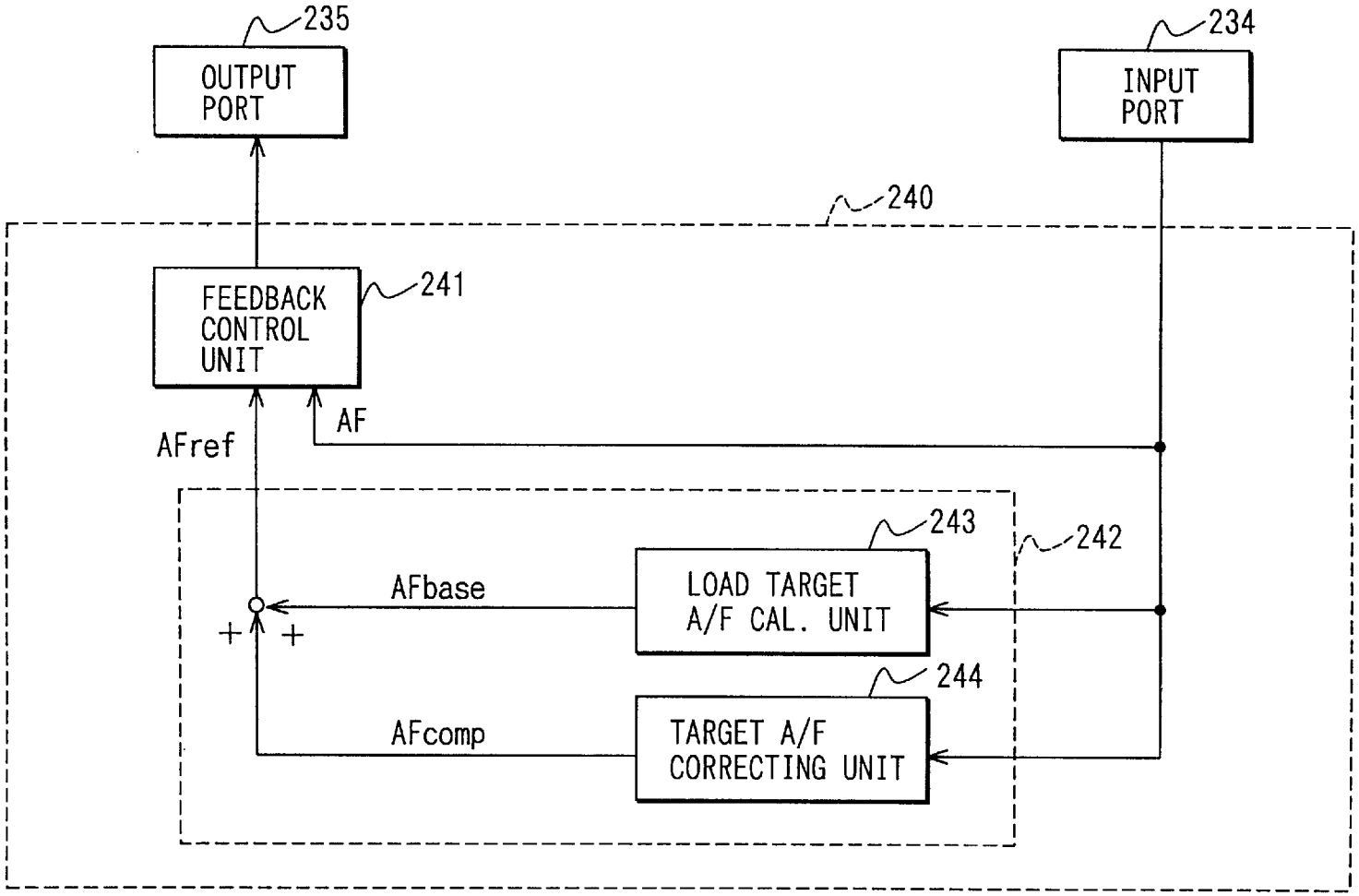
FIG. 28 is a block diagram showing functions of exhaust gas A/F ratio control means realized by the function of computing process of a CPU in an ECU (tenth embodiment)
Figure 29:
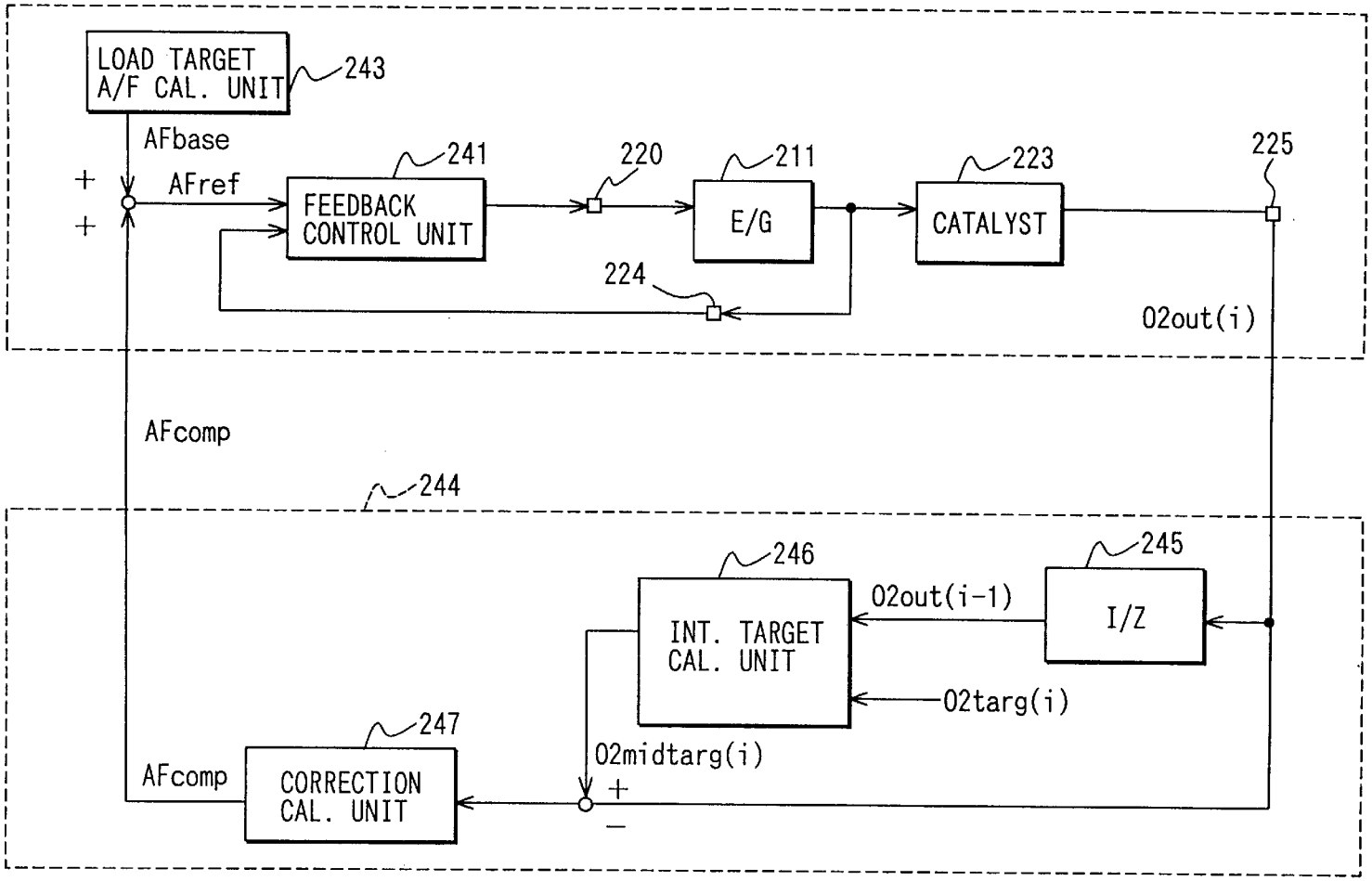
FIG. 29 is a functional block diagram showing the functions of a whole exhaust gas A/F ratio feedback control system (tenth embodiment)

An A/F ratio feedback control system of the tenth embodiment will be described hereinbelow with reference to FIGS. 28 and 29. FIG. 28 is a block diagram showing the functions of A/F ratio control means 240 realized by the computing process function of the CPU 231, and FIG. 29 is a block diagram showing the functions of the whole A/F ratio feedback control system.

The A/F ratio control means 240 is constructed by a fuel injection amount feedback control unit 241 and a target A/F ratio calculating unit 242. Further, the target A/F ratio calculating unit 242 is constructed by a load target A/F ratio calculating unit 243 and a target A/F ratio correcting unit 244.

The fuel injection amount feedback control unit 241 calculates fuel injection time Tinj of the fuel injection valve 220 so that the A/F ratio AF detected by the upstream-side exhaust gas sensor 224 converges to an upstream-side target A/F ratio AFref. The fuel injection time Tinj is calculated by an optimum regulator built for a linear equation of a model of the subject to be controlled. The fuel injection amount feedback control unit 241 operates as A/F ratio feedback control means in the present invention.

The load target A/F ratio calculating unit 243 calculates a load target A/F ratio AFbase according to an intake air volume (or intake pipe pressure) and engine speed by a functional equation or map stored in the ROM 229. The functional equation or map for calculating the load target A/F ratio AFbase is preset by a test or the like so that, when an output value O2out (detected A/F ratio) of the downstream-side exhaust gas sensor 225 is stationarily almost equal to a final target value O2targ (final downstream-side target A/F ratio), by maintaining the upstream-side target A/F ratio AFref at the load target A/F ratio AFbase, the output value O2out of the downstream-side exhaust gas sensor 225 is maintained at about the final target value O2targ.

The target A/F ratio control unit 244 calculates a correction amount AFcomp of the upstream-side target A/F ratio AFref by using an intermediate target value O2midtarg which will be described hereinlater on the basis of the output value O2out of the downstream-side exhaust gas sensor 225. By adding the correction amount AFcomp to the load target A/F ratio AFbase, the upstream-side target A/F ratio AFref is obtained. The upstream-side target A/F ratio AFref is supplied to the fuel injection amount feedback control unit 241.

$$AFref=AFbase+AFcomp \tag{52}$$

In place of the equation, the upstream-side target A/F ratio AFref may be also calculated.

$$AFref=(1+AFcomp)\times AFbase \tag{53}$$

In this case, the target A/F ratio calculating unit 242 (the load target A/F ratio calculating unit 243 and the target A/F ratio correcting unit 244) corresponds to sub feedback control means in the present invention.

A method of calculating the correction amount AFcomp of the upstream-side target A/F ratio AFref by using the intermediate target value O2midtarg by the target A/F ratio correcting unit 244 will be described with reference to FIG. 29.

The subject to be controlled is a system including the fuel injection amount feedback control unit 241, fuel injection valve 220, engine 211, catalyst 223, and downstream-side exhaust gas sensor 225. The A/F ratio correcting unit 244 has a time lag element (1/z) 245, an intermediate target value calculating unit 246, and a correction amount calculating unit 247. The time lag element 245 supplies an output O2out(i−1) of the downstream-side exhaust gas sensor 225 in computation of last time to the intermediate target value calculating unit 246.

Figure 30:
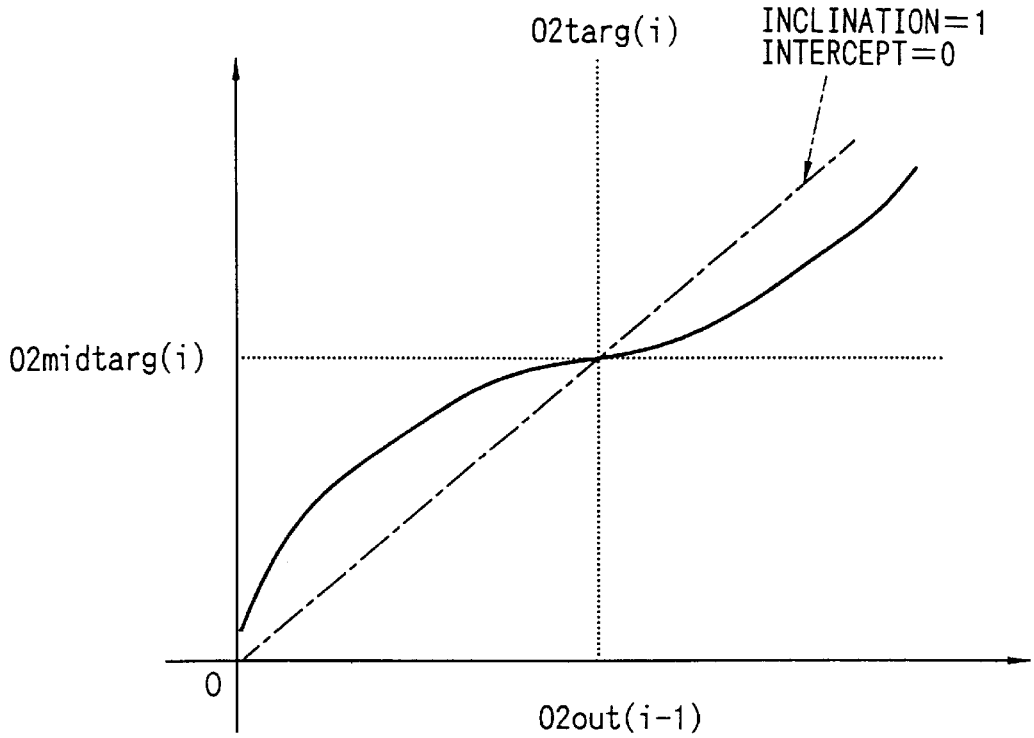
FIG. 30 is a diagram conceptually showing a map for setting an intermediate target value O2midtarg(i) in accordance with an output O2out(i−1) of a downstream-side A/F ratio sensor in computation of last time (tenth embodiment)

The intermediate target value calculating unit 246 corresponds to intermediate target value setting means in the present invention and calculates an intermediate target value O2midtarg(i) on the basis of the output O2out(i−1) of the downstream-side exhaust gas sensor 225 in computation of last time and a final target value O2targ(i) (final downstream-side target A/F ratio) by using a map of FIG. 30 or the following equation (54). By the calculation, the intermediate target value O2midtarg(i) is set between the output O2out(i−1) of the downstream-side exhaust gas sensor 225 in computation of last time and the final target value O2targ(i).

The map of FIG. 30 for setting the intermediate target value O2midtarg(i) is expressed by a non-linear increasing function which is set as follows. When the output O2out(i−1) of the downstream-side exhaust gas sensor 225 in computation of last time is smaller than the final target value O2targ(i), that is, when the A/F ratio is lean, the intermediate target value O2midtarg(i) is positioned upper than the linear line having inclination of 1 and intercept of 0. On the contrary, when the output O2out(i−1) of the downstream-side exhaust gas sensor 225 in computation of last time is larger than the final target value O2targ(i), that is, when the A/F ratio is rich, the intermediate target value O2midtarg(i) is positioned lower than the linear line having inclination of 1 and intercept of 0. The curve of the non-linear increasing function may be determined by static characteristics of the downstream-side exhaust gas sensor 225.

In the case of calculating the intermediate target value O2midtarg(i) by mathematical expression, the following expression (54) may be used.

$$\mathrm{O2midtarg}(i)=\mathrm{O2targ}(i)+Kdec\times\{\mathrm{O2out}(i-1)-\mathrm{O2targ}(i)\} \tag{54}$$

In the equation, O2targ(i) denotes a final target value of this time, and O2out(i−1) expresses an output of the downstream-side exhaust gas sensor 225 in computation of last time. Kdec denotes a positive coefficient smaller than 1 (hereinbelow, called a "damping factor") and is set in the range of 0 <Kdec <1. The damping factor Kdec may be a fixed value for a simplified computing process or, for example, may be set by using a map or mathematical expression in accordance with the engine operating conditions (such as intake air amount and engine speed).

An output change characteristic of the downstream-side exhaust gas sensor 225 (oxygen sensor) is that the response of a change from the lean A/F ratio to the rich A/F ratio of exhaust gas and that of a change from the rich A/F ratio to the lean A/F ratio of exhaust gas are not the same but the former is fast and the latter is slow. In consideration of the characteristic, the damping factor Kdec in the rich A/F ratio state and that in the lean A/F ratio state with respect to the final target value O2targ(i) may be calculated from the map of FIG. 31 or mathematical expression. In such a manner, the intermediate target value O2midtarg(i) can be obtained with high accuracy by compensating the difference in response according to the A/F ratio of exhaust gas.

Figure 31:
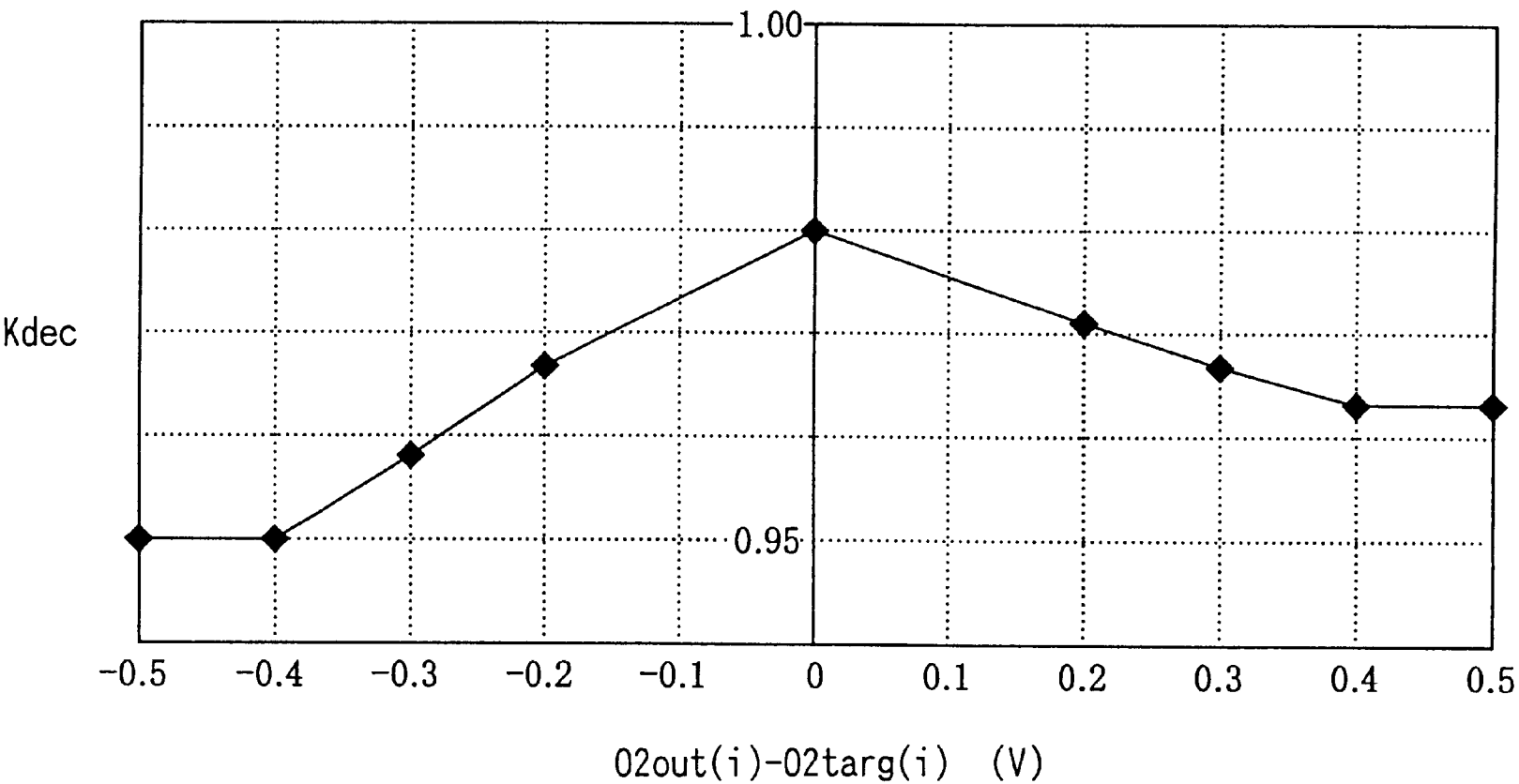
FIG. 31 is a diagram conceptually showing a map for setting a damping factor in accordance with a deviation between an output O2out(i) of the downstream-side A/F ratio sensor at present and a final target value O2targ(i) (tenth embodiment)

In the map of FIG. 31, the smaller the absolute value of the deviation between the output O2out(i) at present of the downstream-side exhaust gas sensor 225 and the final target value O2targ(i) becomes, the higher the damping factor Kdec is set, thereby improving convergence of the output O2out(i) of the downstream-side exhaust gas sensor 225 to the final target value O2targ(i). To simplify the computing process, the damping factor Kdec may be simply switched in two levels at the time of rich A/F ratio and lean A/F ratio with respect to the final target value O2targ(i).

After calculating the intermediate target value O2midtarg (i) by using the map of FIG. 30 or the above equation (54) as described above, the correction amount AFcomp(i) of the upstream-side target A/F ratio AFref is calculated by the following equation using the intermediate target value O2midtarg(i).

$$AFcomp(i)=Fsat\{\mathrm{K1}\times(\mathrm{O2midtarg}(i)-\mathrm{O2out}(i))+\mathrm{K2}\times\Sigma(\mathrm{O2midtarg}(i)-\mathrm{O2out}(i))\}=Fsat(\mathrm{K1}\times\Delta\mathrm{O2}(i)+\mathrm{K2}\times\Sigma\Delta\mathrm{O2}(i)) \tag{55}$$

Here, $\Delta\mathrm{O2}(i)=\mathrm{O2midtarg}(i)-\mathrm{O2out}(i)$

Figure 32:
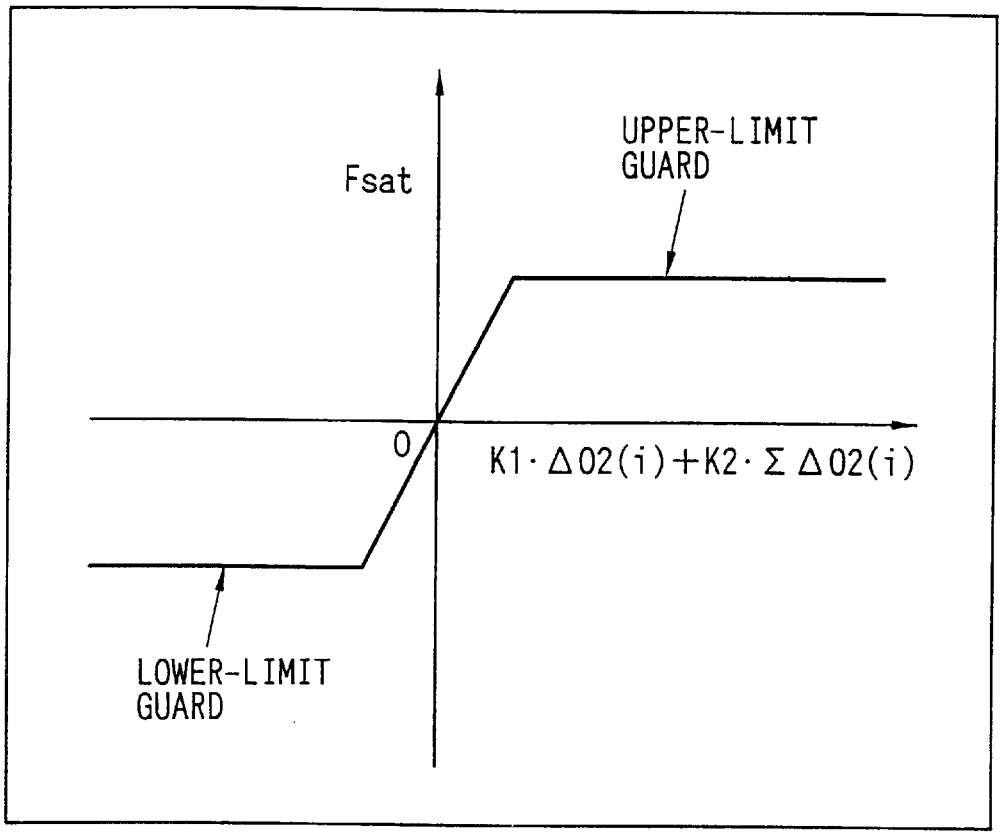
FIG. 32 is a diagram for explaining a saturation function for calculating a correction amount AFcomp(i) (tenth embodiment)

In the equation, Fsat denotes a saturation function having characteristics as shown in FIG. 32 and the correction amount AFcomp(i) is obtained by setting an upper-limit guard value and a lower-limit guard value for a computation value of $\mathrm{K1}\times\Delta\mathrm{O2}(i)+\mathrm{K2}\times\Sigma(\Delta\mathrm{O2}(i))$. In the equation, K1 indicates a proportional gain and K2 expresses an integral gain. Consequently, $\mathrm{K1}\times\Delta\mathrm{O2}(i)$ denotes a proportional term which increases as the deviation $\Delta\mathrm{O2}(i)$ between the intermediate target value O2midtarg(i) and the output O2out(i) of the downstream-side exhaust gas sensor 225 becomes larger. $\mathrm{K2}\times\Sigma\Delta\mathrm{O2}(i)$ denotes an integration term which becomes larger as an integration value of the deviation $\Delta\mathrm{O2}(i)$ between the intermediate target value O2midtarg(i) and the output O2out(i) of the downstream-side exhaust gas sensor 225 becomes larger. The correction amount AFcomp(i) is obtained by a value derived by adding the proportional term and the integration term while setting the upper-limit and lower-limit guard values.

Figure 33:
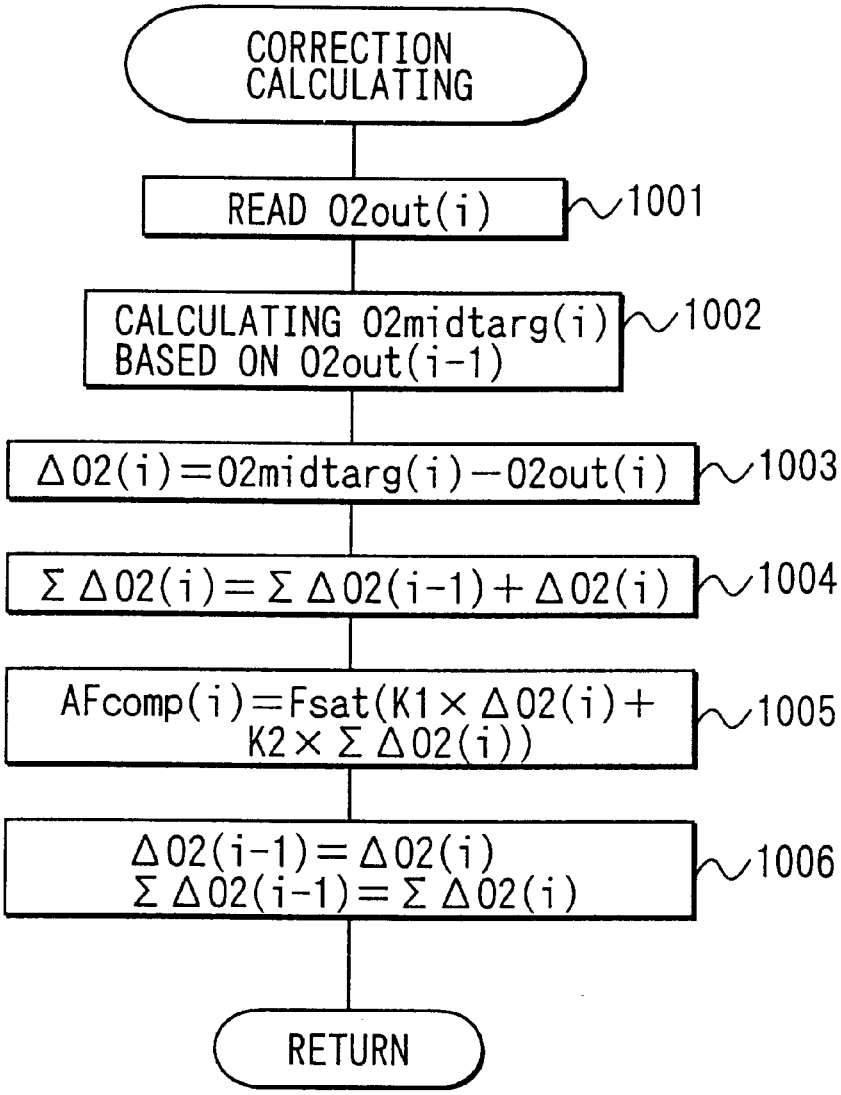
FIG. 33 is a flowchart showing the flow of processes of a correction amount calculating program (tenth embodiment)

The above-described calculation of the correction amount AFcomp(i) by the target A/F ratio correcting unit 244 is executed according to a correction amount calculating program of FIG. 33. The program is executed every predetermined time or every predetermined crank angle. When the program is started, first, in step 1001, a present output O2out(i) of the downstream-side exhaust gas sensor 225 is read. In step 1002, the intermediate target value O2midtarg (i) is calculated by using the map of FIG. 30 or the equation (54) on the basis of the output O2out(i−1) of the downstream-side exhaust gas sensor 225 in computation of last time and the final target value O2targ(i) (final downstream-side target A/F ratio). By the calculation, the intermediate target value O2midtarg(i) is set between the output O2out(i−1) of the downstream-side exhaust gas sensor 225 in computation of last time and the final target value O2targ(i).

After that, the program advances to step 1003 where the deviation $\Delta O2(i)$ between the intermediate target value O2midtarg(i) and the output O2out(i) of the downstream-side exhaust gas sensor 25 is calculated.

$$\Delta O2(i)=O2midtarg(i)-O2out(i) \quad (56)$$

In the following step 1004, the deviation $\Delta O2(i)$ of this time is added to the integration value $\Sigma\Delta O2(i-1)$ of the deviation $\Delta O2$ up to and including last time, thereby calculating the integration value $\Sigma\Delta O2(i)$ up to and including this time.

$$\Sigma\Delta O2(i)=\Sigma\Delta O2(i-1)+\Delta O2(i) \quad (57)$$

After that, the program advances to step 1005 where the correction amount AFcomp(i) of the upstream-side target A/F ratio AFref is calculated by the following equation.

$$AFcomp(i)=Fsat(K1\times\Delta O2(i)+K2\times\Sigma\Delta O2(i)) \quad (58)$$

In this case, the correction amount AFcomp(i) of the upstream-side target A/F ratio AFref is obtained by adding the proportional term $(K1\times\Delta O2(i))$ and the integral term $(K2\times\Sigma\Delta O2(i))$ while setting the upper-limit guard value and the lower-limit guard value.

In step 1006, $\Delta O2(i)$ and $\Sigma\Delta O2(i)$ of this time are stored as $\Delta O2(i-1)$ and $\Sigma\Delta O2(i-1)$ of last time, and the program is finished.

During the engine operation, the load target A/F ratio AFbase according to the intake air volume (or intake pipe pressure) and the engine speed is calculated, and the correction amount AFcomp calculated by the correction amount calculating program of FIG. 33 is added to the load target A/F ratio AFbase, thereby deriving the upstream-side target A/F ratio AFref. A fuel injection time Tinj (fuel injection amount) is calculated so that the A/F ratio AF detected by the upstream-side exhaust gas sensor 224 converges to the upstream-side target A/F ratio AFref.

According to the above-described embodiment, the intermediate target value O2midtarg(i) is calculated on the basis of the output O2out(i−1) of the downstream-side exhaust gas sensor 225 in computation of last time and the final target value O2targ(i), and the correction amount AFcomp(i) of the upstream-side target A/F ratio is calculated on the basis of the output O2out(i) of the downstream-side exhaust gas sensor 225 and the intermediate target value O2midtarg(i). Consequently, the response of the sub feedback control to a change in dynamic characteristics of the catalyst 223 is improved. The A/F ratio on the downstream side of the catalyst 223 (output of the downstream-side exhaust gas sensor 225) becomes stable, no hunting due to a change in dynamic characteristics of the catalyst 223 occurs, and stable control on the A/F ratio can be performed.

As the downstream-side exhaust gas sensor 225, in place of the oxygen sensor, an A/F ratio sensor (linear A/F ratio sensor) may be used. As the upstream-side exhaust gas sensor 224, in place of the A/F ratio sensor (linear A/F ratio sensor), an oxygen sensor may be used.

Although the output O2out(i−1) of the downstream-side exhaust gas sensor 225 in computation of last time is used to calculate the intermediate target value O2midtarg(i) in the tenth embodiment, the output O2out(i−n) of the downstream-side exhaust gas sensor 225 of the time before a predetermined number of computation times may be used.

The present invention can be variously modified by, for example, properly changing an equation of calculating the intermediate target value O2midtarg(i) and an equation of calculating the correction amount AFcomp(i).

Eleventh Embodiment

An A/F ratio feedback control system of the eleventh embodiment will be described hereinbelow with reference to the drawings.

Figure 34:
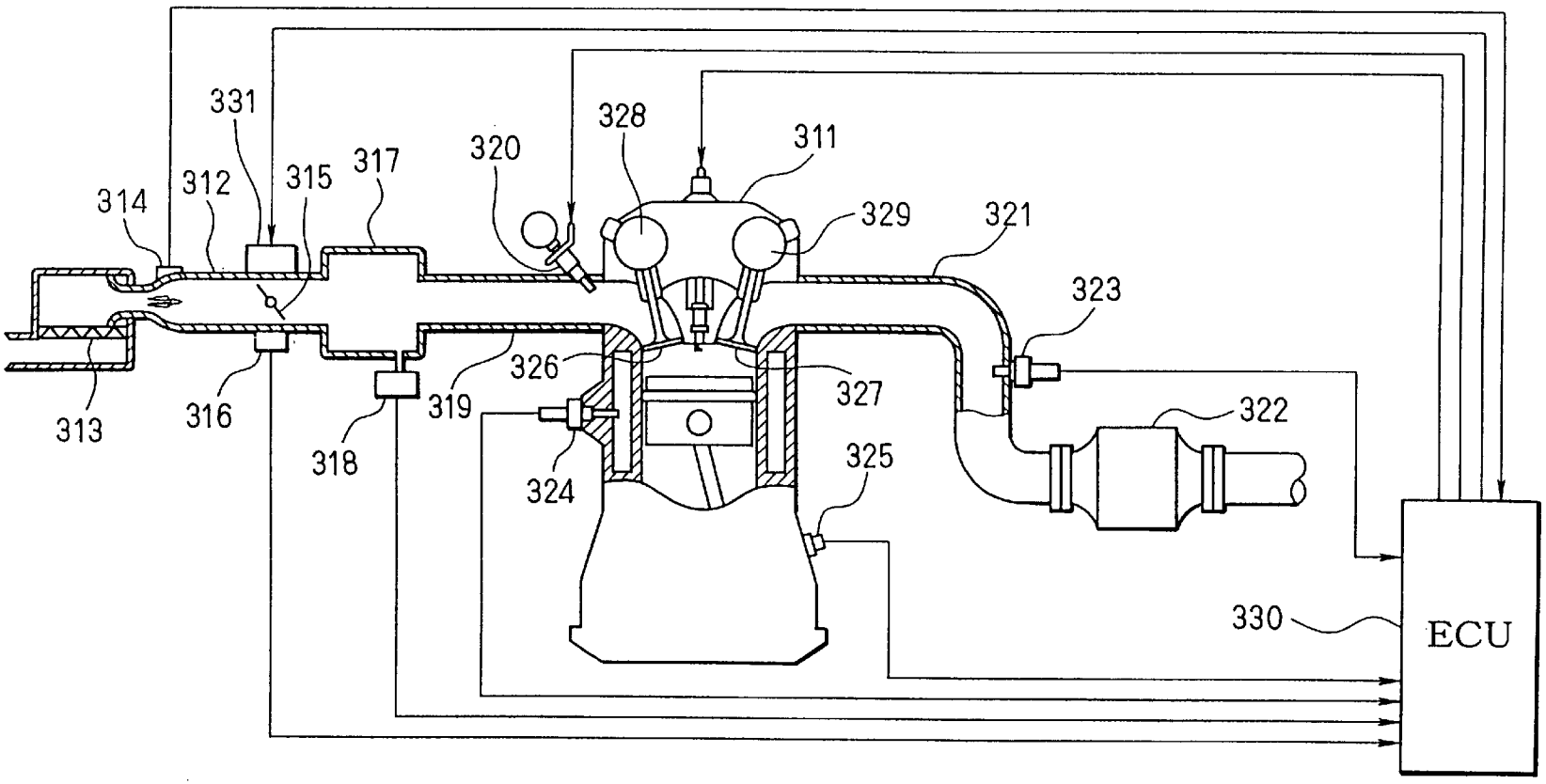
FIG. 34 is a schematic configuration diagram of a whole engine control system in an exhaust gas A/F ratio feedback control system (eleventh embodiment)

First, the schematic configuration of a whole engine control system will be described by referring to FIG. 34. In the uppermost stream part of an intake pipe 312 of an engine 311 as an internal combustion engine, an air cleaner 313 is provided. On the downstream side of the air cleaner 313, an air flow meter 314 for detecting an intake air volume is provided. On the downstream side of the air flow meter 314, a throttle valve 315 driven by a motor 331 such as a DC motor is provided. The angle (throttle angle) of the throttle valve 315 is detected by a throttle angle sensor 316. During engine operation, a controlled variable of the motor 331 is feedback controlled so that an actual throttle angle detected by the throttle angle sensor 316 coincides with a target throttle angle set according to an accelerator operation amount or the like.

On the downstream side of the throttle valve 315, a surge tank 317 is provided, and the surge tank 317 is provided with an intake pressure sensor 318 for detecting an intake pressure. The surge tank 317 is provided with an intake manifold 319 for introducing the air into each of cylinders of the engine 311. Near the intake port of the intake manifold 319 of each cylinder, a fuel injection valve 20 for injecting fuel is attached. An intake valve 326 and an exhaust valve 327 of the engine 311 are driven by variable valve timing adjusting mechanisms 328 and 329, respectively, and an intake/exhaust valve timing (VVT angle) is adjusted according to engine operating conditions.

In some midpoint of an exhaust pipe 321 of the engine 311, a catalyst 322 such as a three-way catalyst for treating exhaust gas is disposed. On the upstream side of the catalyst 22, an A/F ratio sensor (or oxygen sensor) 323 for detecting the A/F ratio of the exhaust gas (or concentration of oxygen) is provided. To a cylinder block of the engine 311, a cooling water temperature sensor 324 for detecting the temperature of cooling water and an engine speed sensor 325 (crank angle sensor) for detecting the engine speed are attached.

Outputs of the various sensors are supplied to an engine control unit (hereinbelow, referred to as "ECU") 330. The ECU 330 is constructed mainly by a microcomputer and executes a correction amount calculating program of FIG. 36, which will be described hereinlater, stored in a built-in ROM (storage medium), thereby performing a feedback control so that the A/F ratio on the upstream side of the catalyst 322 coincides with the target A/F ratio ϕtg. The ECU 330 also performs various feedback controls such as throttle angle control, variable valve timing control, idle speed control (ISC), fuel pressure feedback control (fuel pump control), boost pressure feedback control of a turbo charger, and cruise control.

Figure 35:
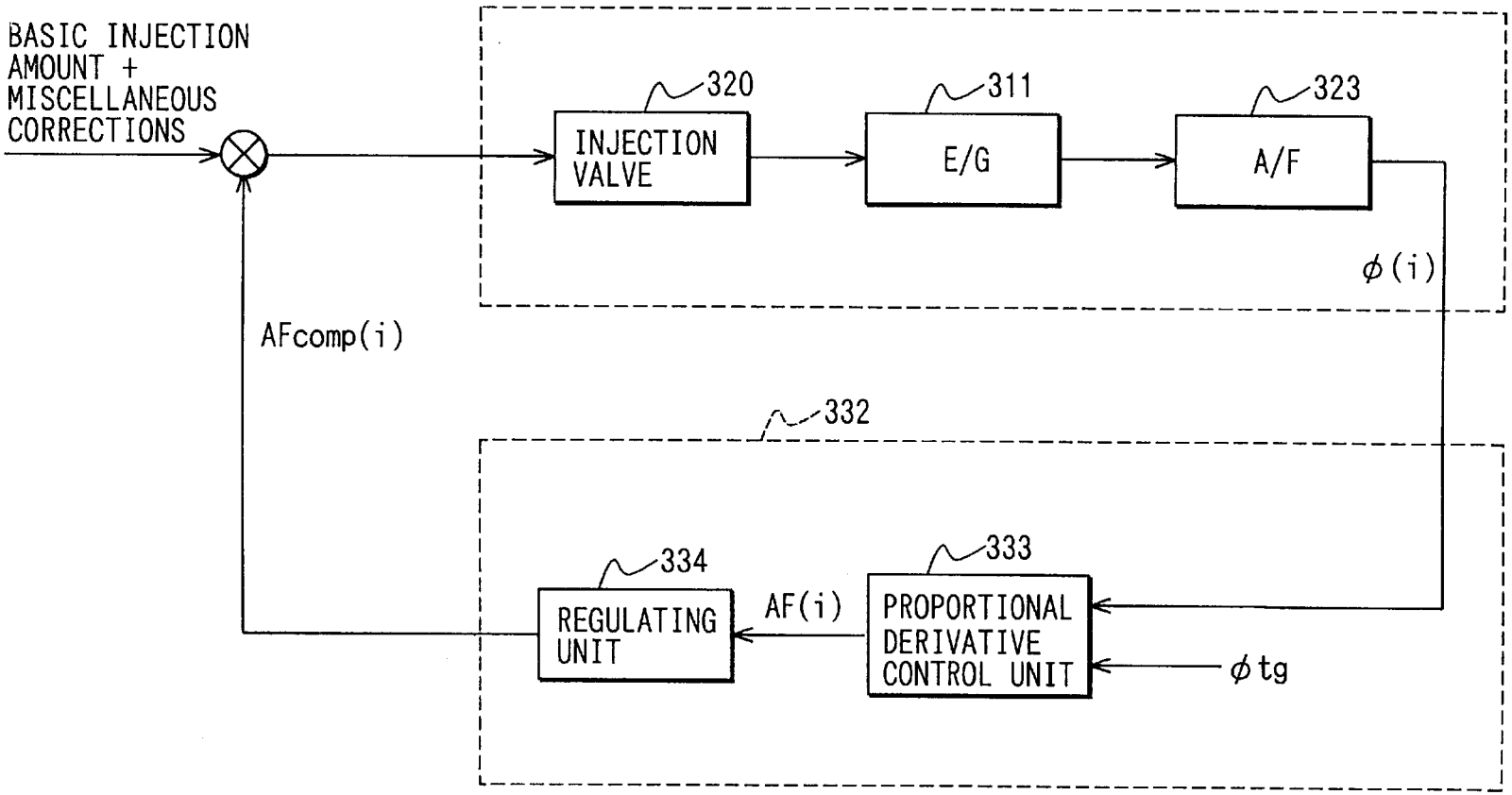
FIG. 35 is a block diagram showing the functions of the whole exhaust gas A/F ratio feedback control system (eleventh embodiment)
Figure 36:
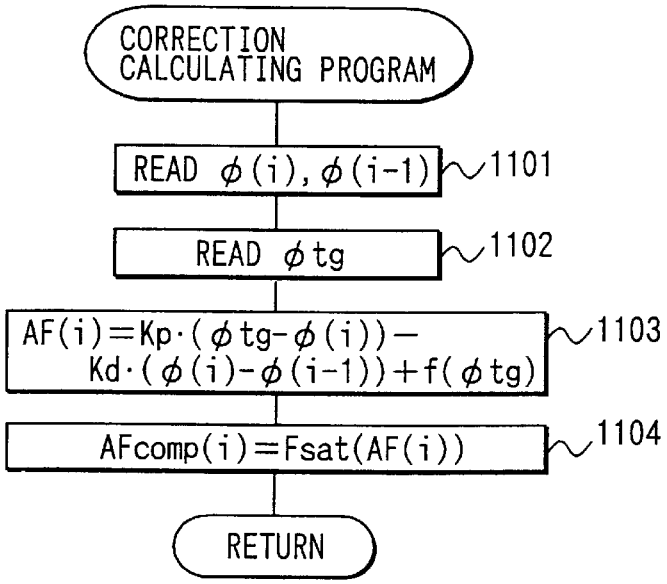
FIG. 36 is a flowchart showing the flow of a correction amount calculating program (eleventh embodiment)

Although the invention can be applied to any of the feedback controls, the case of applying the invention to the A/F ratio feedback control will be described by referring to FIGS. 35–37. FIG. 35 is a functional block diagram showing the outline of an A/F ratio feedback control system. The subject of the A/F ratio feedback control is a system including the fuel injection valve 320, engine 311, and A/F ratio sensor 323. An input of the control subject is a fuel injection amount obtained by correcting a fuel injection amount derived by adding various correction amounts to a basic injection amount (or multiplying the basic injection amount by various correction coefficients) by an output AFcomp(i) of an A/F ratio feedback control unit 332. The basic injection amount is calculated by using a map or mathematical expression in accordance with an intake air volume (or intake pipe pressure) and engine speed. Various correction amounts include, for example, a correction amount according to a cooling water temperature, a correction amount at the time of acceleration/deceleration driving, and a correction amount in a learning control. An output of the control subject is an output ϕ(i) (A/F ratio, excess air ratio, or excess fuel ratio) of the A/F ratio sensor 323.

The relations of the air-fuel ratio, excess air ratio, and excess fuel ratio are as follows.

excess air ratio=air-fuel ratio/stoichiometric air-fuel ratio=air-fuel ratio/14.6 excess fuel ratio=1/excess air ratio=14.6/air-fuel ratio

Since each of the excess air ratio and the excess fuel ratio is a physical quantity expressing information of the A/F ratio, by using any of the A/F ratio, excess air ratio, and excess fuel ratio, the same A/F ratio feedback control can be performed. In the following description, an input of the A/F ratio feedback control unit 332 is A/F ratio. Obviously, the excess air ratio or fuel excess ratio may be used.

The functions of the A/F ratio feedback control unit 332 are realized when the ECU 330 executes a correction amount calculating program of FIG. 36 which will be described hereinlater, and corresponds to the feedback control means in the present invention. The A/F ratio feedback control unit 332 is constructed by a proportional derivative control unit 333 (proportional derivative control means) and a regulating unit 334 (regulating means).

The proportional derivative control unit 333 performs a proportional (P) operation and a differential (D) operation on the basis of the output ϕ(i) of the A/F ratio sensor 323 and the target A/F ratio ϕtg, and calculates the A/F ratio correction amount AF(i) by the following equation.

$$AF(i)=Kp(\phi tg-\phi(i))-Kd(\phi(i)-\phi(i-1))+f(\phi tg) \quad (59)$$

Here, Kp denotes a gain of the proportional term (proportional gain), Kp(ϕtg−ϕ(i)) denotes the proportional term, Kd indicates a gain of a differential term (differential gain), and Kd(ϕ(i)−ϕ(i−1)) expresses a differential term. In this case, the differential gain Kd is set to be higher than the proportional gain Kp (Kd>Kp). f(ϕtg) is calculated by a map or mathematical expression using the target A/F ratio ϕtg as a parameter. The target A/F ratio ϕtg is set by a map or mathematical expression according to the engine operating states (for example, intake air volume and engine speed).

The regulating unit 334 sets the upper-limit guard value and the lower-limit guard value to regulate the A/F ratio correcting amount AF(i) by using a saturation function Fsat(x) having characteristics as shown in FIG. 4 to thereby obtain the final A/F ratio correcting amount AFcomp(i).

$$Afcomp(i)=Fsat(AF(i)) \quad (60)$$

A proportional derivative control equation used for calculating the A/F ratio correction amount AF(i) is derived as follows from a model expression for feedback-controlling the A/F ratio by using an intermediate target value Δϕmidtg (i) as follows.

First, the deviation (A/F ratio deviation) Δϕ(i) between the present output ϕ(i) of the A/F ratio sensor 23 and the final target A/F ratio ϕtg is calculated.

$$\Delta\phi(i)=\phi(i)-\phi tg \quad (61)$$

The intermediate target value Δϕmidtg(i) of the A/F ratio deviation is obtained by multiplying the value Δϕ(i−1) of last time of the A/F ratio deviation by a coefficient K1.

$$\Delta\phi midtg(i)=\mathrm{K1}\times\Delta\phi(1-i) \quad (62)$$

The coefficient K1 may be a fixed value for a simplified computing process or, for example, may be set by a map or mathematical expression in accordance with the engine operating conditions (such as intake air volume and engine speed).

The deviation E between the intermediate target value Δϕmidtg(i) and the A/F ratio deviation Δϕ(i) is calculated.

$$E=\Delta\phi midtg(i)-\Delta\phi(i)=\mathrm{K1}\times\Delta\phi(i-1)-(\phi)(i)-\phi tg)=\mathrm{K1}(\phi(i-1)-\phi tg)-(\phi(i)-\phi tg) \quad (63)$$

By using the deviation E, the A/F ratio correcting amount AF(i) is calculated by the following equation.

$$AF(i)=\mathrm{K2}\times E+f(\phi tg)=\mathrm{K2}\{\mathrm{K1}(\phi(i-1)-\phi tg)-(\phi(i)-\phi tg)\}+f(\phi tg)=\mathrm{K2}(1-\mathrm{K1})(\phi tg-\phi(i))-\mathrm{K1}\times\mathrm{K2}(\phi(i)-\phi)(i-1))+f(\phi tg) \quad (64)$$

When it is assumed that Kp=K2 (1−K1) and Kd=K1×K2, a proportional derivative control expression for calculating the A/F ratio correcting amount AF(i) is derived as follows.

$$AF(i)=Kp(\phi tg-\phi(i))-Kd(\phi(i)-\phi)(i-1\ ))+f(\phi tg) \quad (65)$$

The ECU 330 executes the correction amount calculating program of FIG. 36 every predetermined time or every predetermined crank angle during engine operation, thereby calculating the final A/F ratio AFcomp(i) as follows. First, in step 1101, the present A/F ratio ϕ(i) detected by the A/F ratio sensor 323 and the A/F ratio ϕ(i−1) of last time are read. In step 1102, the target A/F ratio ϕtg is read. The target A/F ratio ϕtg is set by a map or mathematical expression in accordance with the engine operating conditions (such as intake air volume and engine speed).

After that, the program advances to step 1103 where the A/F ratio correcting amount AF(i) is calculated by the following proportional derivative control equation.

$$AF(i)=Kp(\phi tg-\phi(i))-Kd(\phi(i)-\phi(i-1))+f(\phi tg) \quad (66)$$

In the equation, the differential gain Kd is set to be higher than the proportional gain Kp (Kd>Kp). Kd/(Kd+Kp) is preferably set to be 0.7 or larger and is more preferably set to be 0.9 or larger.

Figure 37:
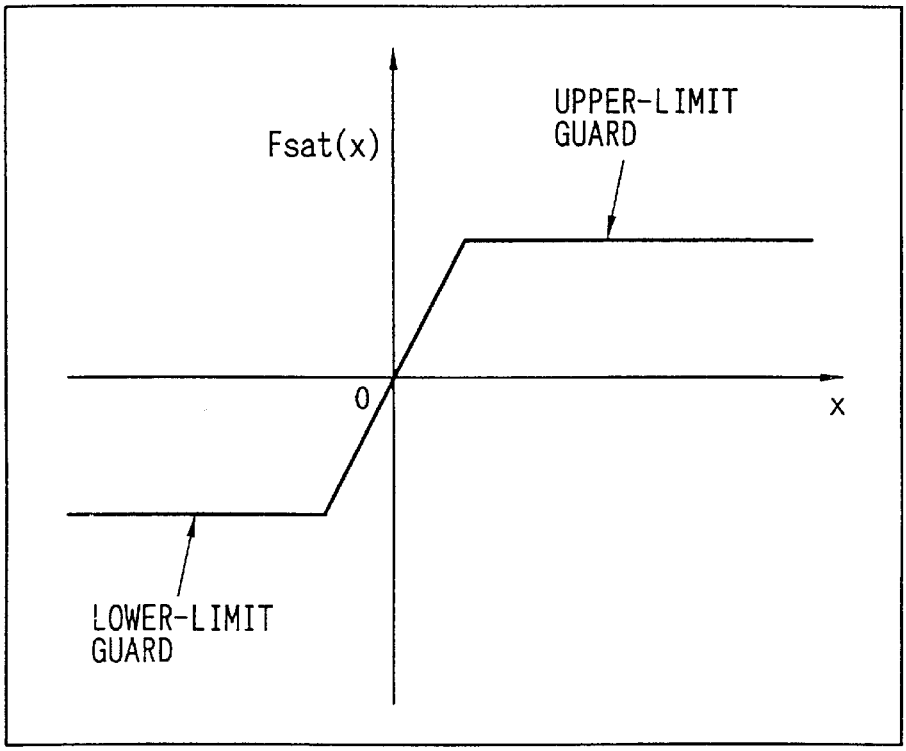
FIG. 37 is a diagram for explaining a saturation function for calculating an correction amount AFcomp(i) (eleventh embodiment)

The program advances to step 1103 where the A/F ratio correcting amount AF(i) is limited while setting the upper-limit and lower-limit guard values by using a saturation function Fsat(x) having characteristics as shown in FIG. 37, thereby deriving the final A/F ratio correction amount AFcomp(i).

$$Afcomp(i)=Fsat(AF(i)) \quad (67)$$

Consequently, the final A/F ratio correction amount AFcomp(i) limited in the range between the upper-limit and lower-limit guard values can be obtained.

Although an addition term f(ϕtg) is added to the proportional derivative control equation to calculate the A/F ratio correction amount AF(i) in the embodiment, as shown by the following equation, it is also possible to omit the addition term f(ϕtg) from the proportional derivative control equation and add the addition term f(ϕtg) to the limited correction amount Fsat(AF(i)), thereby obtaining the final A/F ratio correction amount AFcomp(i).

$$AF(i)=Kp(\phi tg-\phi(i))-Kd(\phi(i)-\phi(i-1)) \quad (68)$$

$$Afcomp(i)=Fsat(AF(i))+f(\phi tg) \quad (69)$$

Further, f(ϕtg) may be fixed to 1 to simplify the computing process.

The above-described embodiment is characterized in that (i) the A/F ratio correction amount AF(i) is calculated by the proportional derivative control, (ii) by setting the differential gain Kd so as to be higher than the proportional gain Kp, the characteristic of start-up of following the target A/F ratio ϕtg, of an actual A/F ratio is improved, and (iii) the A/F ratio correction amount AF(i) calculated by the proportional derivative control is limited within the predetermined range by using the saturation function Fsat(x), thereby solving the inconveniences caused by increasing the differential gain Kd (problems of the influence of noise and deterioration in following the target A/F ratio ϕtg). Consequently, when waste time or a phase delay of the subject to be controlled is large or even disturbance is large, while maintaining the stability of the A/F ratio feedback control, the gain (response) can be increased. Both higher gain and stability in the A/F ratio feedback control can be realized. The control apparatus is not easily influenced by an error in modeling, and robustness can be also improved.

The feedback control of the invention is not limited to the A/F ratio feedback control (what is called, main feedback control) as in the foregoing embodiment but can be applied to various feedback controls related to the control of the internal combustion engine. For example, the invention can be applied to any of sub feedback control of feedback-correcting a target A/F ratio on the upstream side of the catalyst on the basis of an output of an oxygen sensor (or exhaust gas sensor) disposed downstream of the catalyst, electronic throttle control, variable valve timing control, idle speed control, fuel pressure feedback control (fuel pump control), boost pressure feedback control of a turbo charger, and cruise control.

In the case of applying the invention to the sub feedback control, an input of a subject to be controlled is a target A/F ratio on the upstream side of the catalyst, and an output of the subject to be controlled is an output of the oxygen sensor or exhaust gas sensor disposed downstream of the catalyst.

In the case of applying the invention to the electronic throttle control, an input of a subject to be controlled is a control current (control duty) of the motor 331 of the electronic throttle system, and an output of the subject to be controlled is an output (throttle angle) of the throttle angle sensor 316.

In the case of applying the invention to the variable valve timing control, an input of a subject to be controlled is a control current (control duty) of a hydraulic control valve of each of the variable valve timing adjusting mechanisms 328 and 329, and an output of the subject to be controlled is an output (VVT angle) of a cam sensor.

In the case of applying the invention to the idle speed control, an input of a subject to be controlled is either an output (throttle angle) of the throttle angle sensor 316 or the angle of the idle speed control valve, and an output of the subject to be controlled is engine speed.

In the case of applying the invention to the fuel pressure feedback control, an input of a subject to be controlled is a control current (control duty) of a motor of a fuel pump, and an output of the subject-to be controlled is an output (fuel pressure) of the fuel pressure sensor.

In the case of applying the invention to the boost pressure feedback control of a turbo charger, an input of a subject to be controlled is an output (throttle angle) of the throttle angle sensor 316, and an output of the subject to be controlled is an output (boost pressure) of the boost pressure sensor.

In the case of applying the invention to the cruise control, an input of a subject to be controlled is an output (throttle angle) of the throttle angle sensor 316, and an output of the subject to be controlled is an output (vehicle speed) of the vehicle speed sensor.

The various feedback controls may be properly combined. The present invention may be applied to feedback controls other than the above.

Twelfth Embodiment

Figure 38:
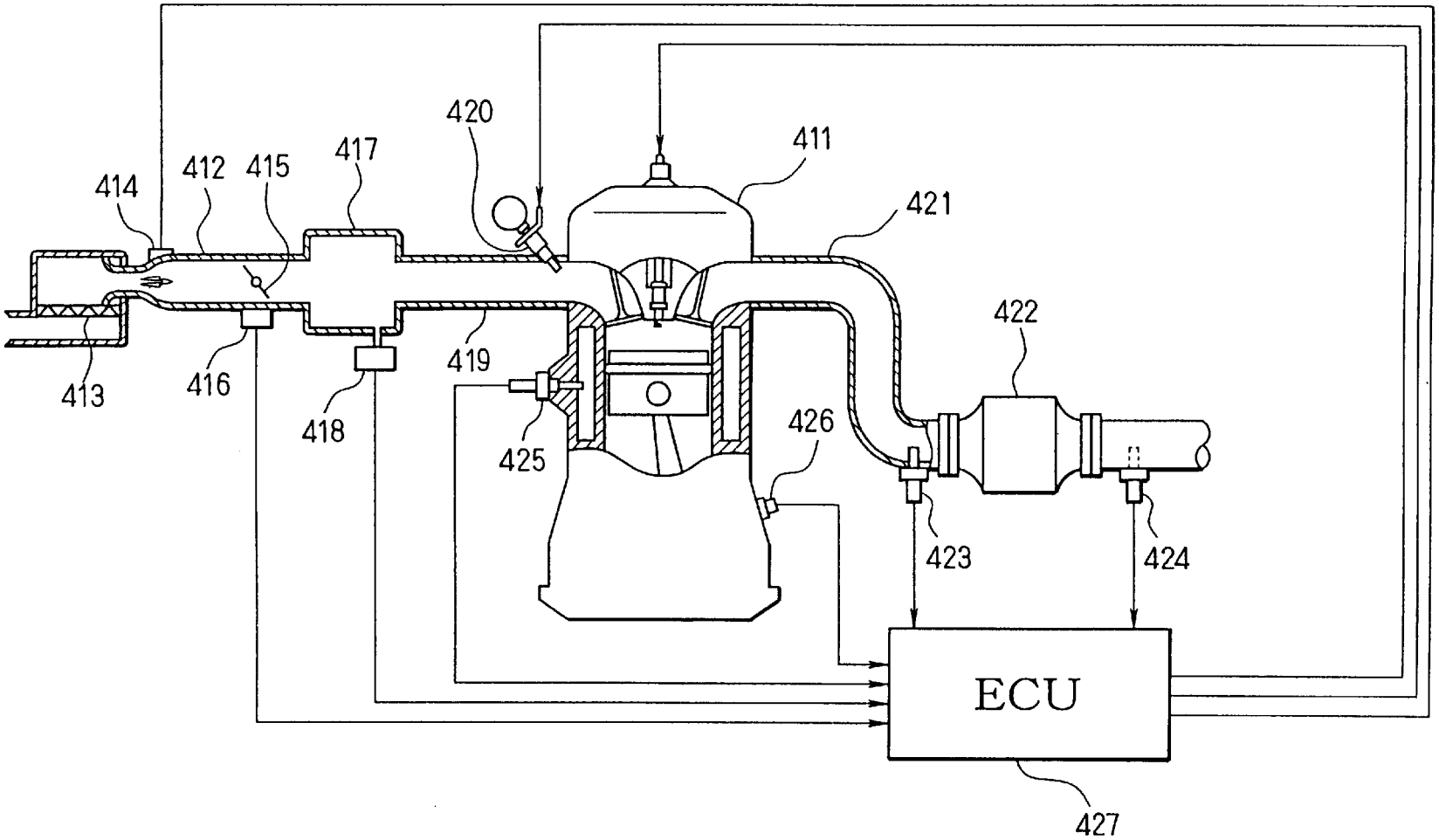
FIG. 38 is a schematic configuration diagram of a whole engine control system (twelfth embodiment)

The twelfth embodiment of the invention will be described hereinbelow with reference to the drawings. First, a schematic configuration of a whole engine control system will be described with reference to FIG. 38. In the uppermost stream part of an intake pipe 412 of an engine 411 as an internal combustion engine, an air cleaner 413 is provided. On the downstream side of the air cleaner 413, an air flow meter 414 for detecting an intake air volume is provided. On the downstream side of the air flow meter 414, a throttle valve 415 and a throttle angle sensor 416 are provided.

Further, on the downstream side of the throttle valve 415, a surge tank 417 is provided. The surge tank 417 is provided with an intake pipe pressure sensor 418 for detecting an intake pipe pressure. The surge tank 417 is also provided with an intake manifold 419 for introducing air into each of cylinders of the engine 411. A fuel injection valve 420 for injecting fuel is attached near the intake port of the intake manifold 419 of each cylinder.

In some midpoint of an exhaust pipe 421 (exhaust path) of the engine 411, a catalyst 422 such as a three-way catalyst for treating harmful components (CO, HC, NOx, and the like) in exhaust gases is disposed. On the upstream and downstream sides of the catalyst 422, sensors 423 and 424 for detecting A/F ratio of an exhaust gas are disposed, respectively. In the twelfth embodiment, as the upstream side sensor 423, a broad range A/F ratio sensor (linear A/F ratio sensor) for outputting a linear A/F ratio signal according to the A/F ratio is used. As the downstream side sensor 424, an oxygen sensor of which output voltage is inverted according to whether the A/F ratio of the exhaust gas is rich state or lean state with respect to the theoretical A/F ratio is used. To a cylinder block of the engine 411, a water temperature sensor 425 for detecting a cooling water temperature and a crank angle sensor 426 for detecting engine speed are attached.

Outputs of the various sensors are supplied to an engine control unit (hereinbelow, referred to as an "ECU") 427. The ECU 427 is constructed mainly by a microcomputer, and executes an A/F ratio feedback control program of FIG. 39 and a sub feedback control program of FIG. 40 stored in a built-in ROM (storage medium) to control the A/F ratio of the exhaust gas on the basis of the outputs of the upstream-side A/F ratio sensor 423 and the downstream side oxygen sensor 424. In this case, the A/F ratio feedback control program of FIG. 39 feedback-controls the A/F ratio (fuel injection amount) so that the A/F ratio of the exhaust gas upstream of the catalyst 422 coincides with the target A/F ratio λTG on the basis of the output of the upstream-side A/F ratio sensor 423, and corresponds to A/F ratio feedback control means in the present invention.

Figure 40:
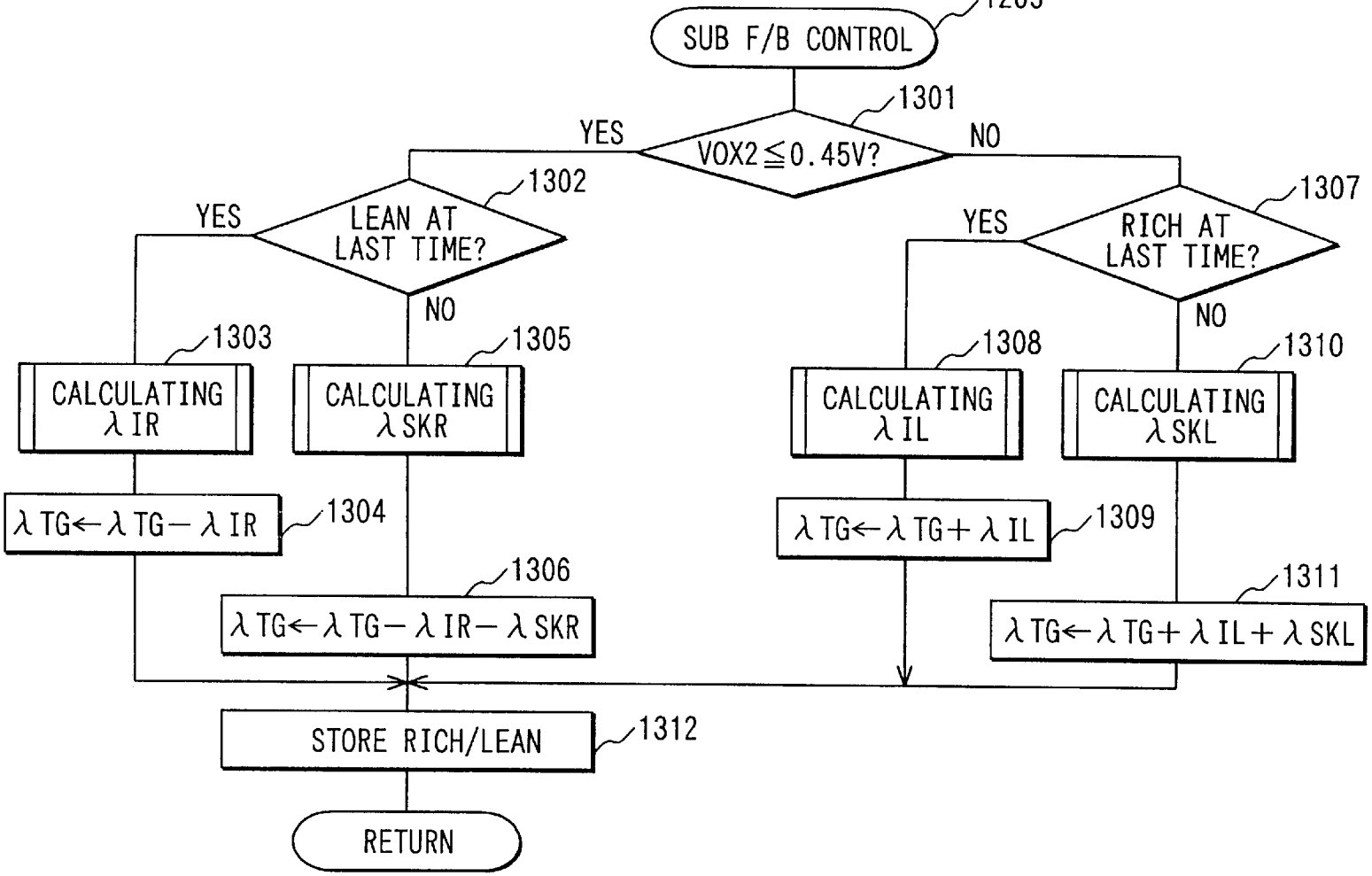
FIG. 40 is a flowchart showing the flow of processes of a sub feedback control program (twelfth embodiment)

The sub feedback control program of FIG. 40 performs sub feedback control for correcting the target A/F ratio λTG upstream of the catalyst 422 on the basis of the output of the downstream-side oxygen sensor 424 so that the A/F ratio downstream of the catalyst 422 coincides with a control target value (for example, in a theoretical A/F ratio range), and corresponds to sub feedback control means in the present invention. In the sub feedback control, at the time of correcting the target A/F ratio λTG upstream of the catalyst 422, by programs of FIGS. 41–44, parameters (rich integral term λIR, lean integral term λIL, rich skip term λSKR, and lean skip term λSKL) of the sub feedback control are calculated in accordance with deviations ΔAFR and AFL between actual A/F ratios on the upstream side of the catalyst 422 detected by the upstream-side A/F ratio sensor 423 and the theoretical A/F ratio. The function operates as parameter varying means in the present invention. The processes of each of the programs will be described hereinbelow.

Figure 39:
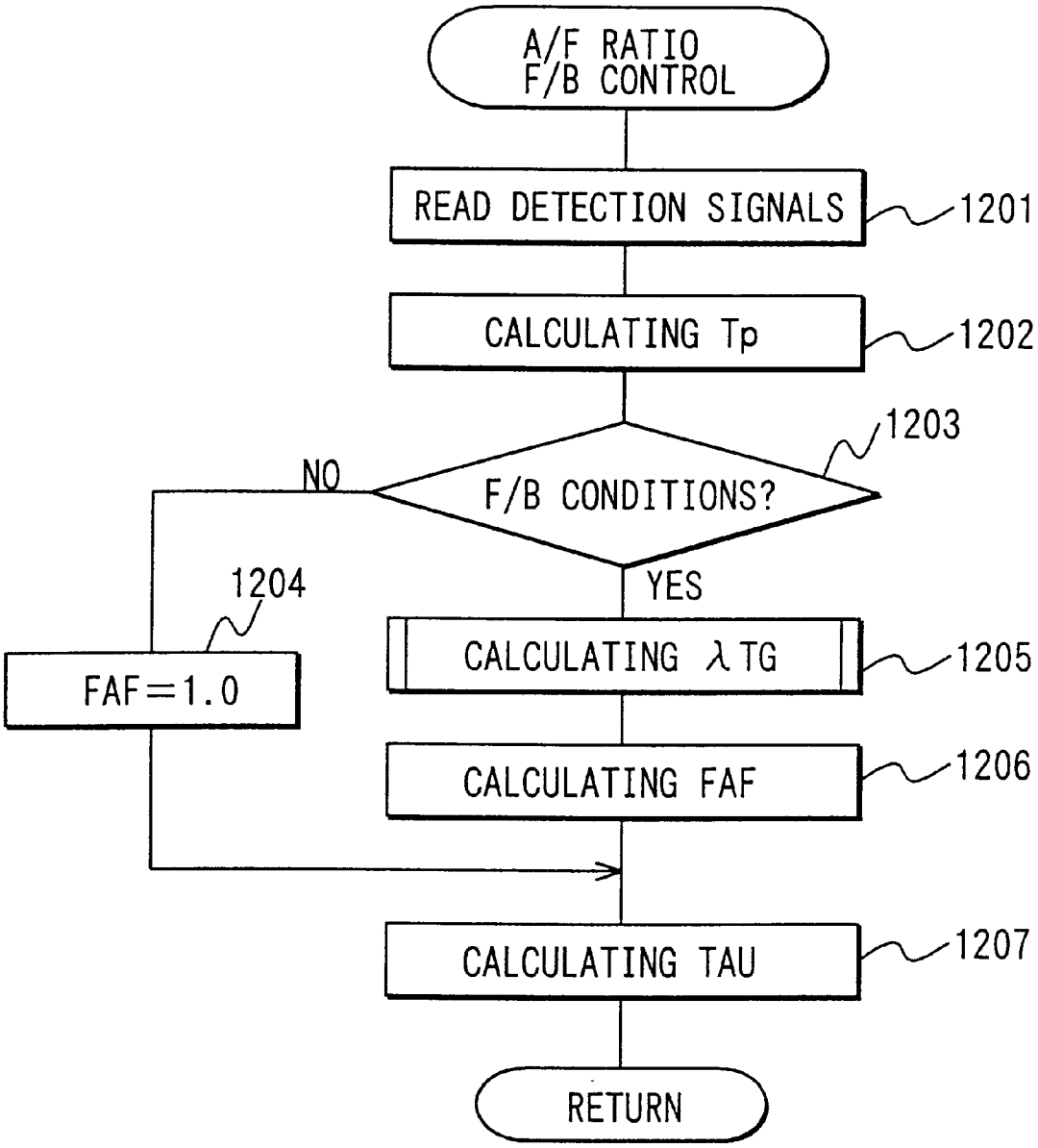
FIG. 39 is a flowchart showing the flow of processes of an exhaust gas A/F ratio feedback control program (twelfth embodiment)

The A/F ratio control program shown in FIG. 39 is a program for calculating a required fuel injection amount TAU by the A/F ratio feedback control and is started every predetermined crank angle (for example, every 180° CA in the case of a four-cylinder engine). When the program is started, first in step 1201, detection signals (such as engine speed, throttle angle, intake pipe pressure, cooling water temperature, output of the upstream-side A/F ratio sensor 423, and output of the downstream-side oxygen sensor 424) from the various sensors are read. After that, in step 1202, a basic fuel injection amount Tp is calculated from a map or the like in accordance with the engine operating conditions (engine speed, intake pipe pressure, and the like).

In step 1203, whether the A/F ratio feedback conditions are satisfied or not is determined. The A/F ratio feedback conditions are satisfied, for example, when a cooling water temperature is a predetermined value or higher, the engine speed is not high, and a load is not high. When it is determined in step 1203 that the A/F ratio feedback conditions are not satisfied, the program advances to step 1204 where an A/F ratio feedback correction factor FAF is set to "1.0", indicating that the feedback correction is not performed, and the program advances to step 1207.

On the other hand, when it is determined in step 1203 that the A/F ratio feedback conditions are satisfied, the program advances to step 1205 where the sub feedback control program of FIG. 40 which will be described hereinlater is executed to correct the target A/F ratio λTG upstream of the catalyst 422 on the basis of an output VOX2 of the downstream side oxygen sensor 424 (actual A/F ratio on the downstream side of the catalyst 422). After that, the program advances to step 1206, and an A/F ratio feedback correction factor FAF is calculated by the following equation on the basis of the target A/F ratio λTG on the upstream side of the catalyst 22 and the output λ of the upstream-side A/F ratio sensor 423 (actual A/F ratio on the upstream side of the catalyst 422).

$$FAF(i)=K1\cdot\lambda(i)+K2\cdot FAF(i-3)+K3\cdot FAF(i-2)+K4\cdot FAF(i-1)+ZI(i) \quad (70)$$

Here, ZI(i)=ZI(i−1)+Ka·{λTG−λ(i)}

Here, where a subscript (i) denotes a value of this time, a subscript (i−1) denotes a value of last time, a subscript (i−2) expresses a value of twice ago, and a subscript (i−3) indicates a value of three times ago. K1 to K4 denote optimum feedback constants, and Ka indicates an integral constant. By the process of step 1206, the A/F ratio feedback control based on the output λ of the upstream-side A/F ratio sensor 423 is performed.

In step 1207, the required fuel injection amount TAU is calculated by the following equation using the basic fuel injection amount Tp and the A/F ratio feedback correction factor FAF, and the program is finished.

$$TAU=Tp\times FAF\times FALL \quad (71)$$

Here, FALL denotes a correction factor (such as correction factor according to the cooling water temperature or correction factor at the time of acceleration or deceleration) other than the A/F ratio feedback correction factor FAF.

The sub feedback control program shown in FIG. 40 is a sub routine executed in step 1205 of the A/F ratio control program of FIG. 39. When the program is started, first, in step 1301, whether the A/F ratio on the downstream side of the catalyst 422 is lean or not is determined according to whether the output VOX2 of the downstream side oxygen sensor 424 is equal to or lower than a voltage (for example, 0.45V) corresponding to the theoretical A/F ratio. In the case of a lean state (VOX2≦0.45), the program advances to step 1302 and whether the A/F ratio on the downstream side was also lean state at last time or not is determined.

Figure 41:
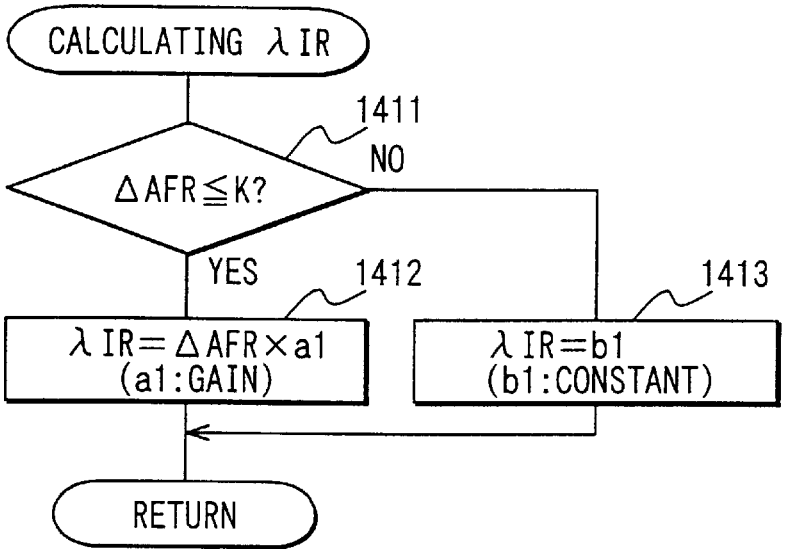
FIG. 41 is a flowchart showing the flow of processes of a rich integral term λIR calculating program (twelfth embodiment)

When the A/F ratio is lean state at last time and this time, the program advances to step 1303 where the rich integral term λIR calculating program shown in FIG. 41 is executed and the rich integral term λIR is calculated as follows. First, in step 311, a deviation ΔAFR (=λ−1.0) between the actual A/F ratio (excess air factor λ) on the upstream side of the catalyst 422 detected by the upstream-side A/F ratio sensor 423 and the theoretical A/F ratio (λ=1.0) is calculated, and whether the A/F ratio deviation ΔAFR is equal to or smaller than a predetermined value K is determined. The predetermined value K is set as a limit value in a range where the downstream side oxygen sensor 424 can detect the A/F ratio on the downstream side of the catalyst 422.

When the A/F ratio deviation ΔAFR is equal to or smaller than the predetermined value K, the program advances to step 1412 where the rich integral term λIR is obtained by multiplying the A/F ratio deviation ΔAFR by a predetermined gain a.

$$\lambda IR=\lambda AFR\times a1 \quad (72)$$

When the A/F ratio deviation ΔAFR is equal to or smaller than the predetermined value K, the rich integral term λIR increases in proportional to the A/F ratio deviation ΔAFR.

On the other hand, when the A/F ratio deviation ΔAFR is larger than the predetermined value K, the program advances to step 1413 where the rich integral term λIR is set as a predetermined value b1. The predetermined value b1 is set to a value smaller than the maximum value of the rich integral term λIR in the case where the A/F ratio deviation ΔAFR is equal to or smaller than the predetermined value K (that is, the rich integral term λIR when the A/F ratio deviation ΔAFR is equal to the predetermined value K).

After setting the rich integral term λIR as described above, the program advances to step 1304 in FIG. 40 where the target A/F ratio λTG of this time is set to a value obtained by subtracting the rich integral term λIR from the target A/F ratio λTG of last time.

$$\lambda TG \leftarrow \lambda TG - \lambda IR \quad (73)$$

Figure 42:
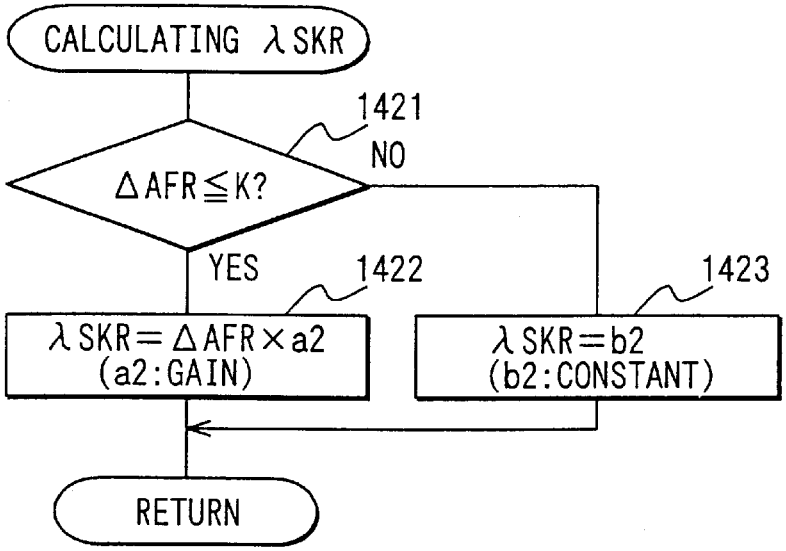
FIG. 42 is a flowchart showing the flow of processes of a rich skip term λSKR calculating program (twelfth embodiment)

On the other hand, when the A/F ratio on the downstream side of the catalyst 422 was rich state at last time and is lean state at this time, that is, immediately after the A/F ratio on the downstream side of the catalyst 422 was changed from the rich state to the lean state, the program advances from step 1302 to step 1305 where the rich skip term λSKR calculating program shown in FIG. 42 is executed to calculate the rich skip term λSKR as follows. First, in step 1421, in a manner similar to step 1411, the deviation ΔAFR (=λ−1.0) between the actual A/F ratio (excess air factor λ) on the upstream side of the catalyst 422 detected by the upstream-side A/F ratio sensor 423 and the theoretical A/F ratio (λ=1.0) is calculated, and whether the A/F ratio deviation ΔAFR is equal to or smaller than the predetermined value K is determined.

When the A/F ratio deviation ΔAFR is equal to or smaller than the predetermined value K, the program advances to step 1422 where the rich skip term λSKR is obtained by multiplying the A/F ratio deviation ΔAFR by a predetermined gain a2.

$$\lambda SKR = \lambda AFR \times a2 \quad (74)$$

When the A/F ratio deviation ΔAFR is equal to or smaller than the predetermined value K, the rich skip term λSKR increases in proportional to the A/F ratio deviation ΔAFR.

On the other hand, when the A/F ratio deviation ΔAFR is larger than the predetermined value K, the program advances to step 1423 where the rich skip term λSKR is set as a predetermined value b2. The predetermined value b2 is smaller than the maximum value of the rich skip term λSKR in the case where the A/F ratio deviation ΔAFR is equal to or smaller than the predetermined value K (that is, the rich skip term λSKR when the A/F ratio deviation ΔAFR is equal to the predetermined value K).

After setting the rich skip term λSKR as described above, the program advances to step 1306 in FIG. 40 where the target A/F ratio λTG of this time is set to a value obtained by subtracting the rich integral term λIR and the rich skip term λSKR from the target A/F ratio λTG of last time.

$$\lambda TG \leftarrow \lambda TG - \lambda IR - \lambda SKR \quad (75)$$

On the other hand, in step 1301, when the A/F ratio on the downstream side of the catalyst 422 of this time is determined as a rich state (VOX2>0.45V), the program advances to step 1307 and whether the A/F ratio on the downstream side of the catalyst 422 was also high last time is determined. When the A/F ratio was also rich last time like this time, the program advances to step 1308 where the lean integral term λIL shown in FIG. 43 is calculated as follows. First, in step 1431, a deviation ΔAFL (=1.0−λ) between the actual A/F ratio (excess air factor λ) on the upstream side of the catalyst 422 detected by the upstream-side A/F ratio sensor 423 and the theoretical A/F ratio (λ=1.0) is calculated, and whether the A/F ratio deviation ΔAFL is equal to or smaller than a predetermined value K is determined. The predetermined value K is set as a limit value in a range where the downstream side oxygen sensor 424 can detect the A/F ratio on the downstream side of the catalyst 422.

When the A/F ratio deviation ΔAFL is equal to or smaller than the predetermined value K, the program advances to step 1432 where the lean integral term λIL is obtained by multiplying the A/F ratio deviation ΔAFL by a predetermined gain a3.

$$\lambda IL = \lambda AFL \times a3 \quad (76)$$

When the A/F ratio deviation ΔAFL is equal to or smaller than the predetermined value K, the lean integral term λIL increases in proportional to the A/F ratio deviation ΔAFL.

On the other hand, when the A/F ratio deviation ΔAFL is larger than the predetermined value K, the program advances to step 1433 where the lean integral term λIL is set as a predetermined value b3. The predetermined value b3 is set to a value smaller than the maximum value of the lean integral term λIL in the case where the A/F ratio deviation ΔAFL is equal to or smaller than the predetermined value K (that is, the lean integral term λIL when the A/F ratio deviation ΔAFL is equal to the predetermined value K).

After setting the lean integral term λIL as described above, the program advances to step 1309 in FIG. 40 where the target A/F ratio λTG of this time is set to a value obtained by adding the lean integral term λIL to the target A/F ratio λTG of last time.

$$\lambda TG \leftarrow \lambda TG + \lambda IL \quad (77)$$

On the other hand, when the A/F ratio on the downstream side of the catalyst 422 was lean state at last time and is rich state at this time, that is, immediately after the A/F ratio on the downstream side of the catalyst 422 was changed from the lean state to the rich state, the program advances from step 1307 to step 1310 where the lean skip term λSKL calculating program shown in FIG. 44 is executed to calculate the lean skip term λSKL as follows. First, in step 1441, in a manner similar to step 1431, the deviation ΔAFL (=1.0−λ) between the actual A/F ratio (excess air factor λ) on the upstream side of the catalyst 422 detected by the upstream-side A/F ratio sensor 423 and the theoretical A/F ratio (λ=1.0) is calculated, and whether the A/F ratio deviation ΔAFL is equal to or smaller than the predetermined value K is determined.

When the A/F ratio deviation ΔAFL is equal to or smaller than the predetermined value K, the program advances to step 1442 where the lean skip term λSKL is obtained by multiplying the A/F ratio deviation ΔAFL by a predetermined gain a4.

$$\lambda SKL = AFL \times a4 \quad (78)$$

When the A/F ratio deviation ΔAFL is equal to or smaller than the predetermined value K, the lean skip term λSKL increases in proportional to the A/F ratio deviation ΔAFL.

On the other hand, when the A/F ratio deviation ΔAFL is larger than the predetermined value K, the program advances to step 1443 where the lean skip term λSKL is set as a predetermined value b4. The predetermined value b4 is smaller than the maximum value of the lean skip term λSKL in the case where the A/F ratio deviation ΔAFL is equal to or smaller than the predetermined value K (that is, the lean skip term λSKL when the A/F ratio deviation ΔAFL is equal to the predetermined value K).

After setting the lean skip term λSKL, the program advances to step 1311 in FIG. 40 where the target A/F ratio λTG of this time is set to a value obtained by adding the lean integral term λIL and the lean skip term λSKL to the target A/F ratio λTG of last time.

$$\lambda TG \leftarrow \lambda TG + \lambda IL + \lambda SKL \quad (79)$$

As described above, the target A/F ratio λTG of this time is set in any of the steps 1304, 1306, 1309, and 1311. After that, the program advances to step 1312 where the rich/lean state of the A/F ratio on the downstream side of the catalyst 422 of this time is stored, and the program is finished.

Figure 45:
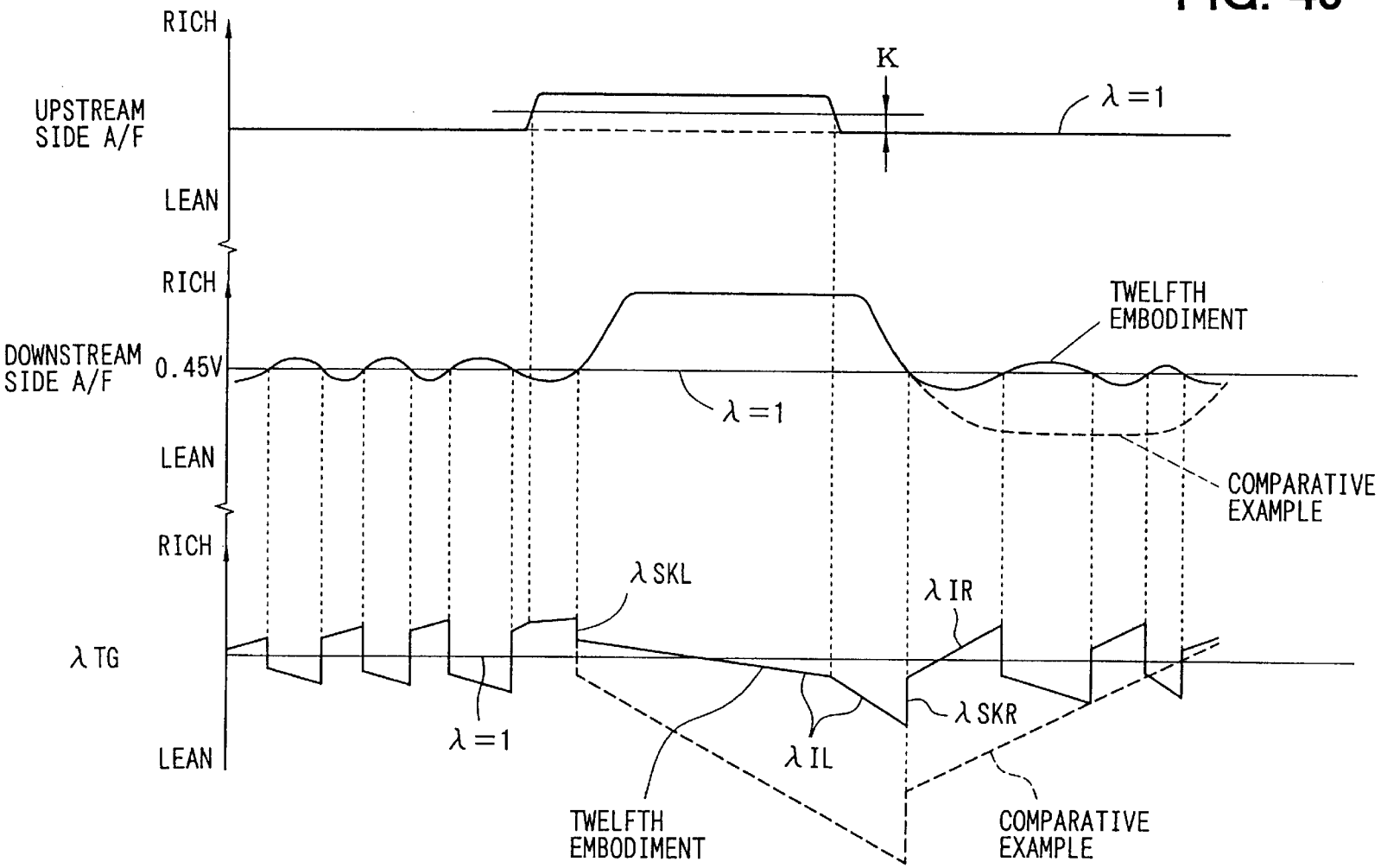
FIG. 45 is a time chart showing behaviors of exhaust gas A/F ratio control (twelfth embodiment)

Effects of the A/F ratio feedback control of the above-described embodiment will now be explained by using the time chart of FIG. 45. The time chart of FIG. 45 shows an example of control in which the state where the actual A/F ratio on the upstream side of the catalyst 422 is controlled around the theoretical A/F ratio changes to a state where the actual A/F ratio is deviated to the high side by more than the predetermined value K and, after elapse of predetermined time, the actual A/F ratio on the upstream side of the catalyst 422 is returned to the theoretical A/F ratio. In a comparative example shown by a broken line in FIG. 45, the parameters (rich integral term λIR, lean integral term λIL, rich skip term λSKR, and lean skip term λSKL) of the sub feedback control are always fixed to predetermined values, and the target A/F ratio λTG is corrected.

In the twelfth embodiment, when the deviation between the actual A/F ratio on the upstream side of the catalyst 422 detected by the upstream-side A/F ratio sensor 423 and the theoretical A/F ratio is equal to or smaller than the predetermined value K, the parameters λIR, λIL, λSKR, and λSKL of the sub feedback control are increased in proportional to the A/F ratio. Consequently, when the deviation between the actual A/F ratio on the upstream side of the catalyst 422 and the theoretical A/F ratio is equal to or smaller than the predetermined value K, within the range the target A/F ratio λTG is not excessively corrected by the sub feedback control, the parameters λIR, λIL, λSKR, and λSKL are increased maximally in accordance with the deviation, thereby increasing the effects of the sub feedback control, and the A/F ratio feedback control with high response is realized.

After that, when the deviation between the actual A/F ratio on the upstream side of the catalyst 422 and the theoretical A/F ratio becomes larger than the predetermined value K, in the embodiment, while setting the parameters λIR, λIL, λSKR, and λSKL of the sub feedback control to smaller values, the sub feedback control is continued, and the target A/F ratio λTG is updated little by little.

On the other hand, in the comparative example, even when the deviation between the actual A/F ratio on the upstream side of the catalyst 422 and the theoretical A/F ratio becomes larger than the predetermined value K, without changing the parameters λIR, λIL, λSKR, and λSKL of the sub feedback control, the sub feedback control is continued. Consequently, the target A/F ratio λTG is largely deviated to the lean state side. After that, even when the actual A/F ratio on the upstream side of the catalyst 422 is returned to about the theoretical value, and an output of the downstream side oxygen sensor 424 is inverted to the lean state side, it takes long time until the target A/F ratio λTG is returned to about the theoretical A/F ratio. During the period, the state where the actual A/F ratio on the downstream side of the catalyst 422 is largely deviated to the lean state side continues. It takes time for the actual A/F ratio on the downstream side of the catalyst 422 returns to the theoretical A/F ratio, so that the catalytic conversion efficiency of the catalyst 422 deteriorates.

In contrast, in the twelfth embodiment, when the deviation between the actual A/F ratio on the upstream side of the catalyst 422 and the theoretical A/F ratio becomes larger than the predetermined value K, while setting the parameters λIR, λIL, λSKR, and λSKL of the sub feedback control to smaller values, the sub feedback control is continued, and the target A/F ratio λTG is updated. Within the range the target A/F ratio λTG is not excessively corrected, the target A/F ratio λTG is updated little by little around the theoretical A/F ratio. Consequently, after that, when the actual A/F ratio on the upstream side of the catalyst 422 is returned to about the theoretical A/F ratio and the output of the downstream side oxygen sensor 424 is inverted to the lean state side, the target A/F ratio is promptly returned to about the theoretical A/F ratio. Without large deviation of the actual A/F ratio on the downstream side of the catalyst 422 to the lean state side, the target A/F ratio is controlled to about the theoretical A/F ratio with high response. By the above, the exhaust gas conversion efficiency of the catalyst 422 is improved as compared with the comparative example.

Although the parameters λIR, λIL, λSKR, and λSKL of the sub feedback control are variably set in accordance with the deviations ΔAFR and ΔAFL between the actual A/F ratio on the upstream side of the catalyst 422 detected by the upstream-side A/F ratio sensor 423 and the theoretical A/F ratio in the embodiment, the parameters λIR, λIL, λSKR, and λSKL of the sub feedback control may be variably set in accordance with the deviations ΔAFRTG and ΔAFLTG between the target A/F ratio on the upstream side of the catalyst 422 and the theoretical A/F ratio. In this case, it is sufficient to replace the actual A/F ratio deviations ΔAFR and ΔAFL with the target A/F ratio deviations ΔAFRTG and ΔAFLTG in each of the programs of FIGS. 41–44.

In the twelfth embodiment, the parameters λIR, λIL, λSKR, and λSKL are calculated by using mathematical expressions using the A/F ratio deviations ΔAFR and ΔAFL in the programs of FIGS. 41–44. Alternatively, as shown in FIG. 46, the parameters may be set according to the A/F ratio deviation by using a table defining the relations between the actual A/F ratio deviations ΔAFR and ΔAFL (or the target A/F ratio variations ΔAFRTG and ΔAFLTG) and the parameters λIR, λIL, λSKR, and λSKL of the sub feedback control. Data characteristics of the table may be set in such a manner that when the A/F ratio deviation is equal to or smaller than a predetermined value, the parameter is increased in proportional to the A/F ratio deviation, and when the A/F ratio deviation is larger than the predetermined value, the parameter is fixed to a smaller predetermined value.

It is also possible to variably set the integral terms λIR and λIL in accordance with the actual A/F ratio deviations ΔAFR and ΔAFL and variably set the skip terms λSKR and λSKL in accordance with the target A/F ratio deviations ΔAFRTG and ΔAFLTG. On the contrary, it is also possible to variably set the skip terms λSKR and λSKL in accordance with the actual A/F ratio deviations ΔAFR and ΔAFL and variably set the integral terms λIR and λIL in accordance with the target A/F ratio deviations ΔAFRTG and ΔAFLTG.

In the twelfth embodiment, both the integral term and the skip term are variably set in accordance with the A/F ratio deviations. Alternatively, one of the integral term and the skip term maybe variably set.

In the twelfth embodiment, when the A/F ratio deviation is equal to or smaller than the predetermined value K, the parameters are variably set according to the A/F ratio deviation. It is also possible not to variably set the parameters in accordance with the A/F ratio deviation when the A/F ratio deviation is equal to or smaller than the predetermined value K. In this case as well, when the A/F ratio deviation is larger than the predetermined value K, in a manner similar to the foregoing embodiment, by performing the sub feedback control while fixing the parameters to smaller predetermined values, the sub feedback control can be carried out within the range the target A/F ratio is not excessively corrected, so that the catalytic conversion efficiency can be improved.

The invention can be variously modified. For example, as each of the upstream side sensor 423 and the downstream side sensor 424, any of the broad range A/F ratio sensor (linear A/F ratio sensor) and the oxygen sensor may be used.

What is claimed is:

1. A control apparatus for an internal combustion engine, for feedback controlling an input of a subject to be controlled in an internal combustion engine so that an output of the subject to be controlled coincides with a final target value, comprising:

intermediate target value setting means for setting an intermediate target value on the basis of the output of the subject to be controlled and the final target value; and feedback control means for calculating a correction amount of the input of the subject to be controlled on the basis of the output of the subject to be controlled and the intermediate target value.

2. A control apparatus for an internal combustion engine according to claim 1, wherein the intermediate target value setting means sets the intermediate target value so as to be between an output of the subject to be controlled in computation of last time or predetermined times ago and the final target value.

3. A control apparatus for an internal combustion engine according to claim 1, wherein the intermediate target value setting means obtains the intermediate target value by adding the final target value and a value derived by multiplying a deviation between an output of the subject to be controlled in computation of last time or predetermined times ago and the final target value by a positive coefficient smaller than 1.

4. A control apparatus for an internal combustion engine according to claim 1, wherein an expression used to calculate a correction amount of an input of the subject to be controlled includes a term which becomes larger as a deviation between the intermediate target value and an output of the subject to be controlled becomes larger.

5. A control apparatus for an internal combustion engine according to claim 1, wherein an expression used to calculate a correction amount of an input of the subject to be controlled includes a term which becomes larger as an integration value of a deviation between the intermediate target value and an output of the subject to be controlled becomes larger.

6. A control apparatus for an internal combustion engine according to claim 1, wherein the intermediate target value setting means sets an intermediate target value of a deviation on the basis of a deviation of last time between an output of the subject to be controlled and the final target value, and the feedback control means calculates a correction amount of an input of the subject to be controlled on the basis of a deviation between the output of the subject to be controlled and the final target value and the intermediate target value.

7. An exhaust gas A/F ratio control apparatus for an internal combustion engine, comprising:

a catalyst for treating an exhaust gas of an internal combustion engine;

an upstream-side exhaust gas sensor and a downstream-side exhaust gas sensor for detecting A/F ratio or rich/lean of the exhaust gas on the upstream and downstream sides of the catalyst, respectively;

exhaust gas A/F ratio feedback control means for feedback-controlling a fuel injection amount so that an A/F ratio detected by the upstream-side exhaust gas sensor becomes equal to an upstream-side target exhaust gas A/F ratio; and sub-feedback control means for correcting the upstream-side target exhaust gas A/F ratio so that an exhaust gas A/F ratio detected by the downstream-side exhaust gas sensor becomes equal to a downstream-side target exhaust gas A/F ratio, wherein the sub-feedback control means has back stepping control means for calculating a correction amount of the upstream-side target exhaust gas A/F ratio on the basis of a state variable obtained from an exhaust gas A/F ratio detected by the downstream-side exhaust gas sensor by using a back stepping method.

8. An exhaust gas A/F ratio control apparatus for an internal combustion engine according to claim 7, wherein the back stepping control means divides a model of a subject to be controlled into a plurality of sub systems, and each sub system includes a virtual input term calculated by the state variable.

9. An exhaust gas A/F ratio control apparatus for an internal combustion engine according to claim 8, wherein the virtual input term has a term proportional to an integration value of the state variable.

10. An exhaust gas A/F ratio control apparatus for an internal combustion engine according to claim 8, wherein the input term is set by using a non-linear function expressed as a linear line or curve having an inclination smaller than 1 and passing first and third quadrants in a predetermined region including the origin and expressed as a linear line having an inclination of 1 in the other region.

11. An exhaust gas A/F ratio control apparatus for an internal combustion engine according to claim 7, wherein the back stepping control means calculates the correction amount by a linear sum of the state variable, a deviation between the state variable and the virtual input term, and an integration value of the deviation.

12. An exhaust gas A/F ratio control apparatus for an internal combustion engine according to claim 11, wherein the back stepping control means calculates each of coefficients of the linear sum by an optimum regulator based on a model of a subject to be controlled at the time of calculating the correction amount.

13. An exhaust gas A/F ratio control apparatus for an internal combustion engine, comprising:

a catalyst for treating exhaust gases of an internal combustion engine;

an upstream-side exhaust gas sensor and a downstream-side exhaust gas sensor for detecting A/F ratio or rich/lean of an exhaust gas on the upstream and downstream sides of the catalyst, respectively;

exhaust gas A/F ratio feedback control means for feedback controlling a fuel injection amount so that an A/F ratio detected by the upstream-side exhaust gas sensor becomes equal to an upstream-side target exhaust gas A/F ratio;

sub feedback control means for performing sub feedback control for correcting the upstream-side target exhaust gas A/F ratio so that an exhaust gas A/F ratio detected by the downstream-side exhaust gas sensor becomes a downstream-side target exhaust gas A/F ratio; and intermediate target value setting means for setting an intermediate target value of the sub feedback control on the basis of the exhaust gas A/F ratio detected by the downstream-side exhaust gas sensor and a final downstream-side target exhaust gas A/F ratio, wherein the sub feedback control means calculates a correction amount of the upstream side target exhaust gas A/F ratio on the basis of the exhaust gas A/F ratio detected by the downstream-side exhaust gas sensor and the intermediate target value.

14. An exhaust gas A/F ratio control apparatus for an internal combustion engine according to claim 13, wherein the intermediate target value setting means sets the intermediate target value so as to be between an exhaust gas A/F ratio detected by the downstream-side exhaust gas sensor in computation of last time or a predetermined number of times ago and a final downstream-side target exhaust gas A/F ratio.

15. An exhaust gas A/F ratio control apparatus for an internal combustion engine according to claim 13, wherein the intermediate target value setting means obtains the intermediate target value by adding a final downstream-side target exhaust gas A/F ratio and a value obtained by multiplying a deviation between the exhaust gas A/F ratio detected by the downstream-side exhaust gas sensor in computation of last time or a predetermined number of times ago and a final downstream-side target exhaust gas A/F ratio by a positive coefficient smaller than 1.

16. An exhaust gas A/F ratio control apparatus for an internal combustion engine according to claim 13, wherein an equation for calculating a correction amount of the upstream-side target exhaust gas A/F ratio includes a term which increases as a deviation between the intermediate target value and the exhaust gas A/F ratio detected by the downstream-side exhaust gas sensor becomes larger.

17. An exhaust gas A/F ratio control apparatus for an internal combustion engine according to claim 13, wherein an equation for calculating a correction amount of the upstream-side target exhaust gas A/F ratio includes a term which increases as an integration value of a deviation between the intermediate target value and the exhaust gas A/F ratio detected by the downstream-side exhaust gas sensor becomes larger.

18. An exhaust gas A/F ratio control apparatus for an internal combustion engine according to claim 13, wherein an equation for calculating a correction amount of the upstream-side target exhaust gas A/F ratio includes a term which is switched according to whether the exhaust gas A/F ratio detected by the downstream-side exhaust gas sensor is rich or lean.

19. A control apparatus for an internal combustion engine, comprising feedback control means for feedback-controlling an input of a subject to be controlled of an internal combustion engine so that an output of the subject to be controlled coincides with a target value, wherein the feedback control means has: proportional derivative means for calculating a correction amount of an input of the subject to be controlled by proportional derivative control in which a gain of a differential term is higher than a gain of a proportional term; and regulating means for regulating the correction amount calculated by the proportional derivative means so as to be within a predetermined range.

20. A control apparatus for an internal combustion engine according to claim 19, wherein the feedback control means executes any of exhaust gas A/F ratio feedback control, electronic throttle control, variable valve timing control, idle speed control, fuel pressure feedback control, boost pressure feedback control of a turbo charger, and cruise control.

21. An exhaust gas A/F ratio control apparatus for an internal combustion engine, in which a sensor for detecting A/F ratio or rich/lean of exhaust gas is disposed on each of the upstream side and the downstream side of a catalyst for treating exhaust gases disposed in an exhaust path of an internal combustion engine, comprising:

exhaust gas A/F ratio feedback control means for feedback controlling an exhaust gas A/F ratio on the upstream side of the catalyst on the basis of an output of the upstream side sensor;

sub feedback control means for performing sub feedback control for reflecting an output of the downstream side sensor into the feedback control on the exhaust gas A/F ratio on the upstream of the catalyst; and parameter varying means for variably setting at least one of parameters of the sub feedback control in accordance with a deviation between the exhaust gas A/F ratio on the upstream side of the catalyst and a theoretical exhaust gas A/F ratio.

22. An exhaust gas A/F ratio control apparatus for an internal combustion engine according to claim 21, wherein the parameter varying means uses a detection value of the upstream side sensor as an exhaust gas A/F ratio on the upstream side of the-catalyst, and variably sets the parameter in accordance with the deviation between the detection value and the theoretical exhaust gas A/F ratio.

23. An exhaust gas A/F ratio control apparatus for an internal combustion engine according to claim 21, wherein the parameter varying means uses a target exhaust gas A/F ratio of the feedback control on the exhaust gas A/F ratio on the upstream side of the catalyst as an exhaust gas A/F ratio on the upstream side of the catalyst, and variably sets the parameter in accordance with the deviation between the target exhaust gas A/F ratio and the theoretical exhaust gas A/F ratio.

24. An exhaust gas ratio control apparatus for an internal combustion engine according to claim 21, wherein the parameter varying means increases at least one of parameters of the sub feedback control as a deviation between the exhaust gas A/F ratio on the upstream side of the catalyst and a theoretical exhaust gas A/F ratio increases when the exhaust gas A/F ratio deviation is in a predetermined range and, when the exhaust gas A/F ratio deviation is out of the predetermined range, the parameter varying means fixes the parameter to a predetermined value smaller than the maximum value of the parameter within the predetermined range.

25. An exhaust gas A/F ratio control apparatus for an internal combustion engine according to claim 21, wherein the parameter variably set by the parameter varying means is an integral term and/or a skip term, and the sub feedback control means corrects the target exhaust gas A/F ratio of the feedback control on the exhaust gas A/F ratio on the upstream side of the catalyst by using the integral term and the skip term.

26. An exhaust gas A/F ratio control apparatus for an internal combustion engine according to claim 21, wherein the upstream side sensor detects the A/F ratio of the exhaust gas, and the downstream side sensor detects the rich/lean of the exhaust gas.

27. An exhaust gas A/F ratio control apparatus for an internal combustion engine, in which a sensor for detecting A/F ratio of exhaust gas is disposed on each of the upstream side and the downstream side of a catalyst for treating exhaust gases disposed in an exhaust path of an internal combustion engine, comprising:

exhaust gas A/F ratio feedback control means for feedback controlling an exhaust gas A/F ratio on the upstream side of the catalyst on the basis of an output of the upstream side sensor;

sub feedback control means for performing sub feedback control for reflecting an output of the downstream side sensor into the feedback control on the exhaust gas A/F ratio on the upstream of the catalyst; and parameter varying means for fixing at least one of parameters of the sub feedback control to a predetermined value smaller than a maximum value of the parameter within a predetermined range when a deviation between the exhaust gas A/F ratio on the upstream side of the catalyst and a theoretical exhaust gas A/F ratio is out of the predetermined range.

* * * * *